US012577737B2

(12) United States Patent
Wiatrowski

(10) Patent No.: US 12,577,737 B2
(45) Date of Patent: Mar. 17, 2026

(54) CONCRETE SLAB JOINT FORMING SYSTEM AND METHOD

(71) Applicant: Illinois Tool Works Inc., Glenview, IL (US)

(72) Inventor: Darrell A. Wiatrowski, Libertyville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 113 days.

(21) Appl. No.: 18/188,072

(22) Filed: Mar. 22, 2023

(65) Prior Publication Data

US 2023/0323609 A1 Oct. 12, 2023

Related U.S. Application Data

(60) Provisional application No. 63/326,636, filed on Apr. 1, 2022.

(51) Int. Cl.

| | |
|---|---|
| ***E01C 11/10*** | (2006.01) |
| ***E01C 11/14*** | (2006.01) |
| ***E04B 1/48*** | (2006.01) |
| ***E04B 1/68*** | (2006.01) |

(52) U.S. Cl.

CPC ..... *E01C 11/106* (2013.01); *E01C 11/14* (2013.01); *E04B 1/483* (2013.01); *E04B 1/6807* (2013.01); *E01C 2201/16* (2013.01)

(58) Field of Classification Search

CPC .... E01C 11/106; E01C 11/14; E01C 2201/16; E04B 1/483; E04B 1/6807

See application file for complete search history.

(56) References Cited

U.S. PATENT DOCUMENTS

| | | | | |
|---|---|---|---|---|
| 1,223,045 A | | 4/1917 | Ferguson | |
| 2,039,775 A | * | 5/1936 | Burgess | E01C 11/14 404/69 |
| 2,215,653 A | * | 9/1940 | Robertson | E01C 11/14 404/62 |
| 2,949,828 A | * | 8/1960 | Carnes | E01C 11/106 404/74 |
| D226,808 S | | 5/1973 | Rollins | |
| 3,880,535 A | | 4/1975 | Durham et al. | |

(Continued)

FOREIGN PATENT DOCUMENTS

| | | | | |
|---|---|---|---|---|
| DE | 1894744 U | | 6/1964 | |
| EP | 3910109 A1 | * | 11/2021 | E01C 11/14 |

(Continued)

OTHER PUBLICATIONS

Extended European Search Report from European Application No. 23151217.9, dated Aug. 11, 2023 (11 pages).

(Continued)

*Primary Examiner* — Jessie T Fonseca

(74) *Attorney, Agent, or Firm* — Neal, Gerber & Eisenberg LLP

(57) ABSTRACT

A concrete slab joint forming system and method for forming a joint between adjacent concrete slabs. In various embodiments, the concrete slab joint forming system includes a concrete slab joint former, an extension connector, a cross intersection connector, a tee intersection connector, an end connector, a field cut connector, and/or any combination of any quantity of these components.

16 Claims, 64 Drawing Sheets

(56) References Cited

U.S. PATENT DOCUMENTS

| | | | | |
|---|---|---|---|---|
| 3,905,169 | A | 9/1975 | Gallo | |
| 4,078,757 | A | 3/1978 | Waters | |
| D256,663 | S | 9/1980 | Gilb | |
| D260,340 | S | 8/1981 | Hardy | |
| 4,332,504 | A * | 6/1982 | Arai | E01D 19/06 14/73.1 |
| 4,522,531 | A * | 6/1985 | Thomsen | E01C 11/14 404/49 |
| 5,005,331 | A | 4/1991 | Shaw et al. | |
| D360,476 | S | 7/1995 | Smeja et al. | |
| D364,554 | S | 11/1995 | Seo | |
| D374,605 | S | 10/1996 | Chase | |
| D402,536 | S | 12/1998 | Cousins | |
| D414,732 | S | 10/1999 | Redmond | |
| D466,394 | S | 12/2002 | Neider et al. | |
| 6,532,714 | B1 | 3/2003 | Ferm et al. | |
| D505,065 | S | 5/2005 | Smeja et al. | |
| 6,926,463 | B2 | 8/2005 | Shaw et al. | |
| 7,101,134 | B2 * | 9/2006 | LeVey | F16B 25/0047 411/416 |
| 7,228,666 | B2 | 6/2007 | Michiels | |
| D558,039 | S | 12/2007 | Skinner | |
| D558,040 | S | 12/2007 | Skinner | |
| D558,041 | S | 12/2007 | Skinner | |
| 7,338,230 | B2 | 3/2008 | Shaw et al. | |
| 7,516,576 | B1 | 4/2009 | Mullane | |
| D608,917 | S | 1/2010 | Ward et al. | |
| D617,181 | S | 6/2010 | Mcmullen | |
| D622,135 | S | 8/2010 | Kubic | |
| 8,210,504 | B1 | 7/2012 | Skornickel | |
| 8,539,726 | B2 | 9/2013 | Laiho et al. | |
| D710,038 | S | 7/2014 | Keen | |
| D768,470 | S | 10/2016 | Noturno | |
| D773,922 | S | 12/2016 | Fiebig et al. | |
| 9,765,485 | B2 | 9/2017 | Keen | |
| D802,798 | S | 11/2017 | Belisle | |
| 10,077,533 | B2 | 9/2018 | Meuwissen et al. | |
| 10,323,359 | B2 | 6/2019 | Meuwissen et al. | |
| D854,400 | S | 7/2019 | Haley et al. | |
| 10,400,417 | B1 * | 9/2019 | Dawson | E01C 5/08 |
| 10,711,410 | B2 | 7/2020 | Meuwissen et al. | |
| 10,851,501 | B2 | 12/2020 | De Rivas | |
| D927,025 | S | 8/2021 | Keen | |
| D939,857 | S | 1/2022 | Dains et al. | |
| D944,079 | S | 2/2022 | Young et al. | |
| D949,002 | S | 4/2022 | Parab et al. | |
| D952,384 | S | 5/2022 | Styrc | |
| D952,785 | S | 5/2022 | Bao | |
| D966,077 | S | 10/2022 | Fox | |
| D966,869 | S | 10/2022 | Su | |
| D972,393 | S | 12/2022 | Karlsson | |
| D977,930 | S | 2/2023 | Dreisbach | |
| D996,964 | S | 8/2023 | Singh | |
| D1,030,466 | S | 6/2024 | Schuknecht et al. | |
| D1,035,434 | S | 7/2024 | Creasy et al. | |
| 12,031,329 | B2 | 7/2024 | Argyrou | |
| D1,042,094 | S | 9/2024 | Jiménez | |
| 2003/0033778 | A1 | 2/2003 | Boxall et al. | |
| 2005/0232697 | A1 * | 10/2005 | Brinkman | E01C 11/14 404/47 |
| 2005/0276660 | A1 | 12/2005 | Mclean et al. | |
| 2006/0075706 | A1 | 4/2006 | Boxall et al. | |
| 2009/0272861 | A1 | 11/2009 | Bevelacqua | |
| 2010/0139188 | A1 | 6/2010 | Callentine et al. | |
| 2016/0319543 | A1 | 11/2016 | Messina et al. | |
| 2017/0037644 | A1 | 2/2017 | Gazzotti | |
| 2017/0081805 | A1 | 3/2017 | Keen | |
| 2018/0371703 | A1 | 12/2018 | Meuwissen et al. | |
| 2020/0190746 | A1 | 6/2020 | De Rivas | |
| 2020/0318347 | A1 * | 10/2020 | Murdoch | E04B 5/36 |
| 2020/0318361 | A1 * | 10/2020 | Murdoch | E01C 11/126 |
| 2020/0325638 | A1 | 10/2020 | Murdoch et al. | |
| 2021/0131100 | A1 | 5/2021 | Lim | |
| 2022/0010546 | A1 | 1/2022 | Mason | |
| 2023/0020378 | A1 | 1/2023 | Mason et al. | |
| 2023/0052491 | A1 | 2/2023 | Mason et al. | |
| 2023/0061416 | A1 | 3/2023 | Mason | |

FOREIGN PATENT DOCUMENTS

| | | | | |
|---|---|---|---|---|
| FR | 124772-001 | | 5/1978 | |
| SG | 2008610 | C | 8/2008 | |
| WO | WO-2007144008 | A1 * | 12/2007 | E01C 11/08 |
| WO | 2013128152 | A2 | 9/2013 | |
| WO | WO-2015173549 | A1 * | 11/2015 | E01C 11/04 |
| WO | WO-2019074632 | A1 * | 4/2019 | E01C 11/04 |

OTHER PUBLICATIONS

Snapedge Paver Restraint, date first available Jan. 11, 2021 [online], Available from the internet URL: https://greatnorthhardscape.com/product-detail/snapedge (Year: 2021).

"Wave bonders", Wave bonders, retrieved Sep. 24, 2024 [online], Available from the internet URL: https://www.bona.com/en-my/webchannel/professional/adhesives/primers-/wellenverbinder-70-x-6-mm-100/.

Pictures of Commercially Available Armored Joints, available prior to Apr. 1, 2022 (28 pages).

SB024-B Yellow OSHA Compliant Guardrail Base w/Toeboard Slots (24 Ct.); Safety Boot; Amazon.com; Jun. 10, 2014; Acc Aug. 5, 2024; URL:<https://www.amazon.com/Safety-Boot-Compliant-Guardrail-Toeboard/dp/B00KWKA7ZQ> (Year: 2014).

European Office Action from European Application No. 23151217.9, dated Jul. 10, 2025 (5 pages).

* cited by examiner

CONCRETE SLAB JOINT FORMING SYSTEM AND METHOD

This application claims priority to and the benefit of U.S. Provisional Patent Application Ser. No. 63/326,636, filed Apr. 1, 2022, the entire contents of which are incorporated herein by reference.

BACKGROUND

Various concrete floors and roadways include a series of separate individually poured or cast-in-place concrete slabs that are referred to herein as "concrete slabs." Various known issues with such concrete slabs relate to the joint between adjacent concrete slabs, the relative movements of adjacent concrete slabs when loads are placed on the concrete slabs, and the opening that forms between adjacent concrete slabs at the joint.

Two types of joints are often used for concrete slabs. Construction joints are often used between separately individually poured adjacent concrete slabs (that are poured at sequential times). Contraction joints (which are sometimes called control joints) are often used for simultaneously poured adjacent concrete slabs. Contraction joints are often partially formed by vertically cutting a larger concrete slab at a desired location of the contraction joint to form the separate adjacent concrete slabs. The vertical cut often extends approximately one third of the way through the depth of the concrete. When the larger concrete slab cracks along the cut, the respective concrete slabs are able to separate. Contraction joints are thus often used to control natural cracking in concrete slabs from stresses caused by concrete shrinkage, thermal contraction, moisture or thermal gradients within the concrete, and/or various external forces on the concrete slabs.

Freshly poured concrete shrinks as it cures and hardens due to the chemical reaction that occurs between the cement and water. As the concrete shrinks, stress accumulates in the concrete. Therefore, the joint between two adjacent concrete slabs needs to be able to open to enable such shrinkage of each of the individual concrete slabs without damaging the concrete slabs and while maintaining the integrity of the joint.

After curing and hardening, adjacent concrete slabs are also subject to loads that can cause the movements of the concrete slabs relative to one another. Various construction and contraction joints include load transferring dowels of various different geometries that connect adjacent concrete slabs such that the movement of one concrete slab causes the movement of the adjacent concrete slab. In other words, these load transferring dowels connect the adjacent concrete slabs such that they substantially move together when a load is placed on one of the adjacent concrete slabs.

There is a continuing need to develop new and better systems, apparatus, and methods for forming joints between adjacent concrete slabs.

SUMMARY

Various embodiments of the present disclosure provide concrete slab joint forming systems and methods of using such concrete slab joint forming systems for forming joints between adjacent concrete slabs.

In various embodiments of the present disclosure, the concrete slab joint forming system includes: (1) a concrete slab joint former, (2) an extension connector, (3) a cross intersection connector, (4) a tee intersection connector, (5) an end connector, (6) a field cut connector, and/or (7) any combination of any quantity of these components (1) to (6). Each of the extension connector, the cross intersection connector, the tee intersection connector, and the field cut connector are connectable to one or more concrete slab joint formers or extension connectors. The end connector is connectable to one concrete slab joint former or to one extension connector. One or more of each of the extension connector, the cross intersection connector, the tee intersection connector, the end connector, and the field cut connector are selectively usable with one or more of the concrete slab joint formers and one or more extension connectors to form one or more joints for concrete slabs and the respective concrete slabs themselves.

The concrete slab joint forming system of various embodiments of the present disclosure reduce: (1) the quantity of components for forming concrete slab, (2) the weight of the components for forming concrete slabs, (3) the complexity of the assembly and installation of the components for forming concrete slabs, and/or (4) the assembly and installation time for the components needed for forming concrete slabs, as compared to various known concrete slab forming and load transfer apparatus.

Additional features and advantages of the present disclosure are described in, and will be apparent from, the following Detailed Description and the Figures.

BRIEF DESCRIPTION OF THE FIGURES

FIG. 1.

DETAILED DESCRIPTION OF EXAMPLE EMBODIMENTS

Figure 1:
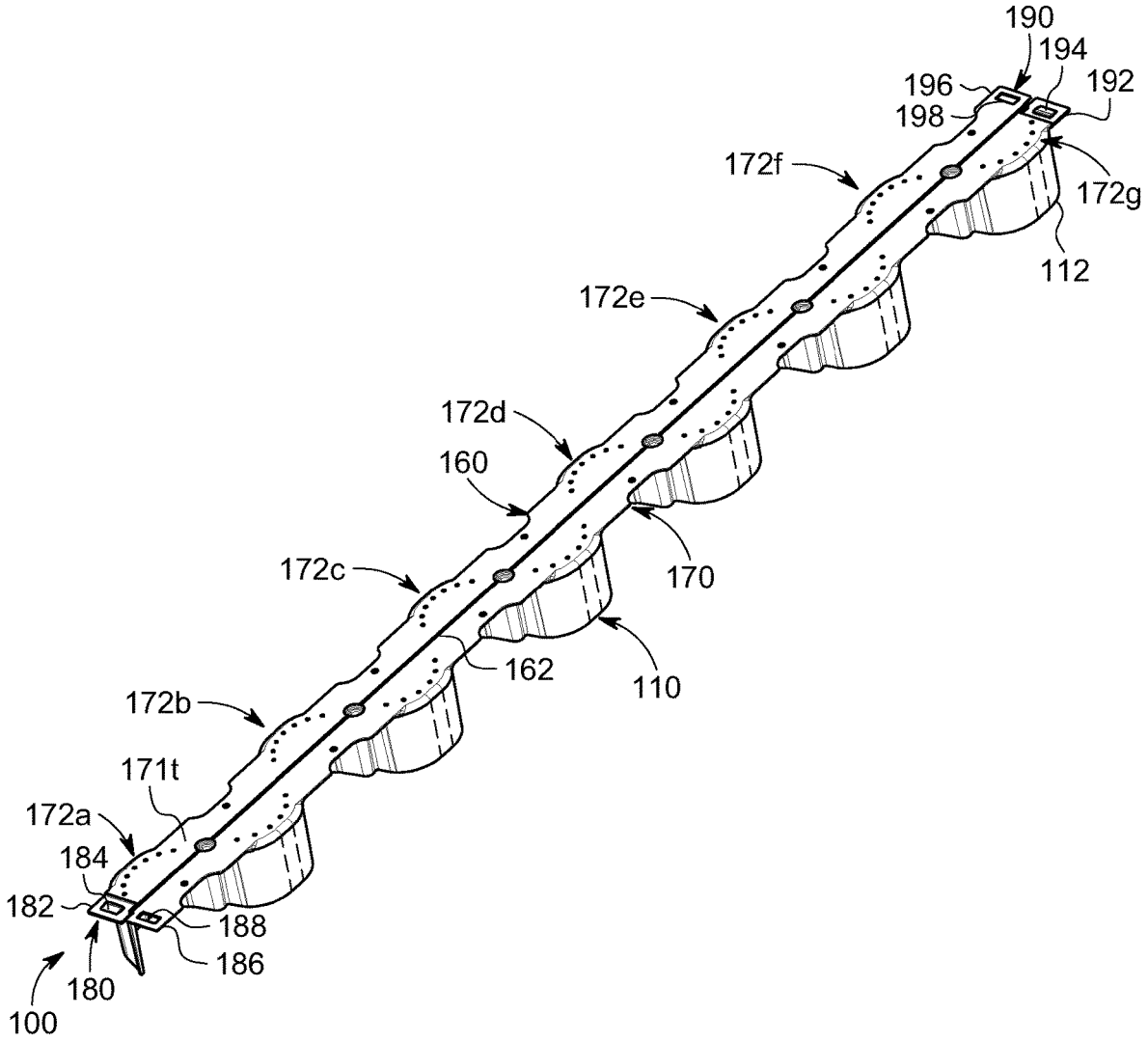
FIG. 1 is a top perspective view of a concrete slab joint former of one example embodiment of the concrete slab joint forming system of the present disclosure.
Figure 2:
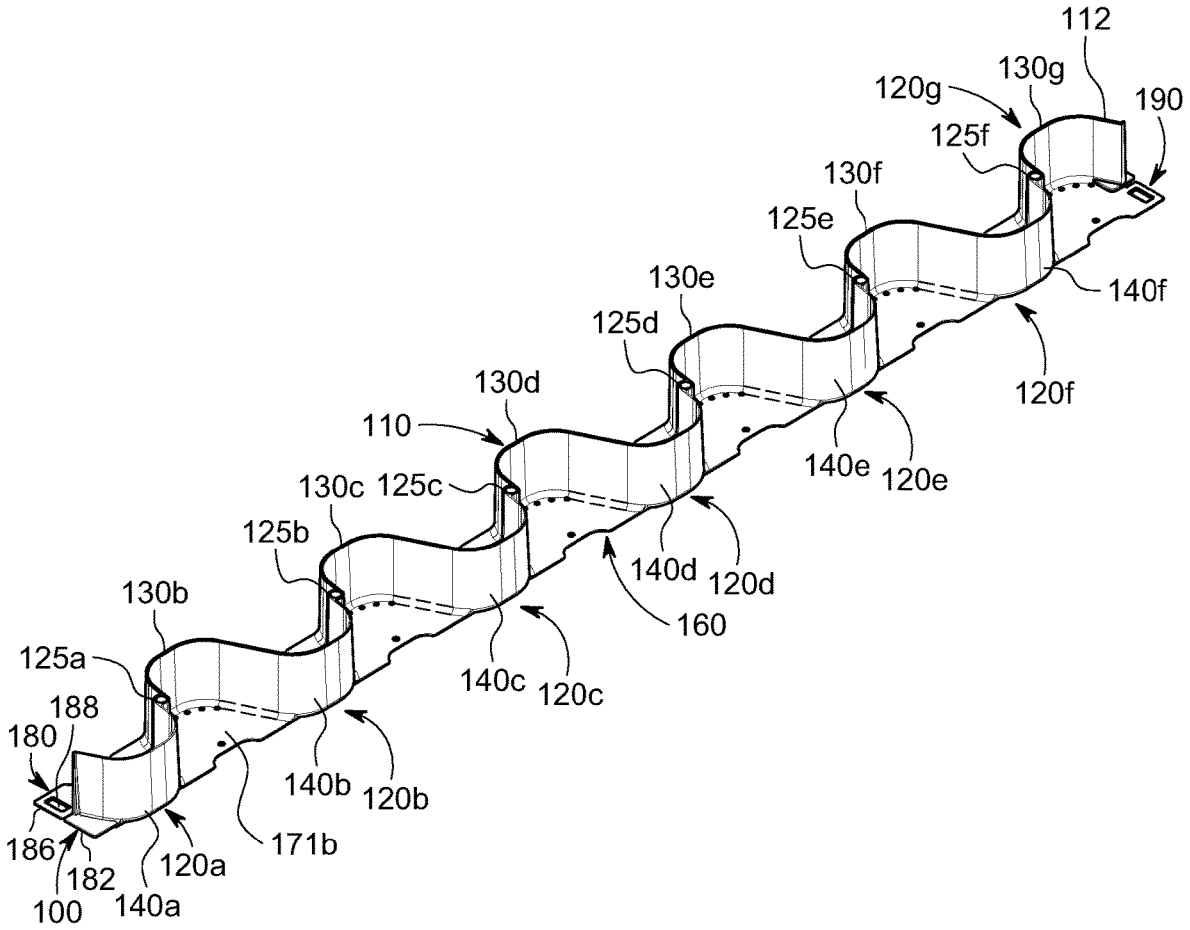
FIG. 2 is a bottom perspective view of the concrete slab joint former
Figure 3:
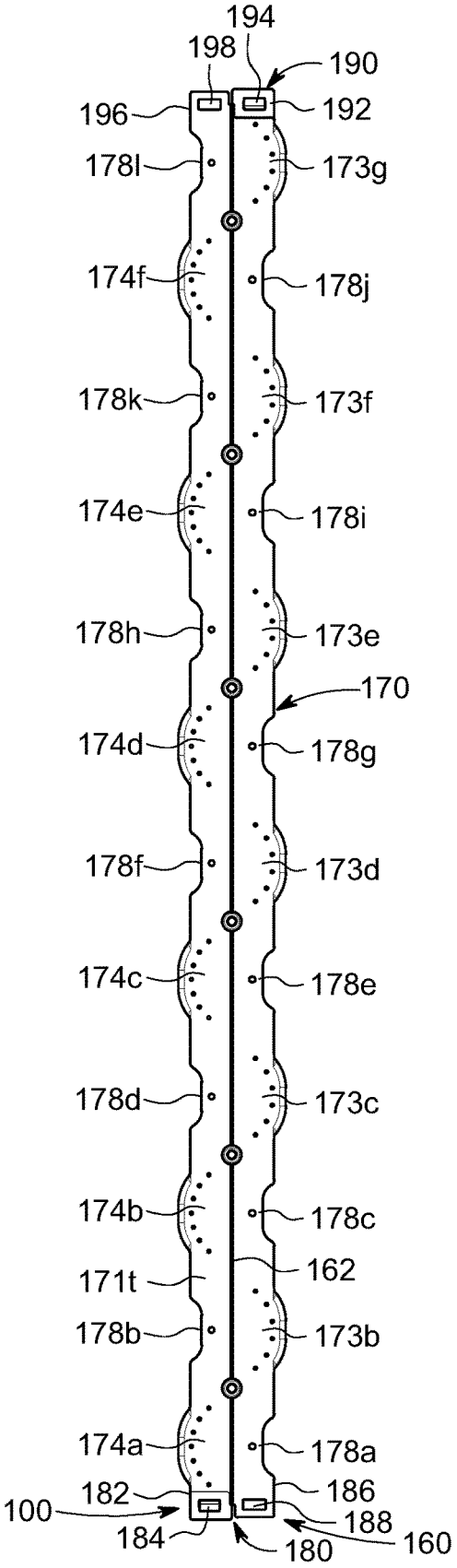
FIG. 3 is a top view of the concrete slab joint former of FIG. 1.
Figure 4:
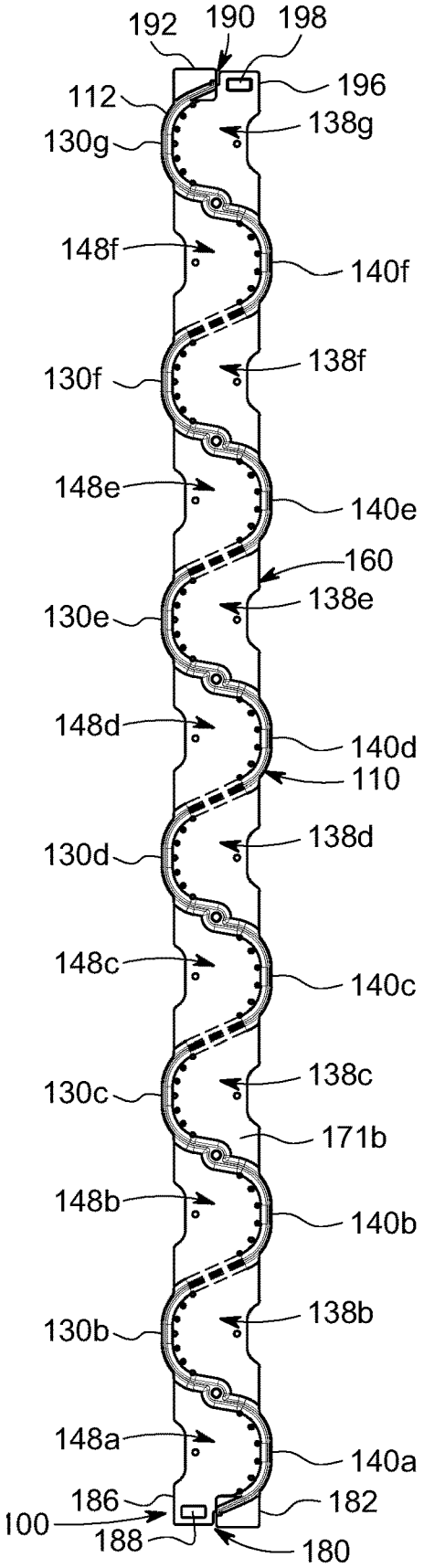
FIG. 4 is a bottom view of the concrete slab joint former of FIG. 1.
Figure 5:
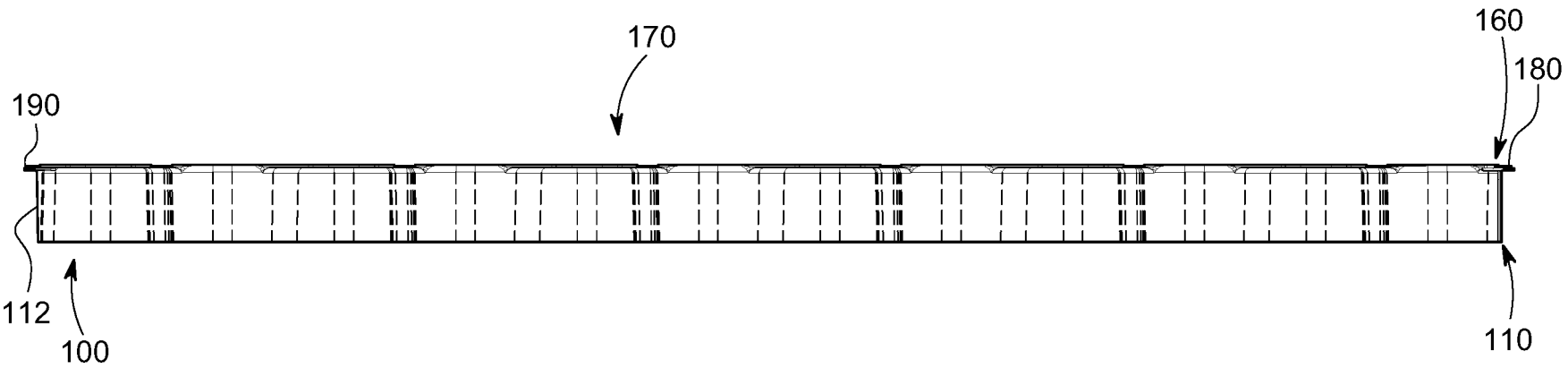
FIG. 5 is a first side view of the concrete slab joint former of FIG. 1.
Figure 6:
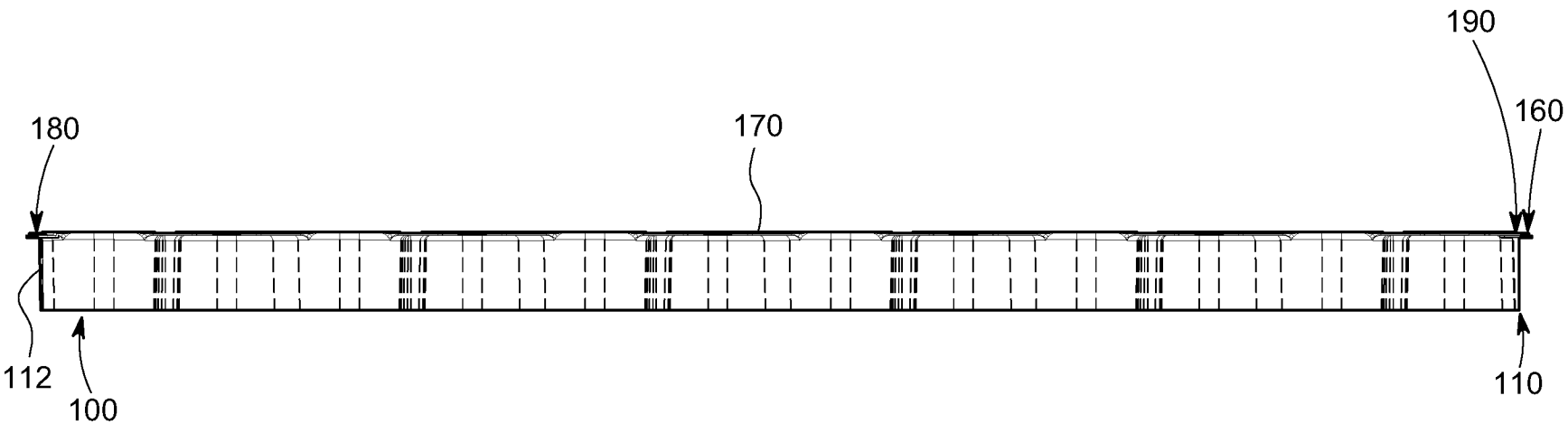
FIG. 6 is a second side view of the concrete slab joint former of FIG. 1.
Figure 7:
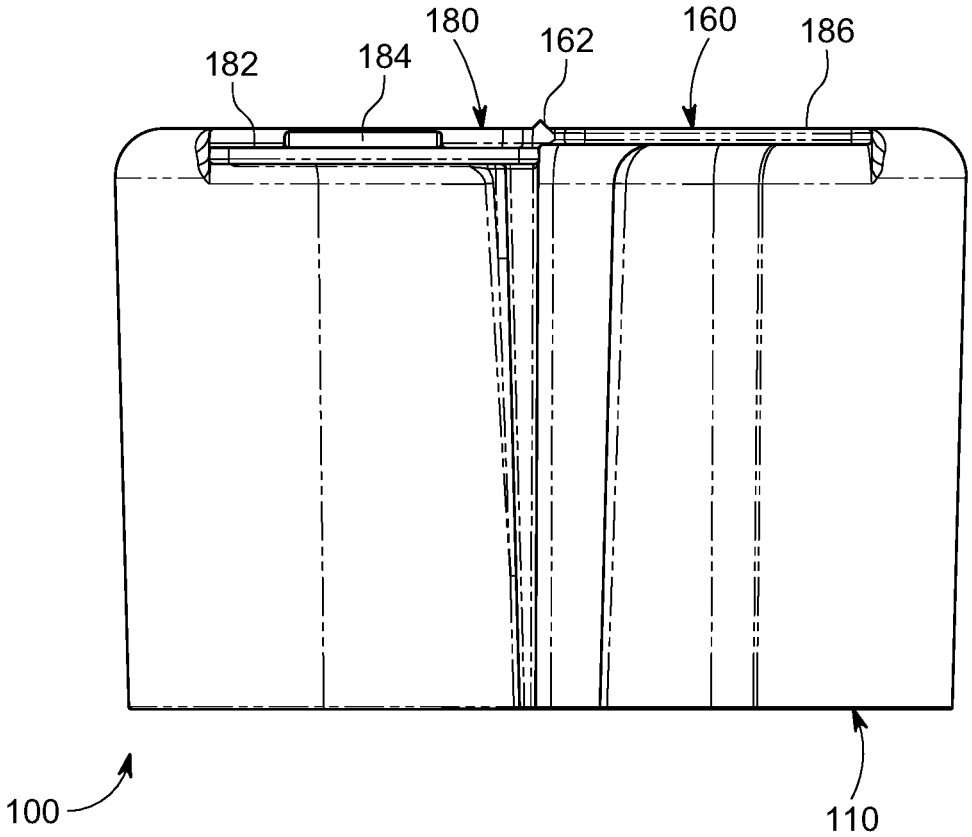
FIG. 7 is an enlarged first end view of the concrete slab joint former of FIG. 2.
Figure 8:
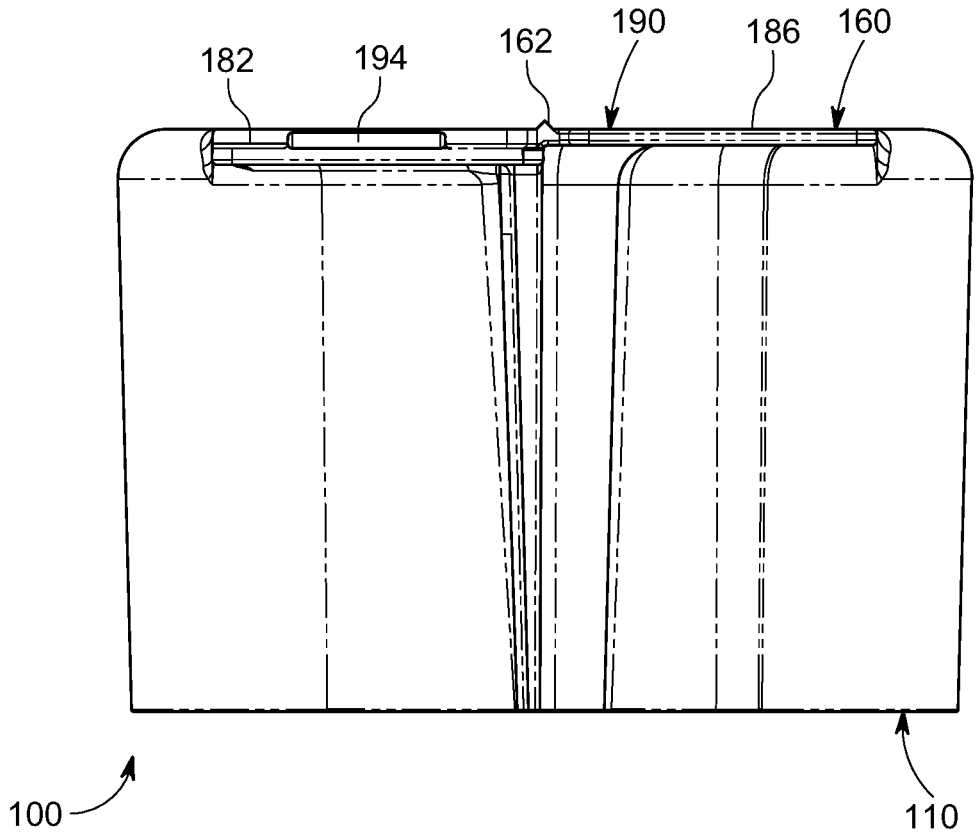
FIG. 8 is an enlarged second end view of the concrete slab joint former of FIG. 2.
Figure 9:
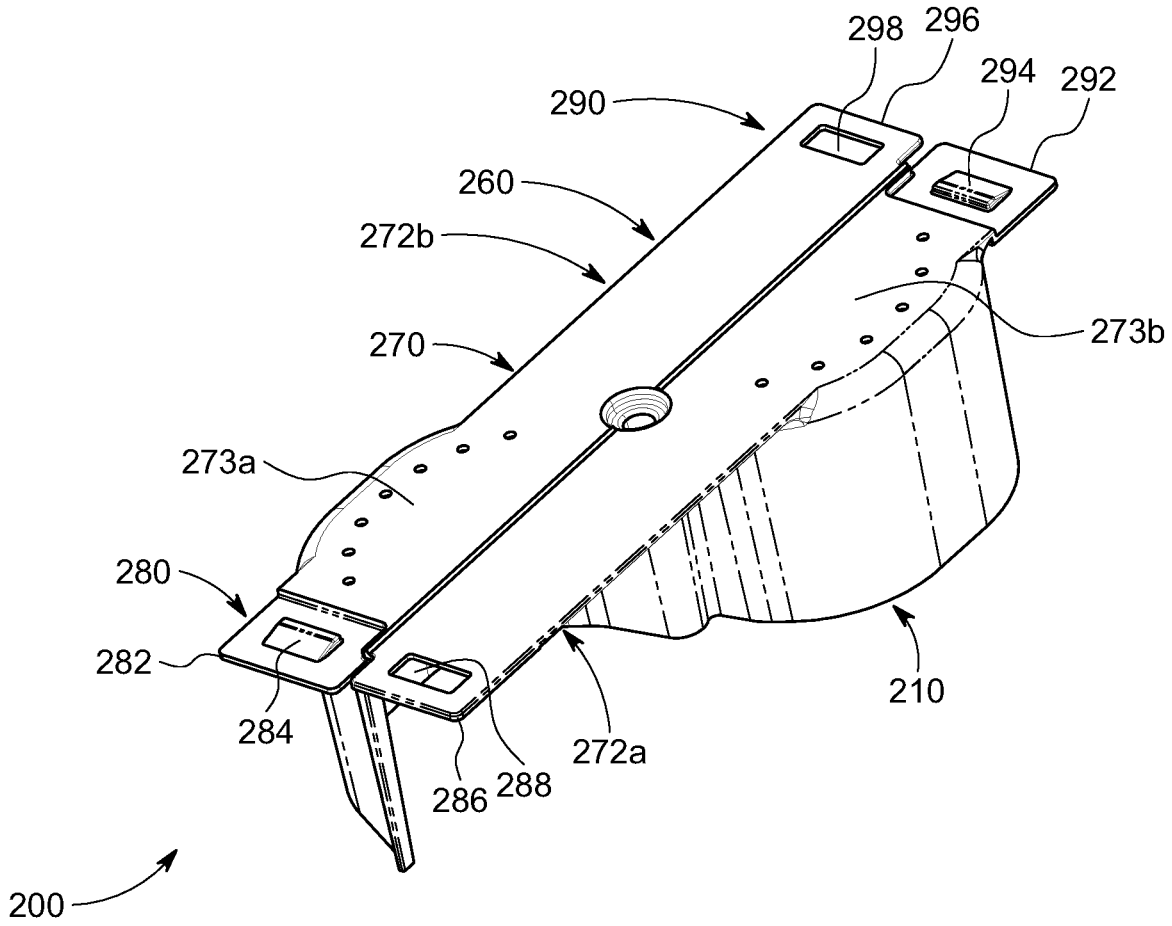
FIG. 9 is a top perspective view of an extension connector of one example embodiment of the concrete slab joint forming system of the present disclosure.
Figure 10:
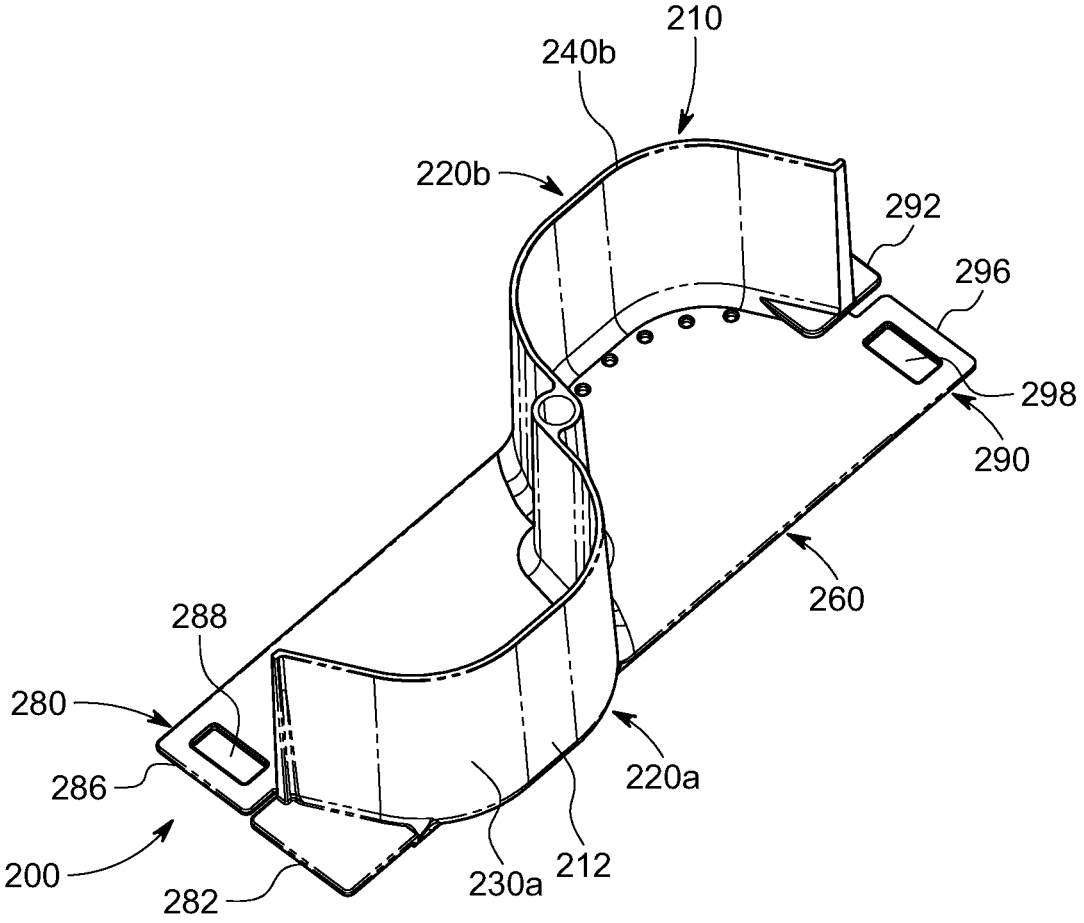
FIG. 10 is a bottom perspective view of the extension connector of FIG. 9.
Figure 11:
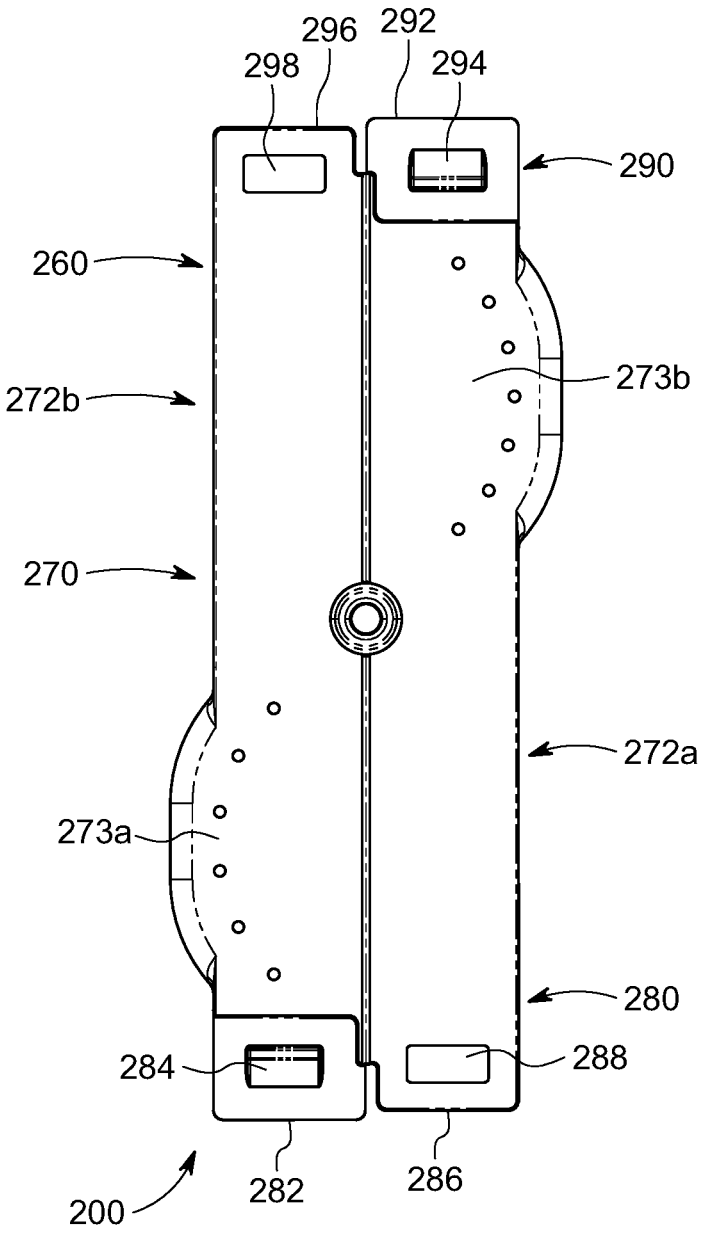
FIG. 11 is a top view of the extension connector of FIG. 9.
Figure 12:
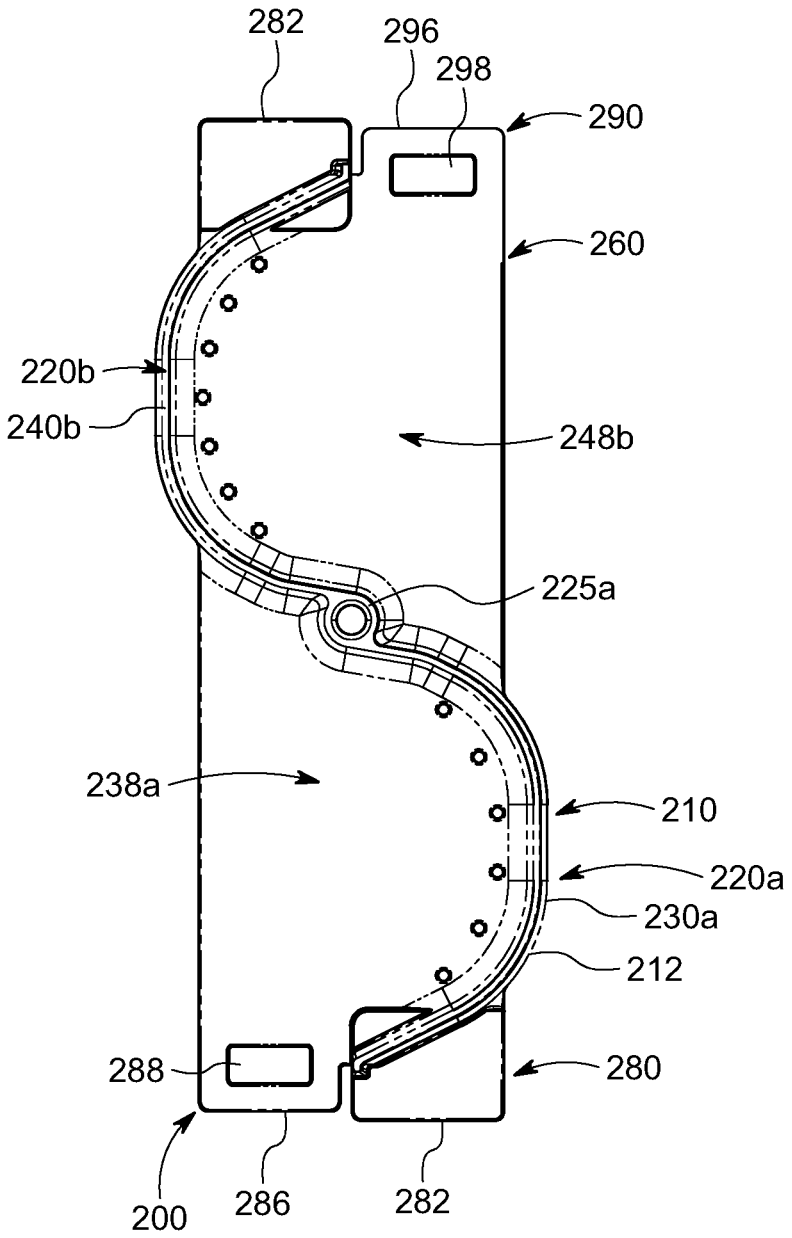
FIG. 12 is a bottom view of the extension connector of FIG. 9.
Figure 13:
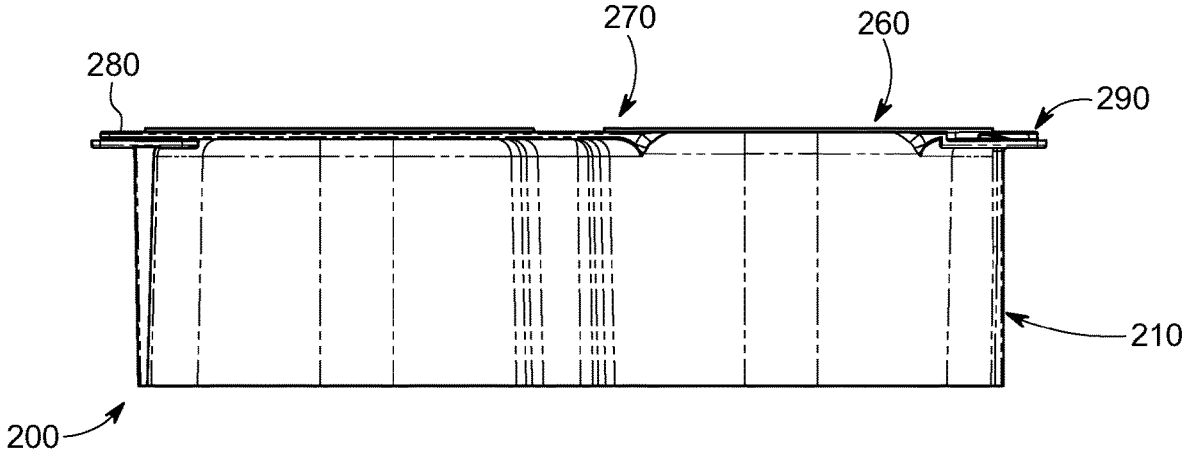
FIG. 13 is a first side view of the extension connector of FIG. 9.
Figure 14:
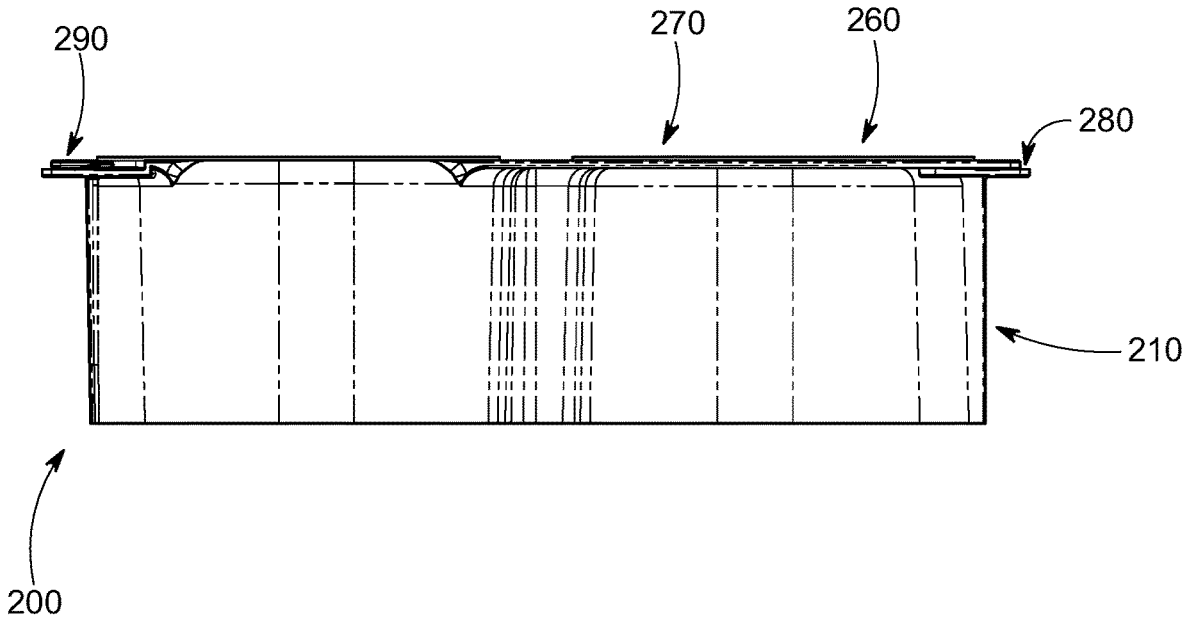
FIG. 14 is a second side view of the extension connector of FIG. 9.
Figure 15:
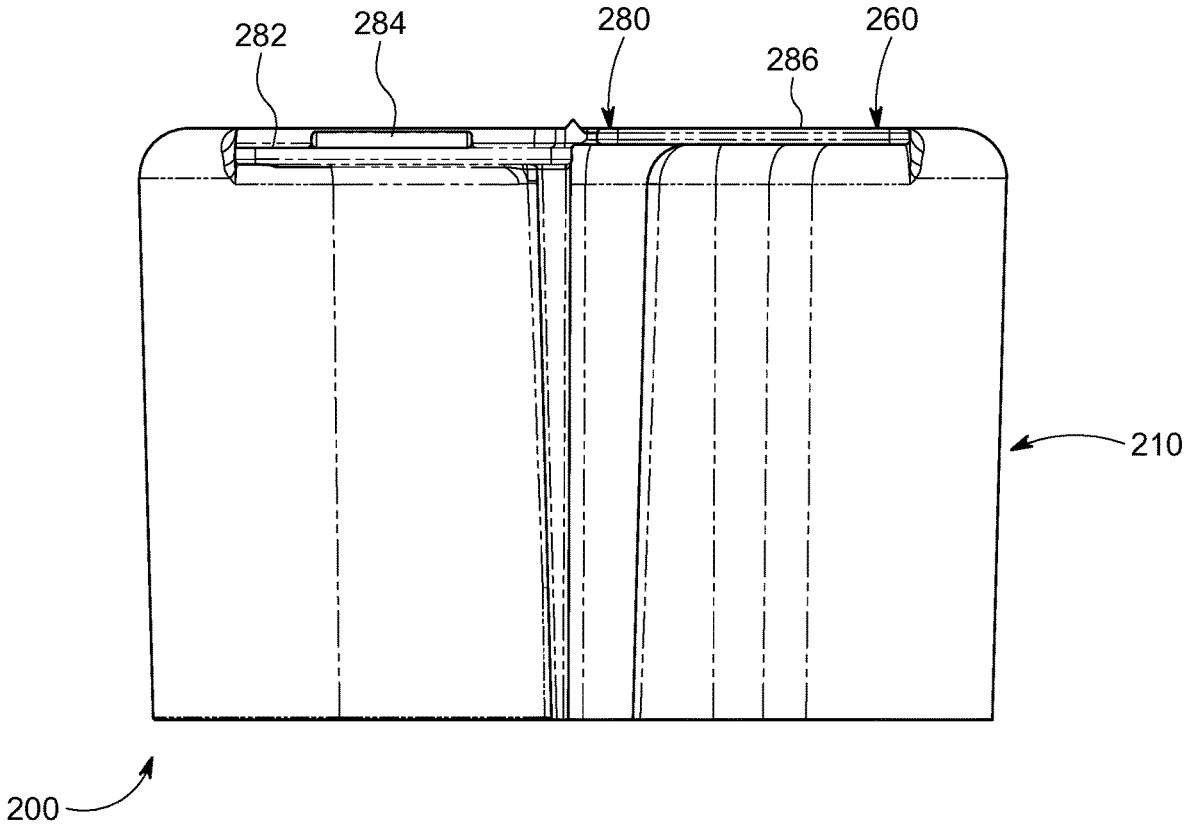
FIG. 15 is an enlarged first end view of the extension connector of FIG. 9.
Figure 16:
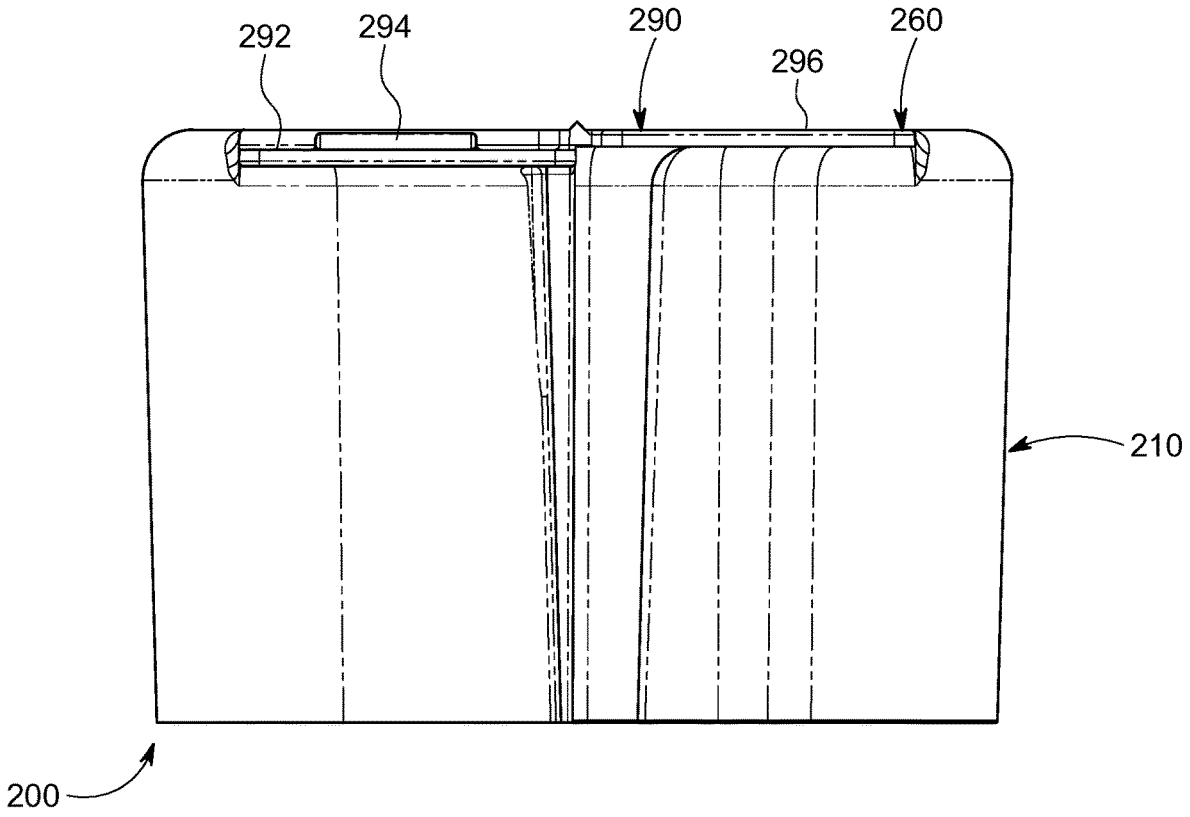
FIG. 16 is an enlarged second end view of the extension connector of FIG. 9.
Figure 17:
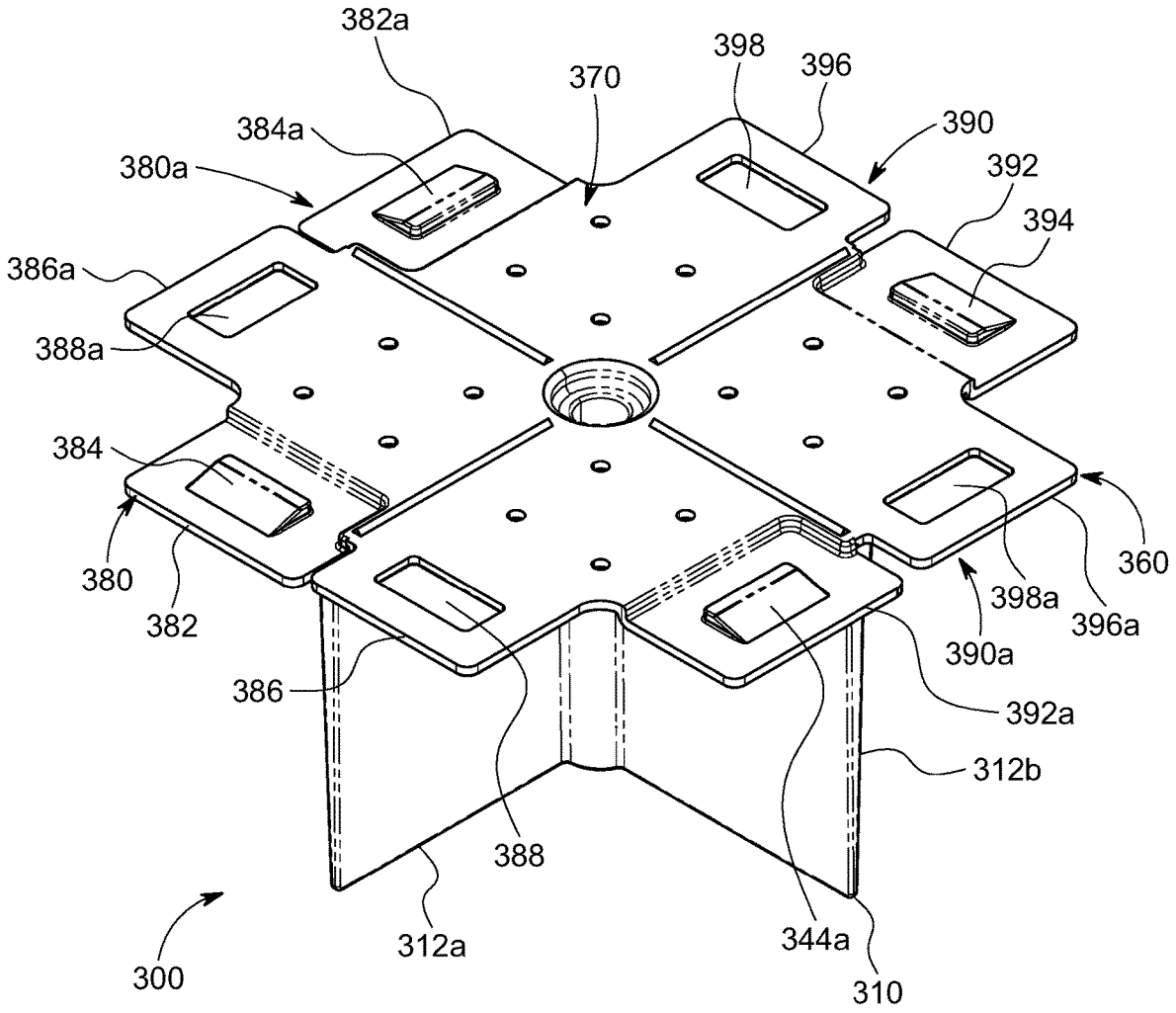
FIG. 17 is a top perspective view of a cross intersection connector of one example embodiment of the concrete slab joint forming system of the present disclosure.
Figure 18:
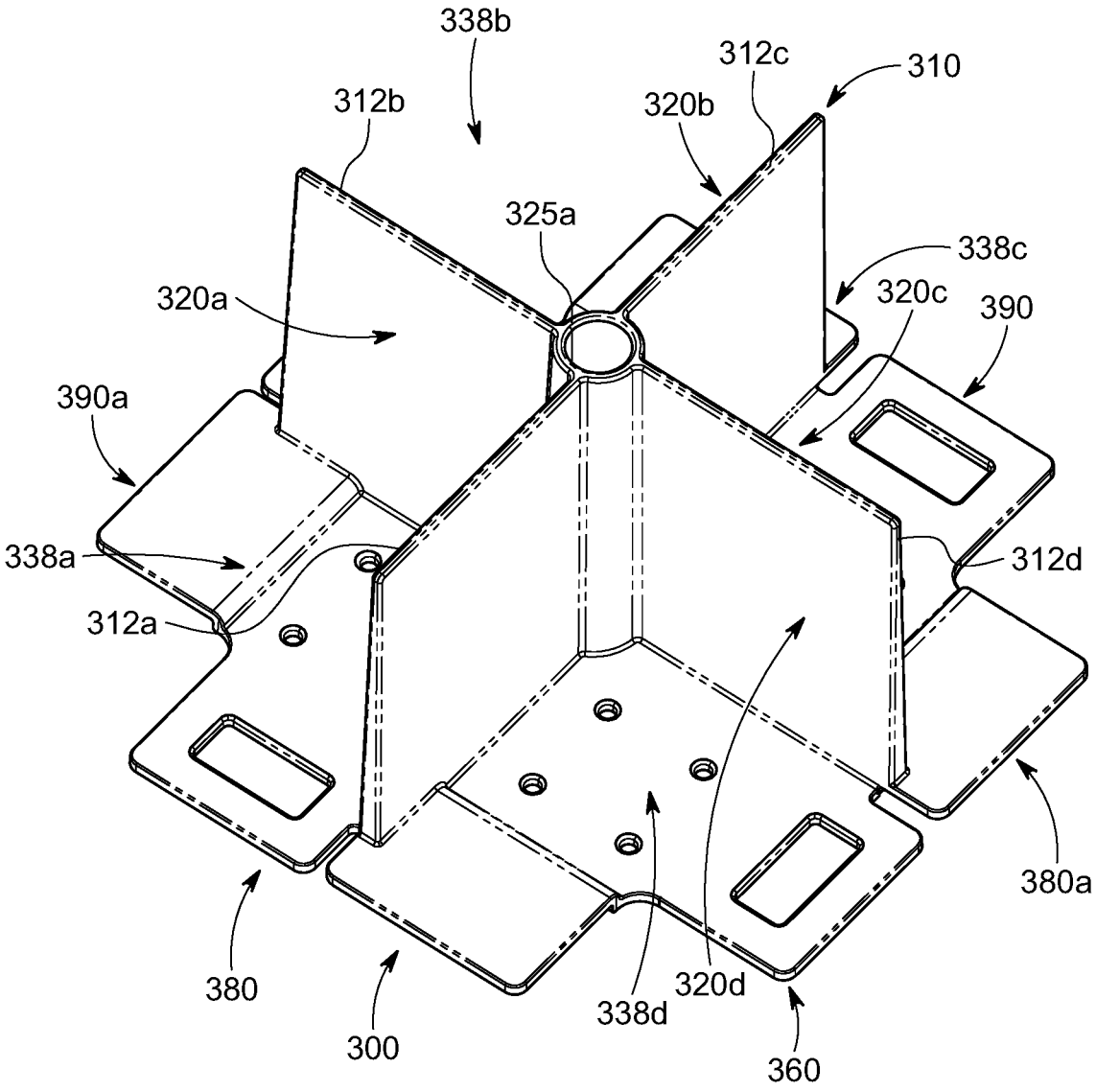
FIG. 18 is a bottom perspective view of the cross intersection connector of FIG. 17.
Figure 19:
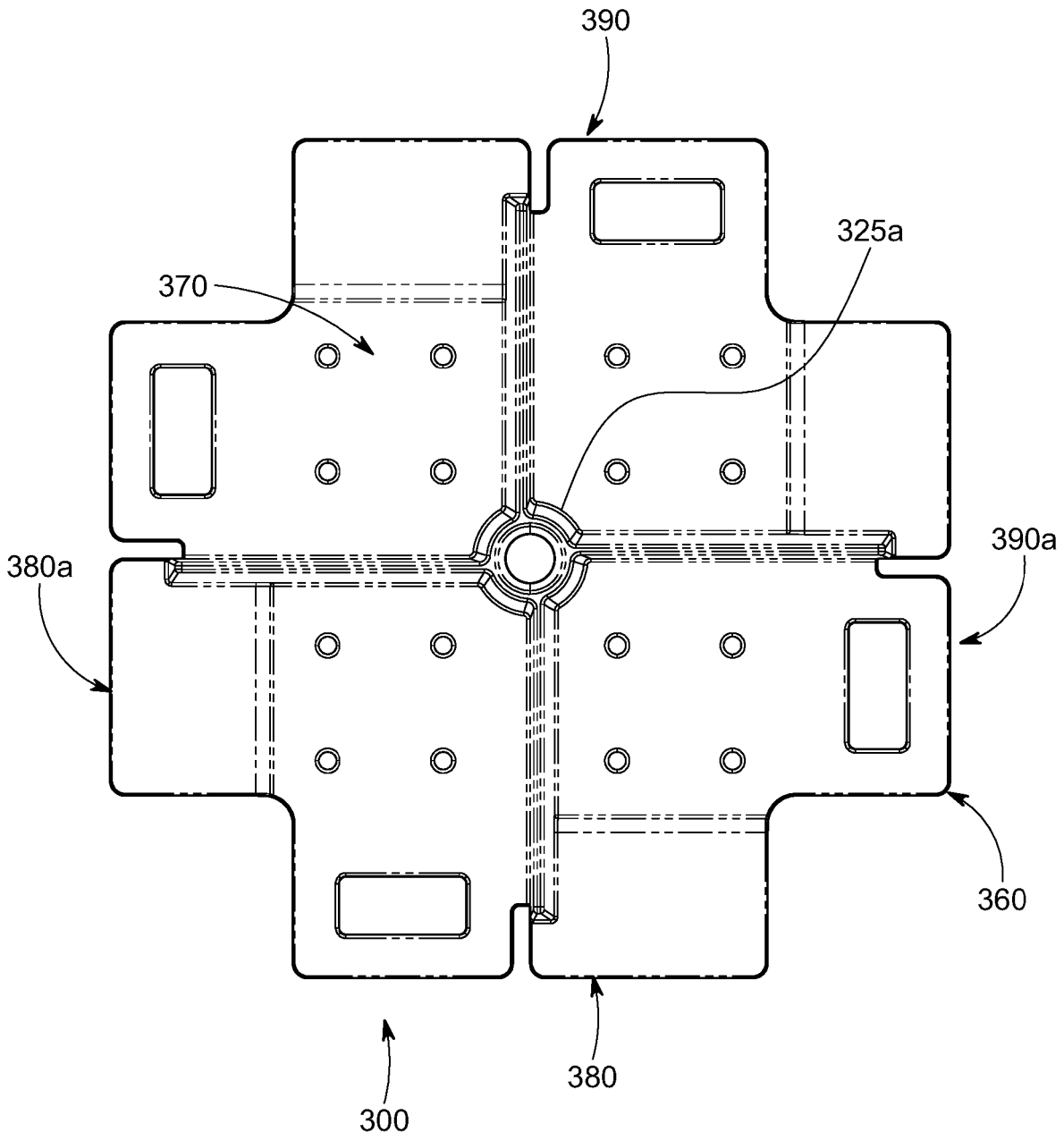
FIG. 19 is a top view of the cross intersection connector of FIG. 17.
Figure 20:
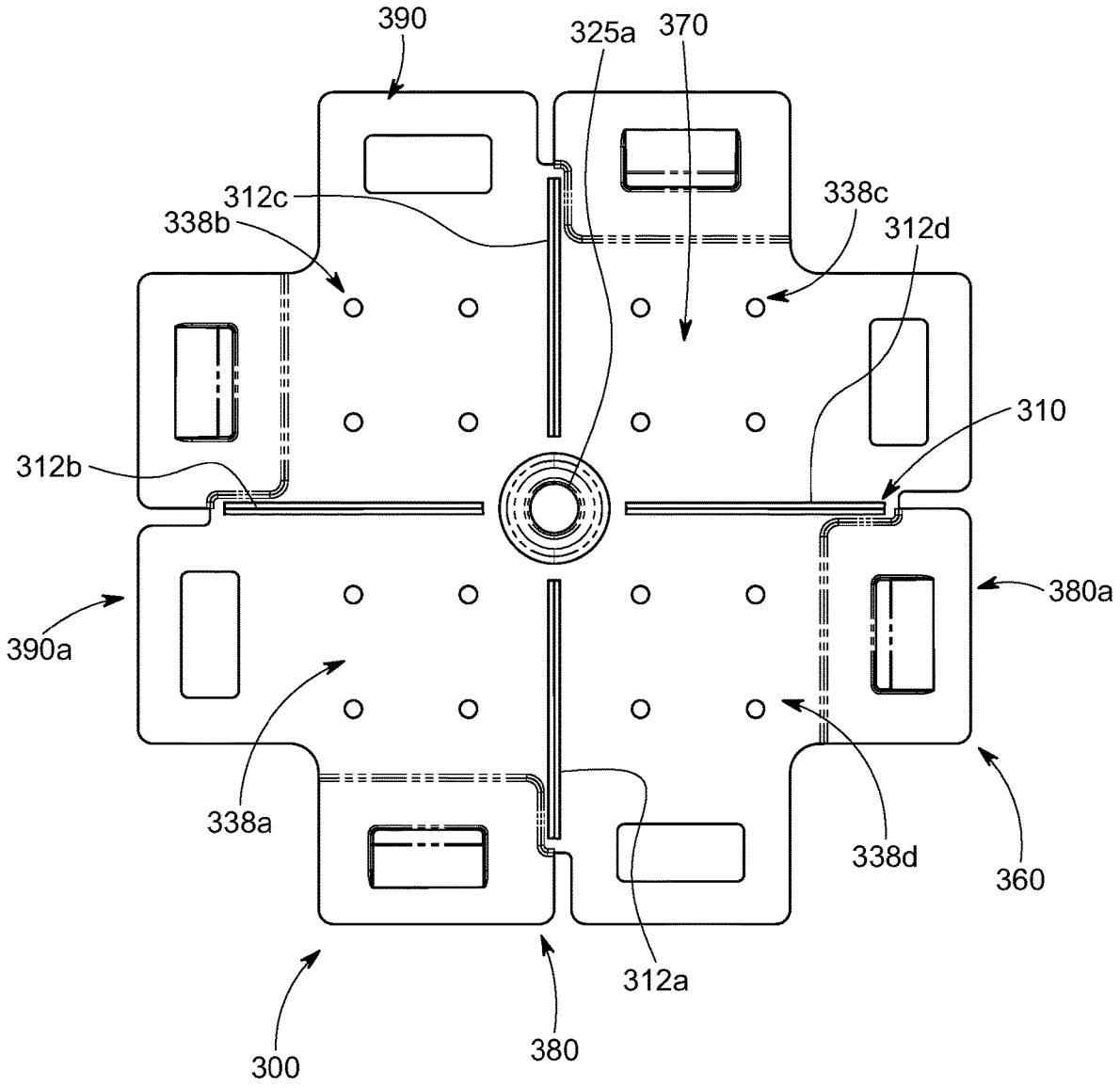
FIG. 20 is a bottom view of the cross intersection connector of FIG. 17.
Figure 21:
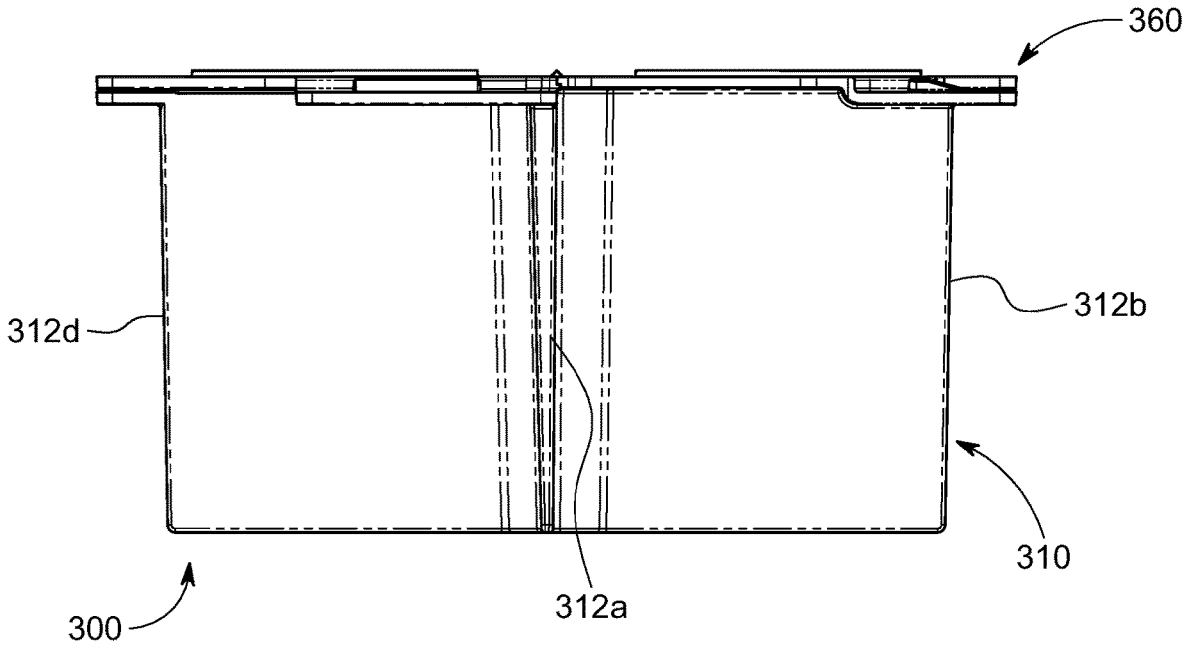
FIG. 21 is a first side view of the cross intersection connector of FIG. 17.
Figure 22:
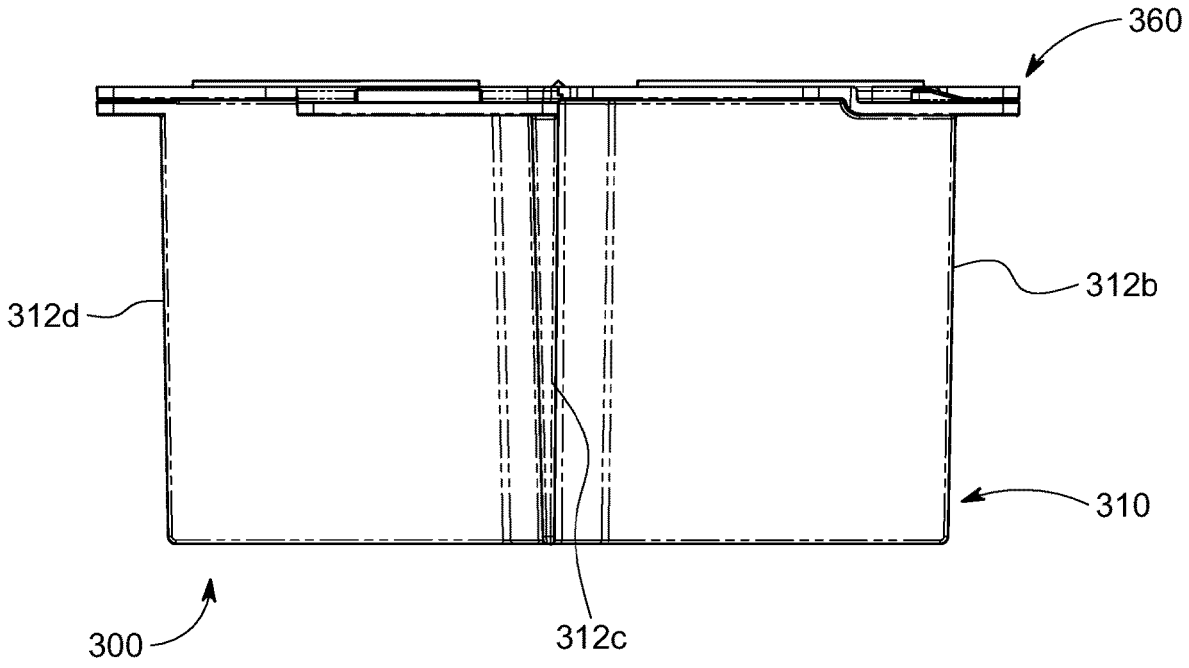
FIG. 22 is a second side view of the cross intersection connector of FIG. 17.
Figure 23:
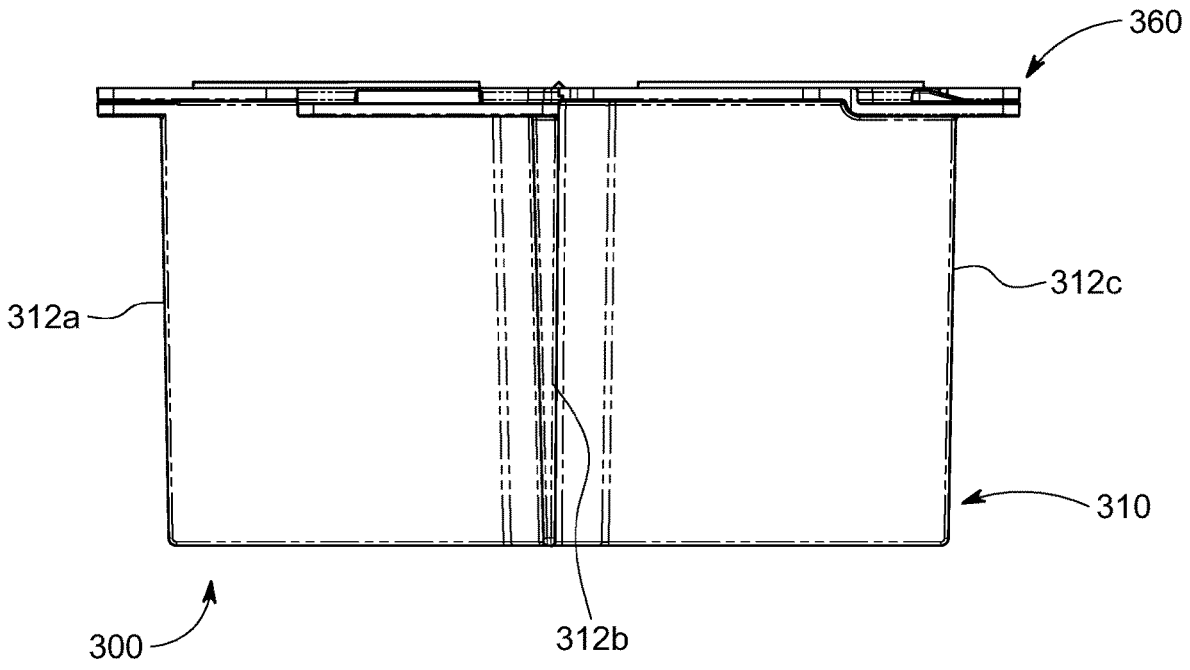
FIG. 23 is a first end view of the cross intersection connector of FIG. 17.
Figure 24:
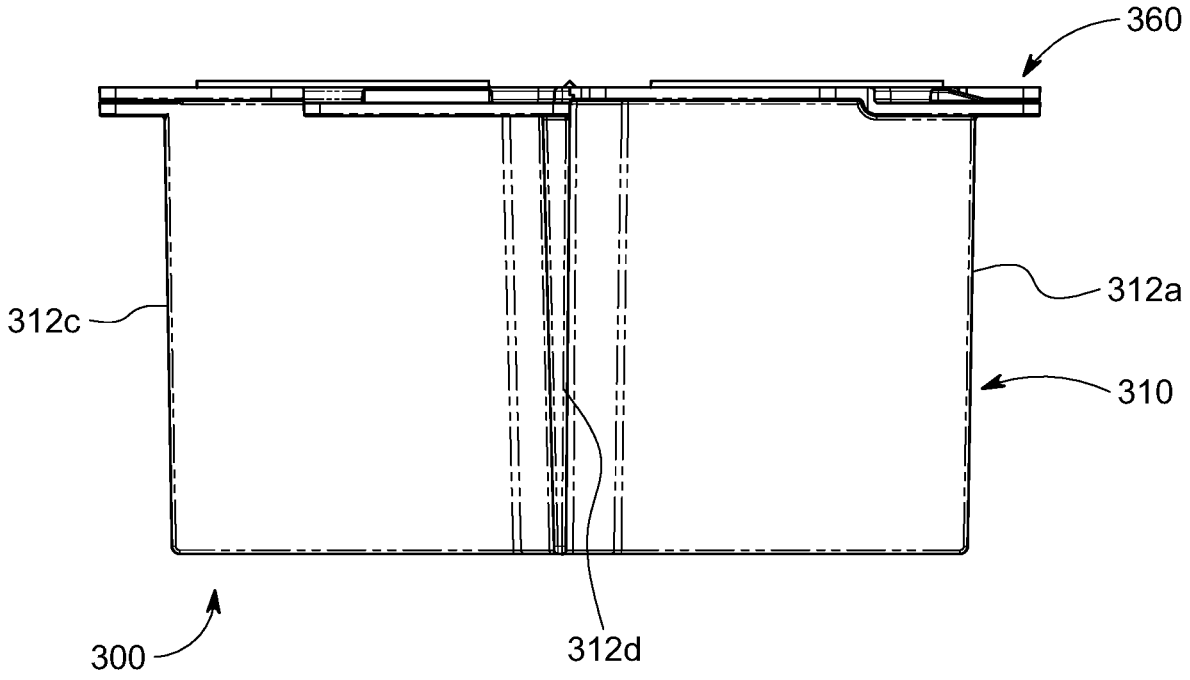
FIG. 24 is a second end view of the cross intersection connector of FIG. 17.
Figure 25:
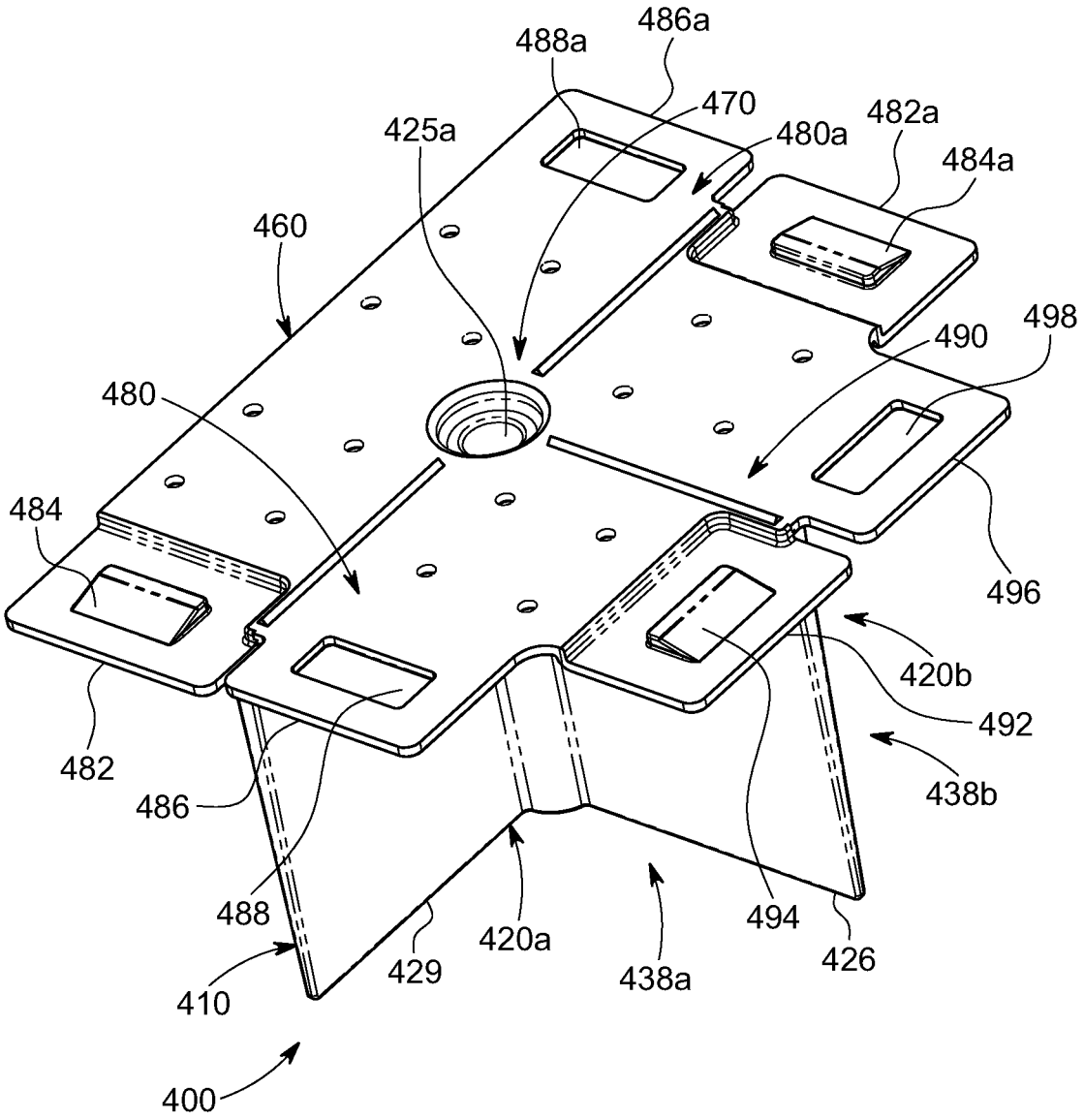
FIG. 25 is a top perspective view of a tee intersection connector of one example embodiment of the concrete slab joint forming system of the present disclosure.
Figure 26:
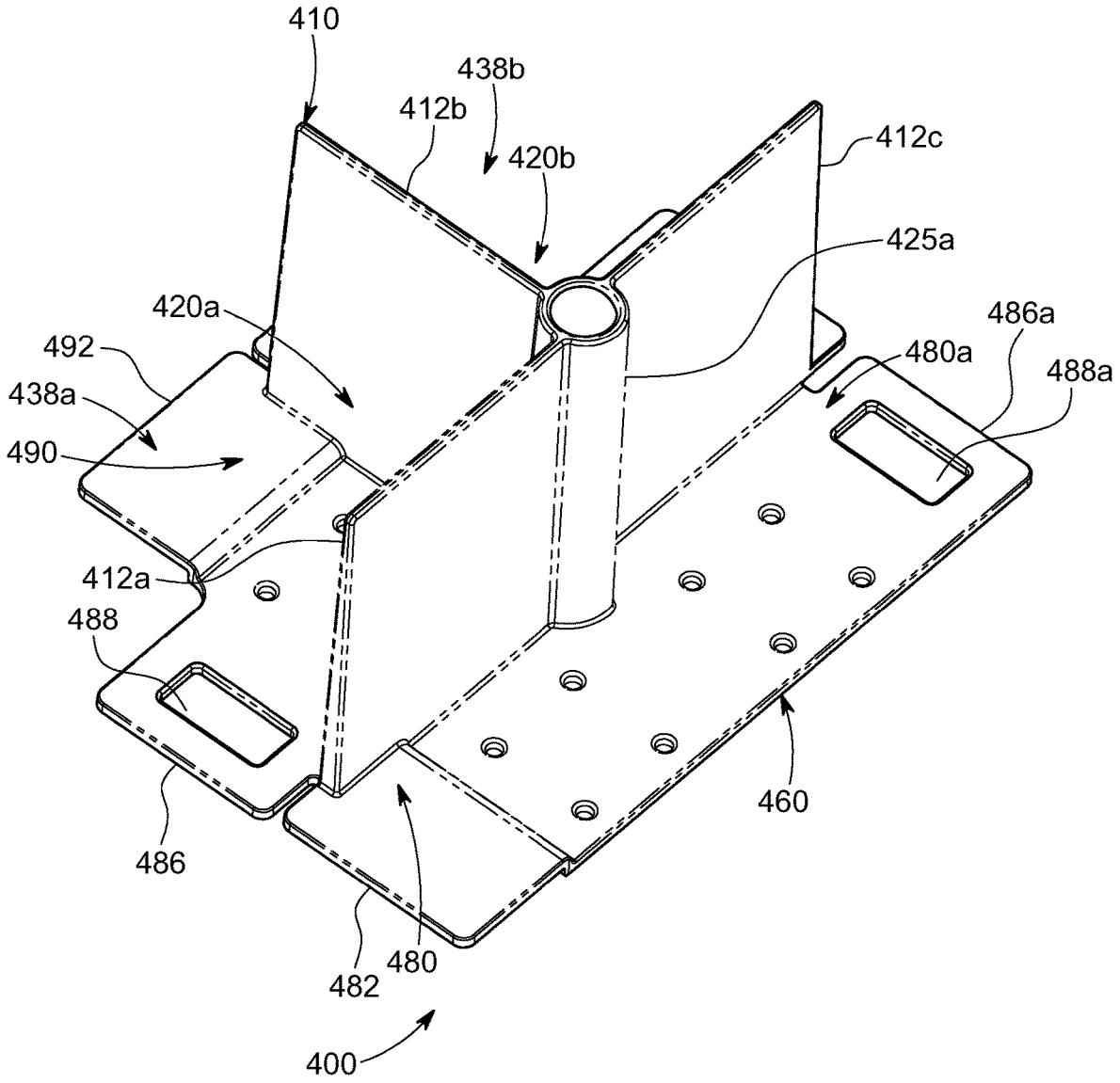
FIG. 26 is a bottom perspective view of the tee intersection connector of FIG. 25.
Figure 27:
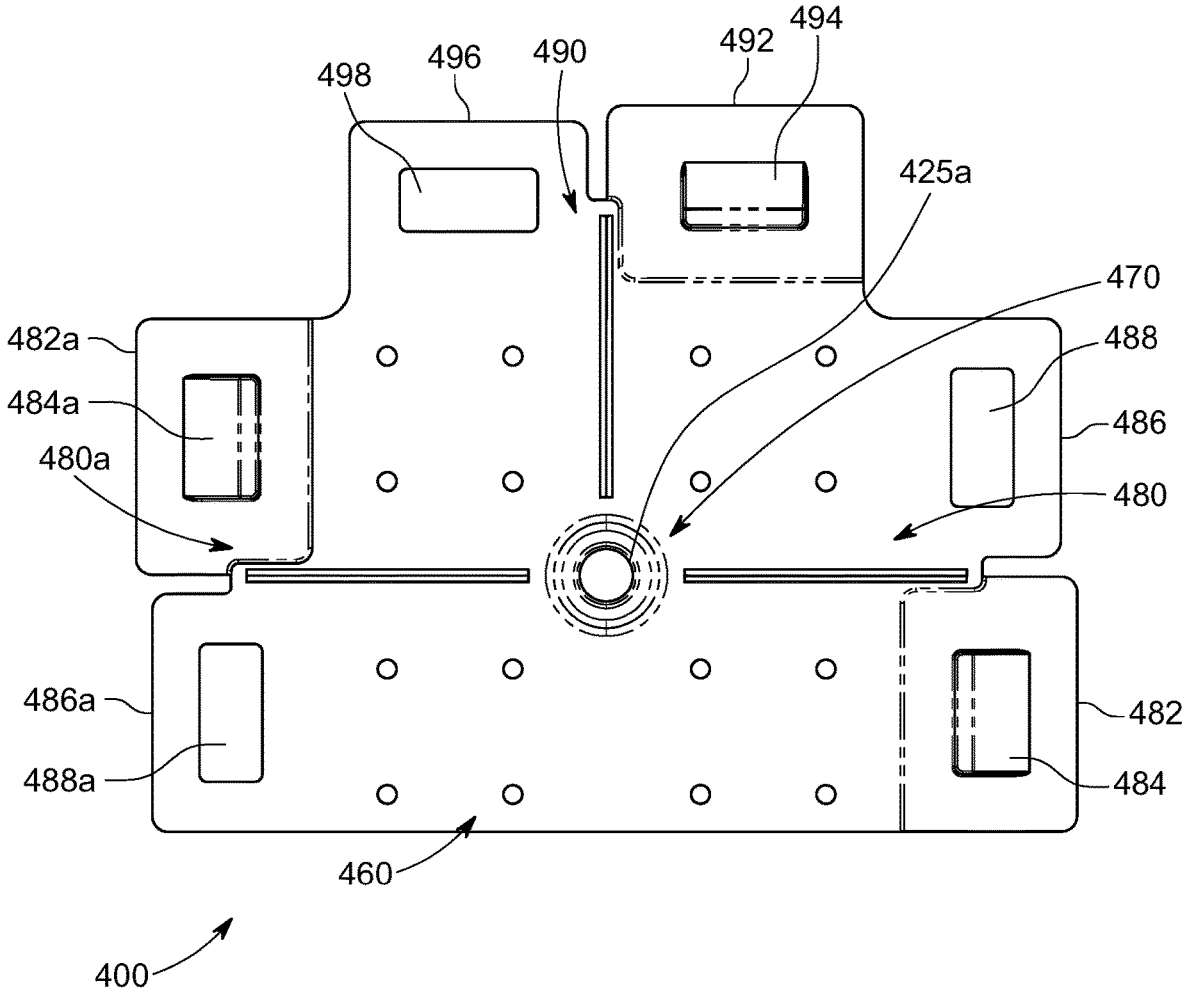
FIG. 27 is a top view of the tee intersection connector of FIG. 25.
Figure 28:
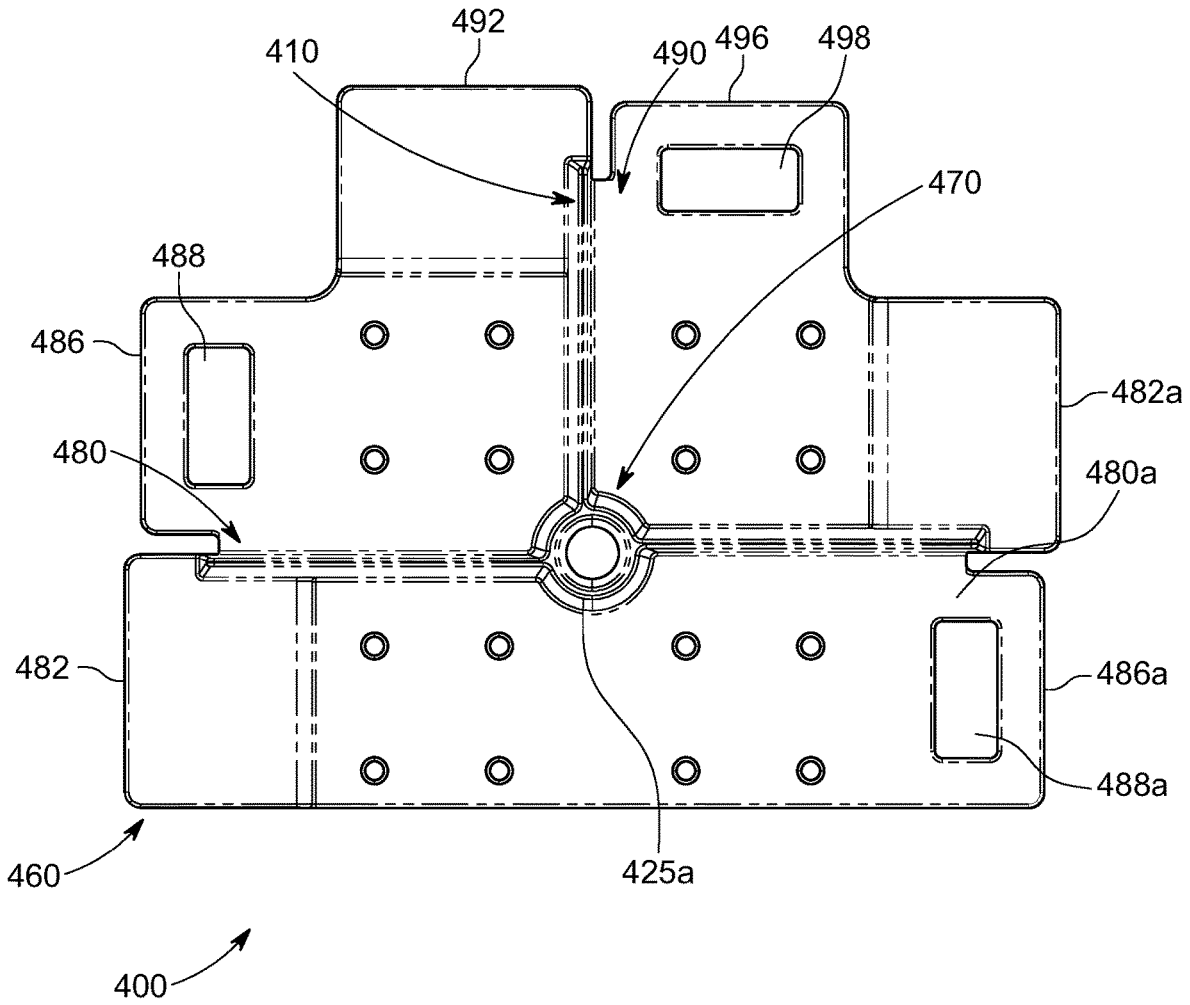
FIG. 28 is a bottom view of the tee intersection connector of FIG. 25.
Figure 29:
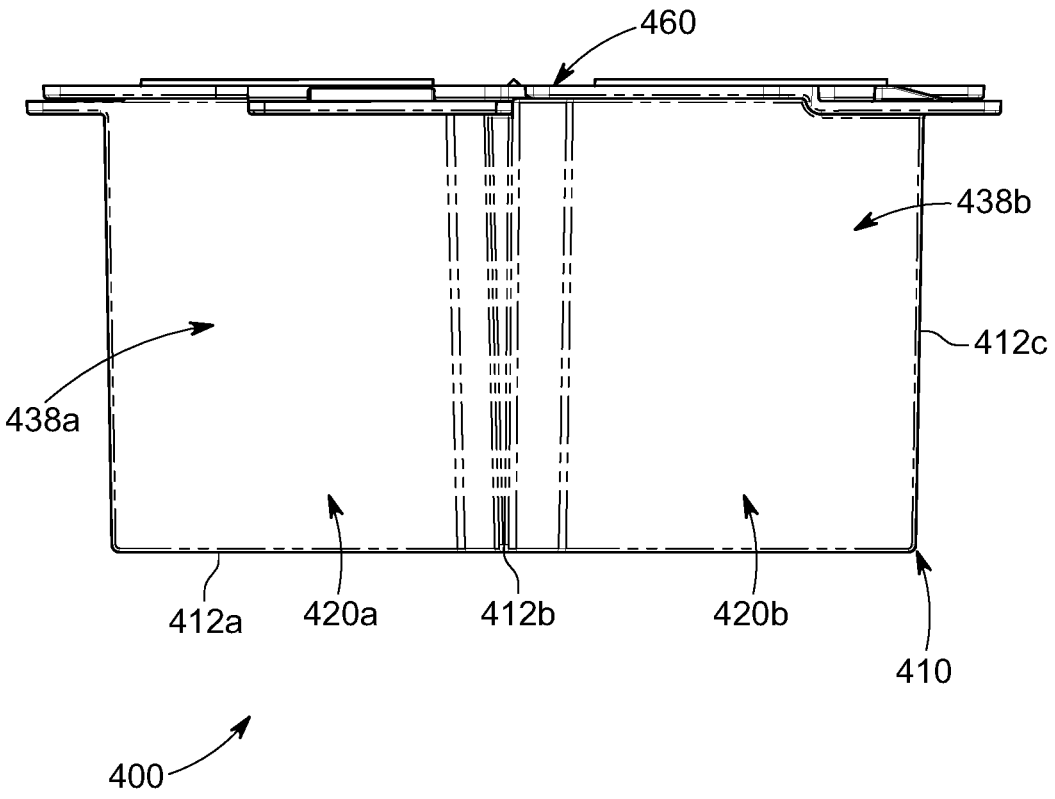
FIG. 29 is a first side view of the tee intersection connector of FIG. 25.
Figure 30:
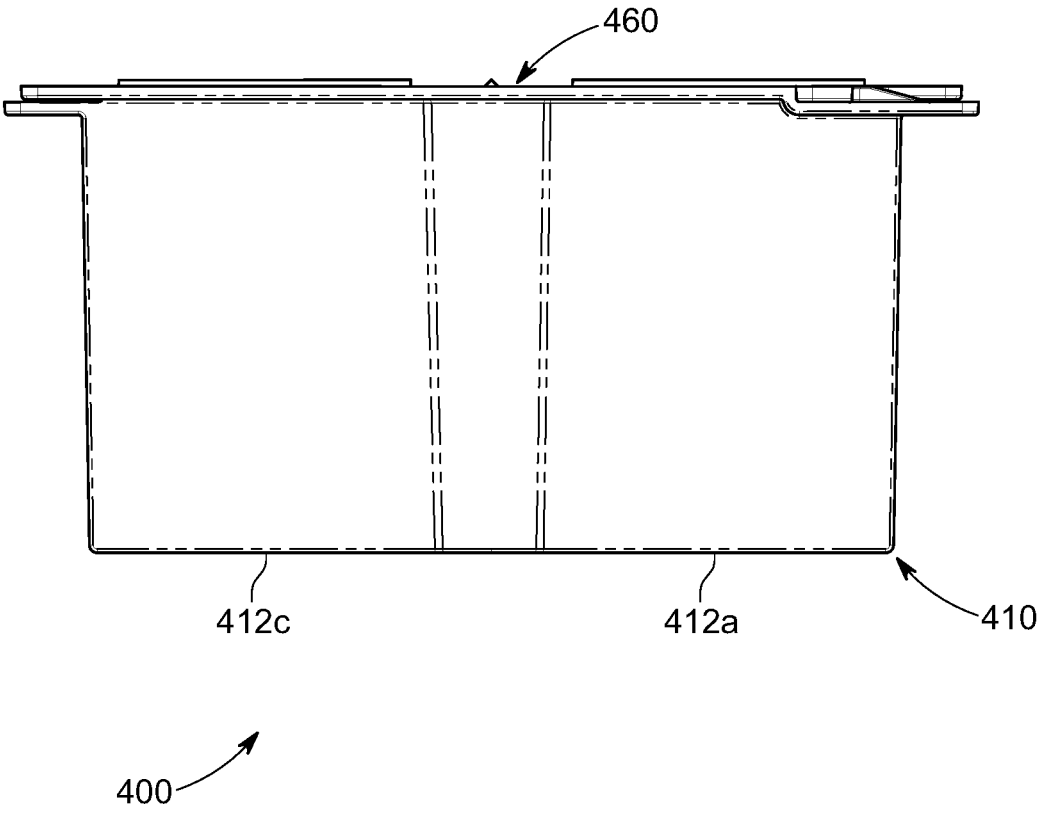
FIG. 30 is a second side view of the tee intersection connector of FIG. 25.
Figure 31:
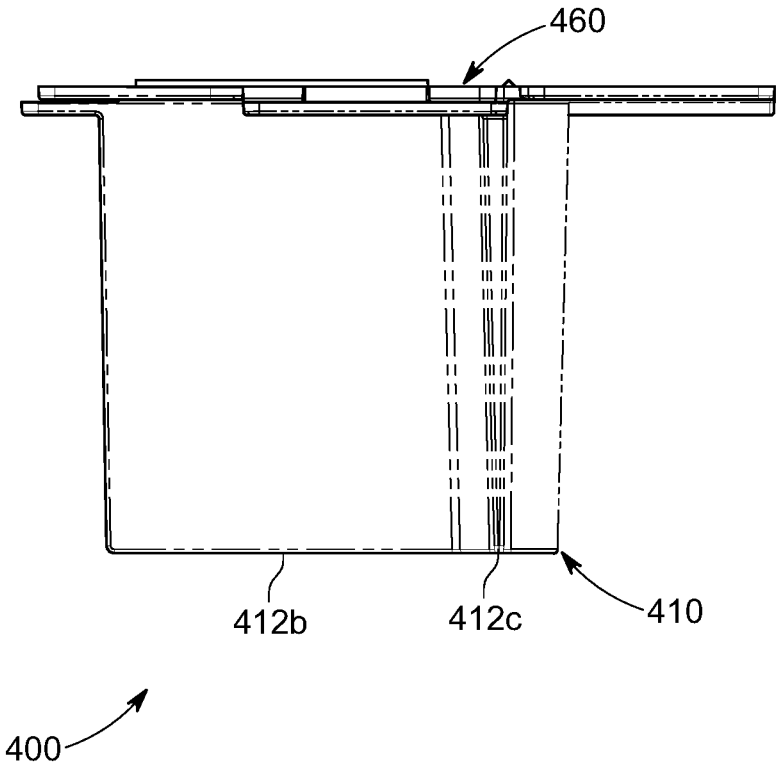
FIG. 31 is a first end view of the tee intersection connector of Figure
Figure 32:
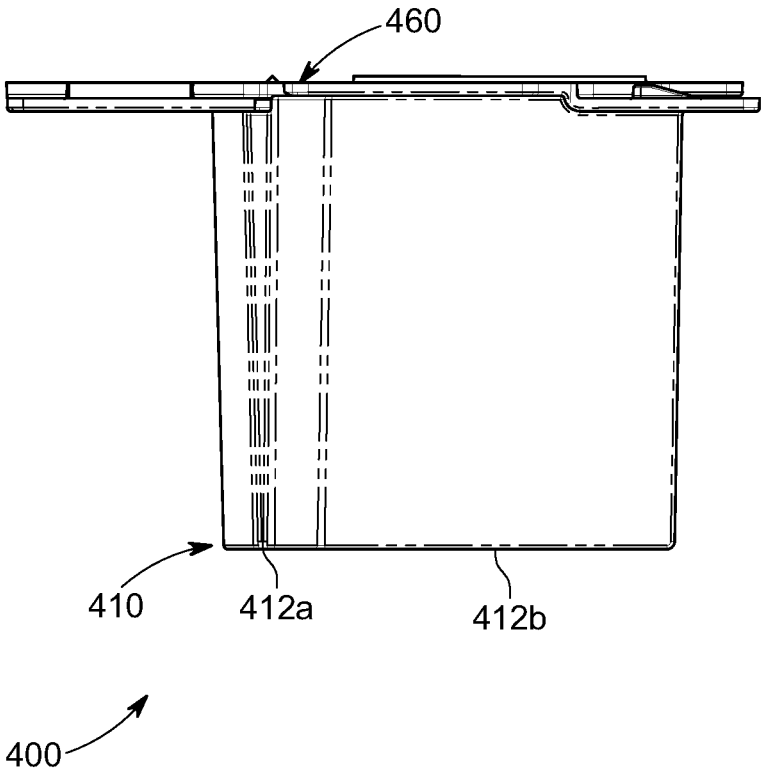
FIG. 32 is a second end view of the tee intersection connector of FIG. 25.
Figure 33:
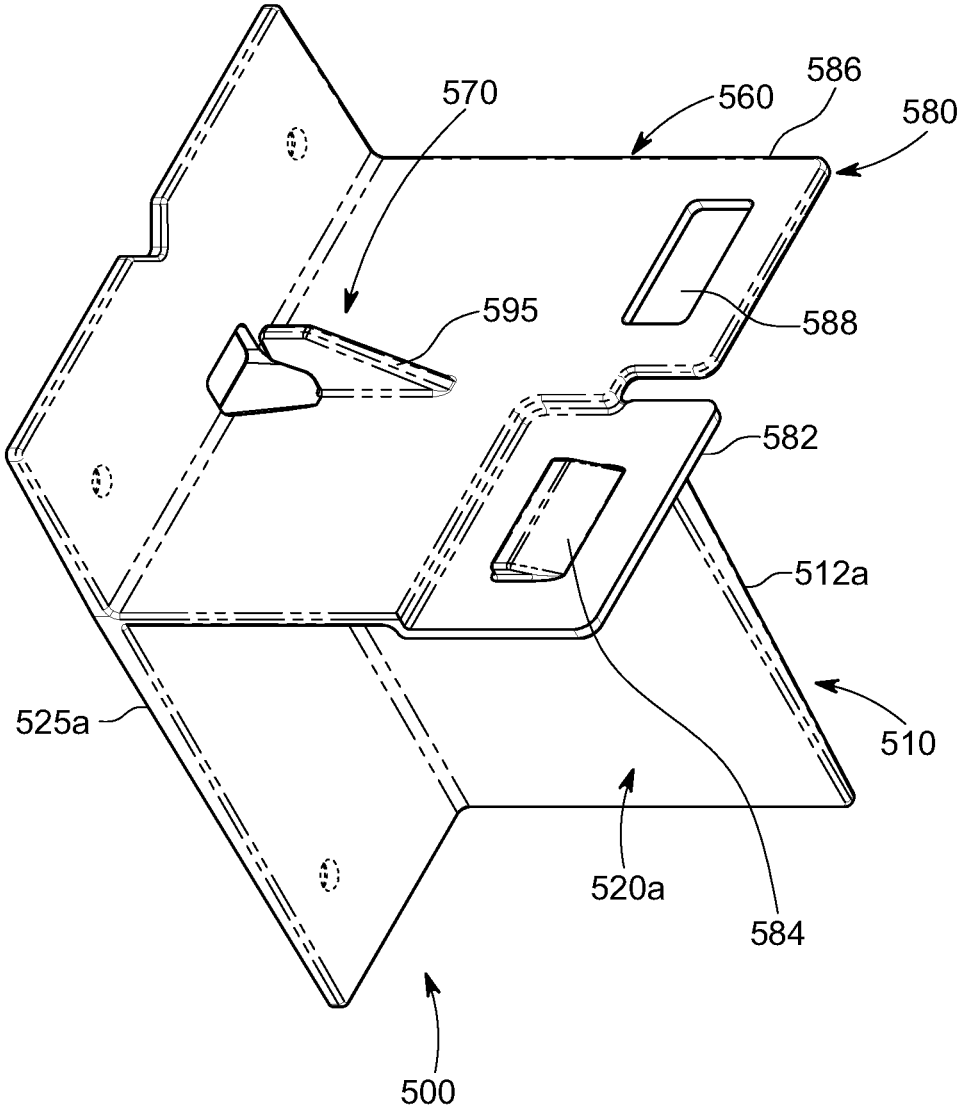
FIG. 33 is a top perspective view of an end connector of one example embodiment of the concrete slab joint forming system of the present disclosure.
Figure 34:
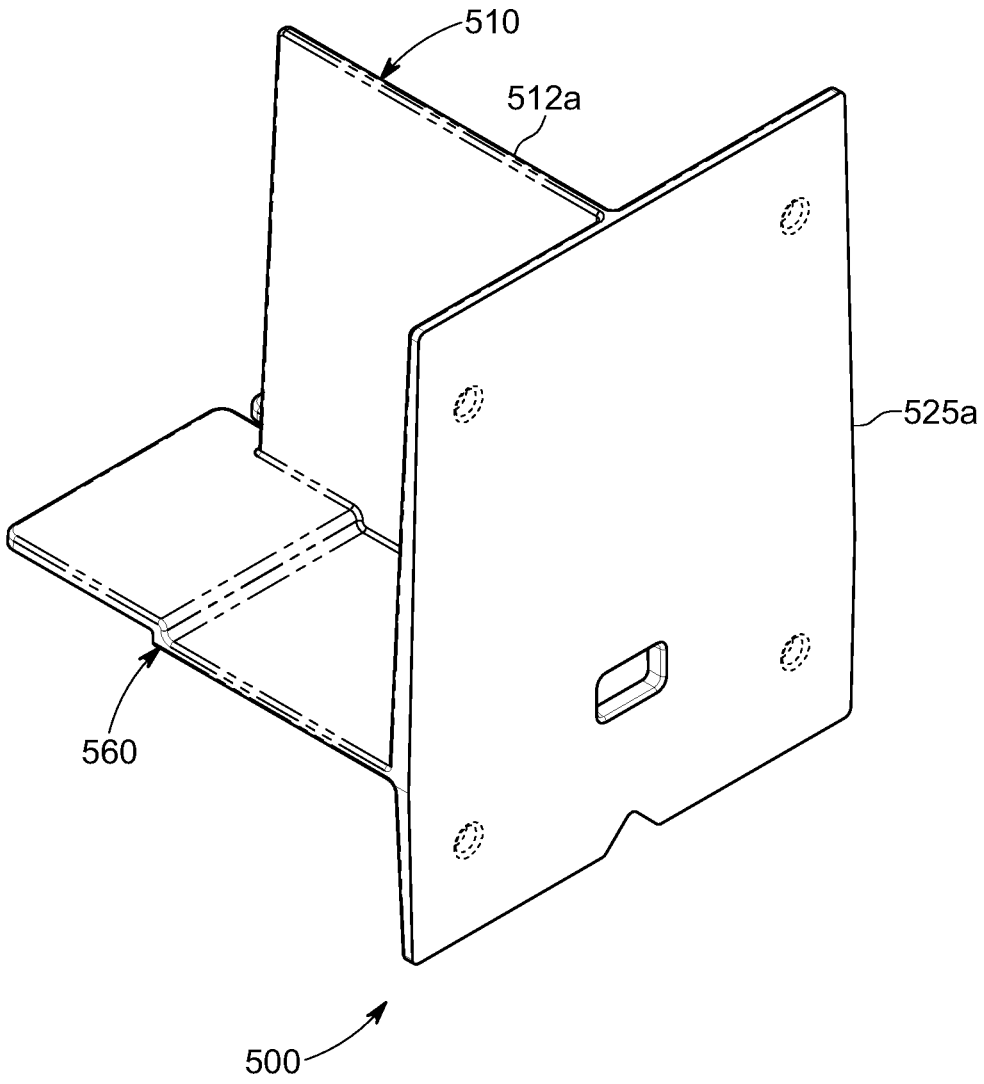
FIG. 34 is a bottom perspective view of the end connector of FIG. 33.
Figure 35:
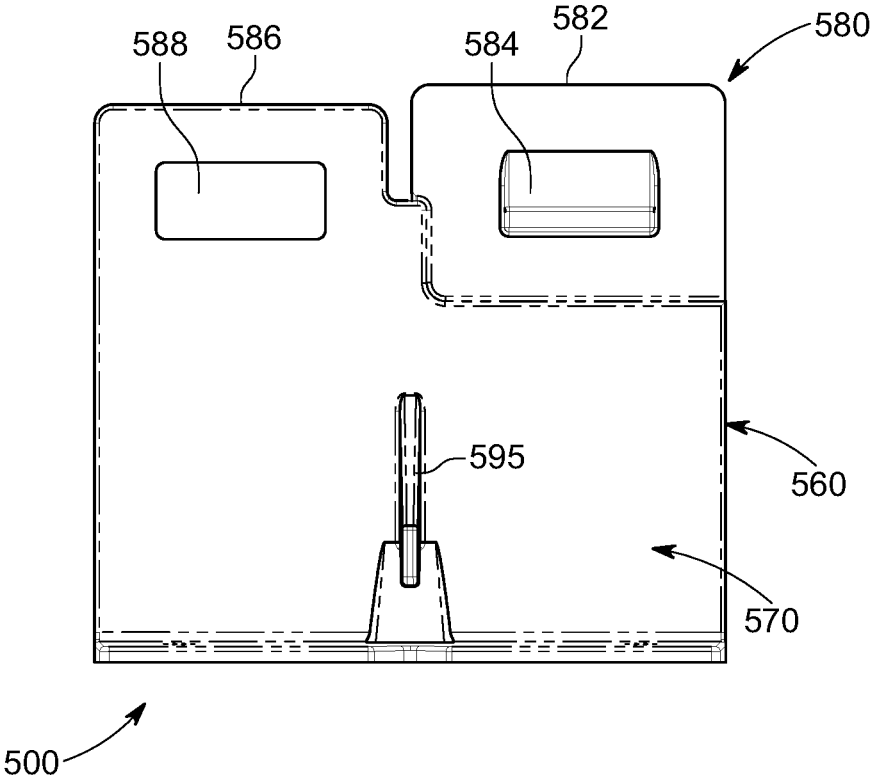
FIG. 35 is a top view of the end connector of FIG. 33.
Figure 36:
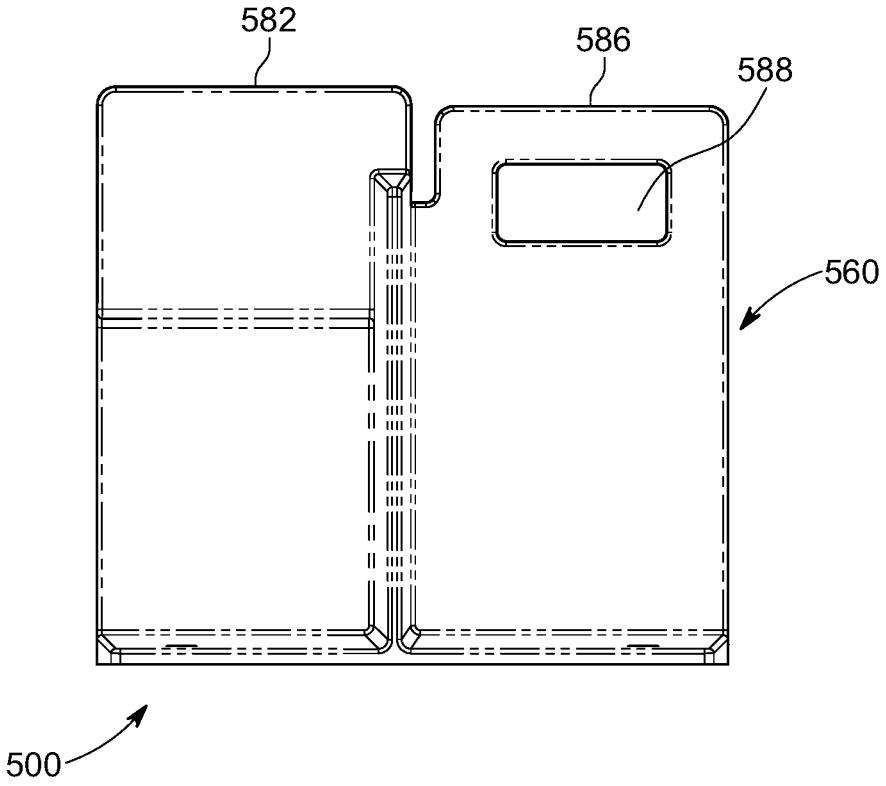
FIG. 36 is a bottom view of the end connector of FIG. 33.
Figure 37:
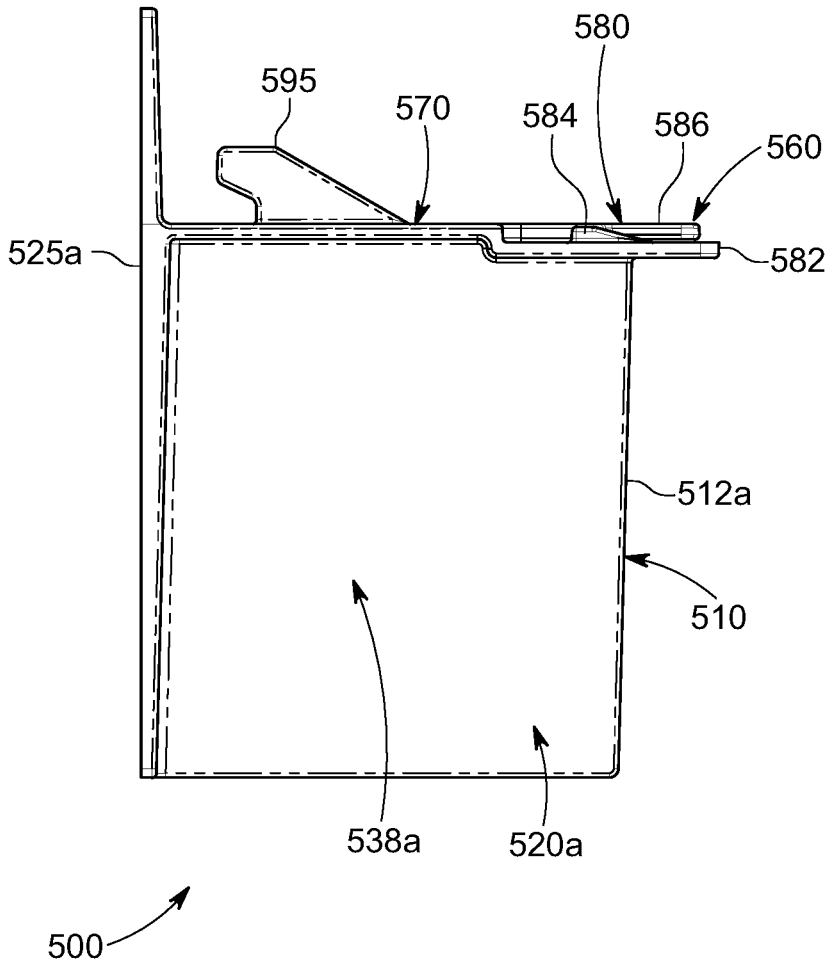
FIG. 37 is a first side view of the end connector of FIG. 33.
Figure 38:
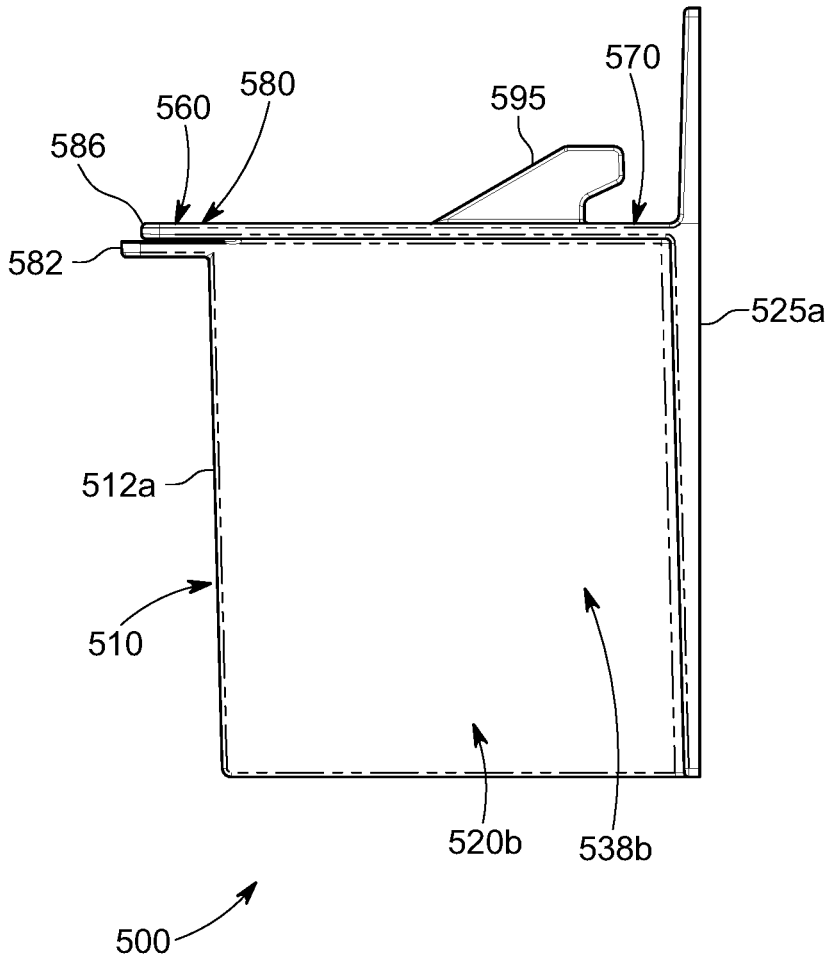
FIG. 38 is a second side view of the end of FIG. 33.
Figure 39:
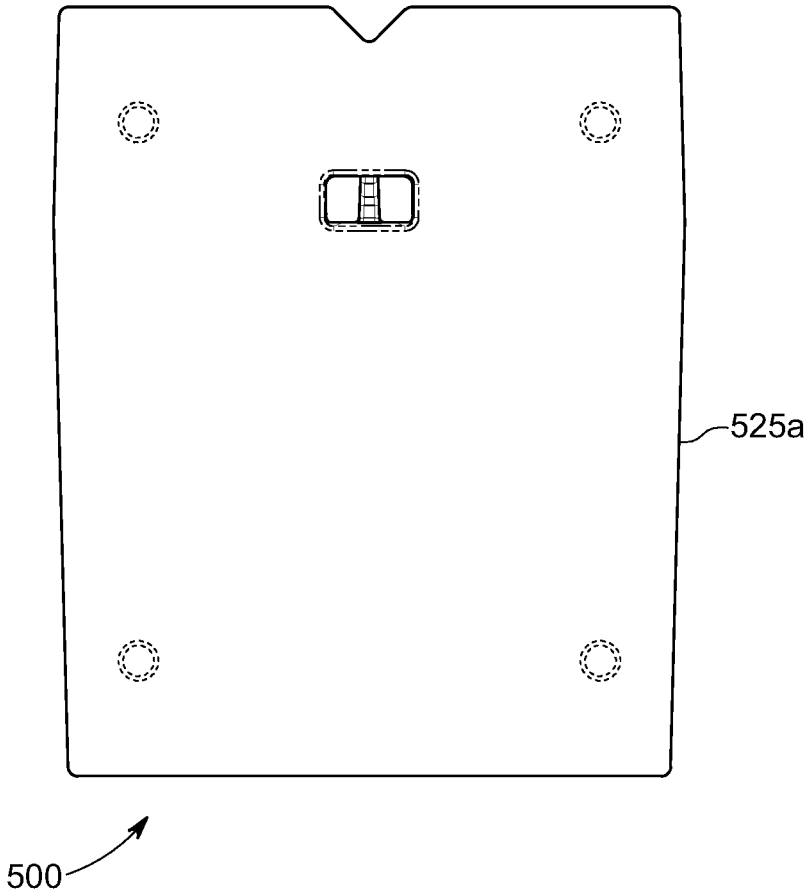
FIG. 39 is a first end view of the end connector of FIG. 33.
Figure 40:
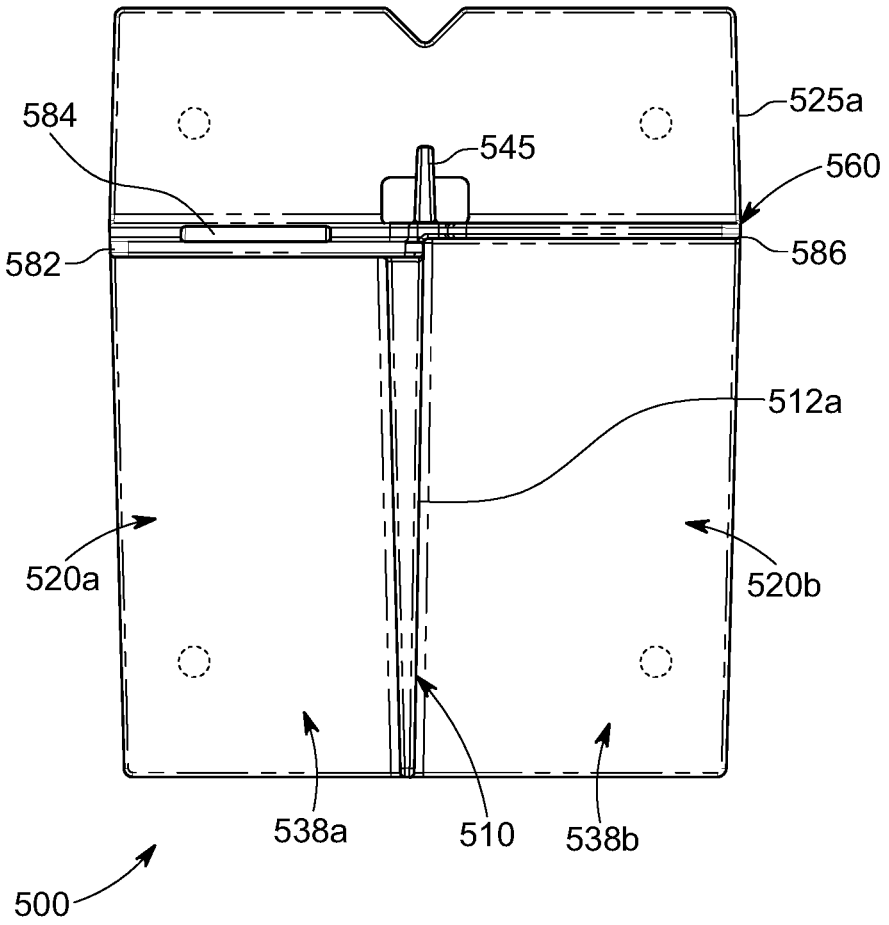
FIG. 40 is a second end view of the end connector of FIG. 33.
Figure 41:
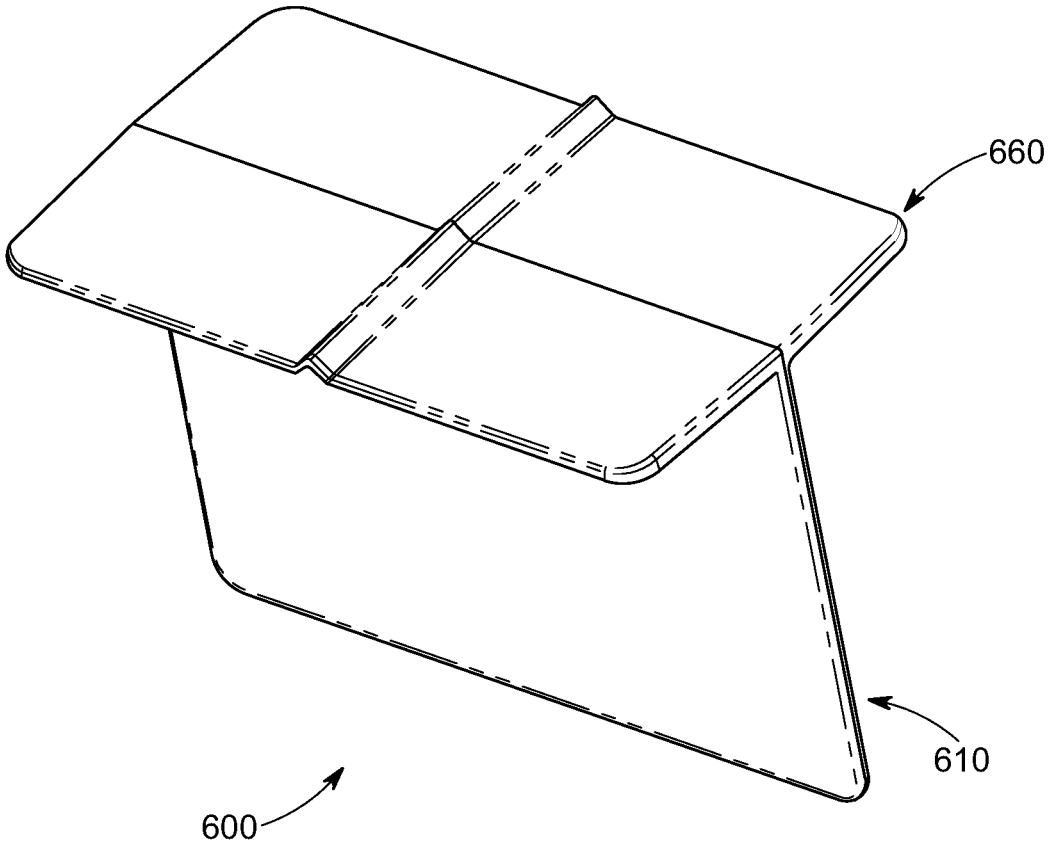
FIG. 41 is a top perspective view of a field cut connector of one example embodiment of the concrete slab joint forming system of the present disclosure.
Figure 42:
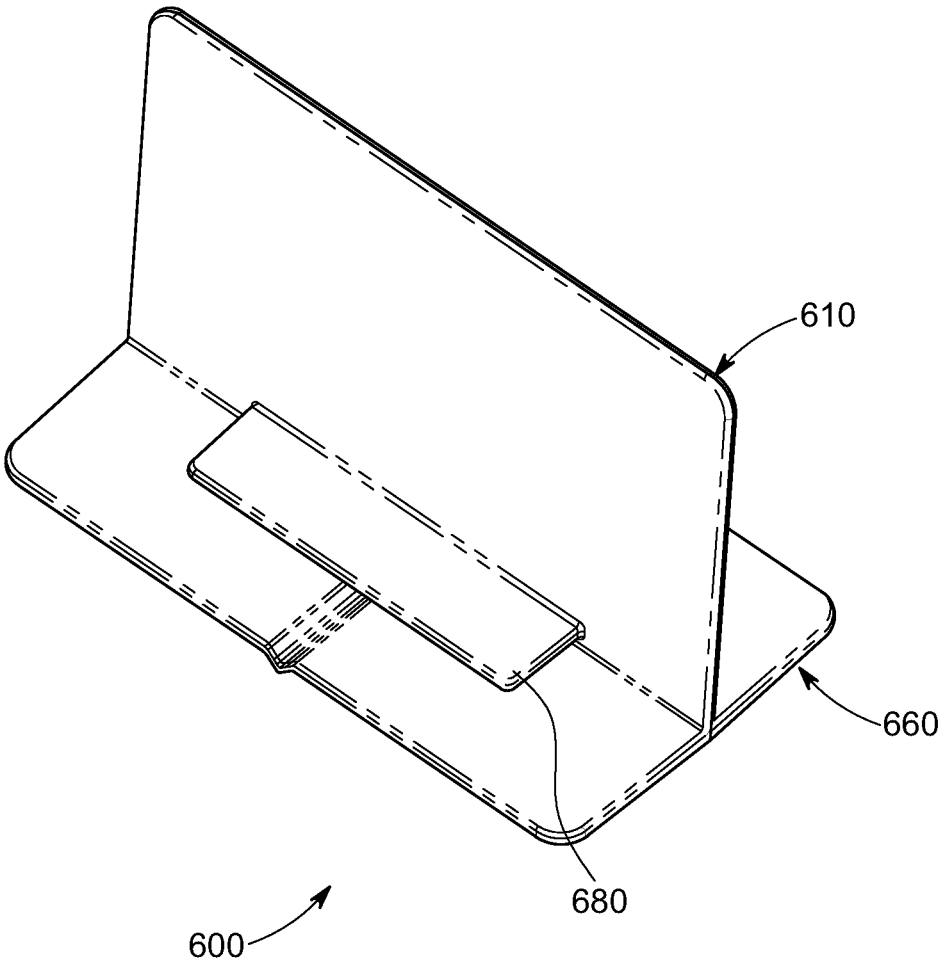
FIG. 42 is a bottom perspective view of the field cut connector of FIG. 33.
Figure 43:
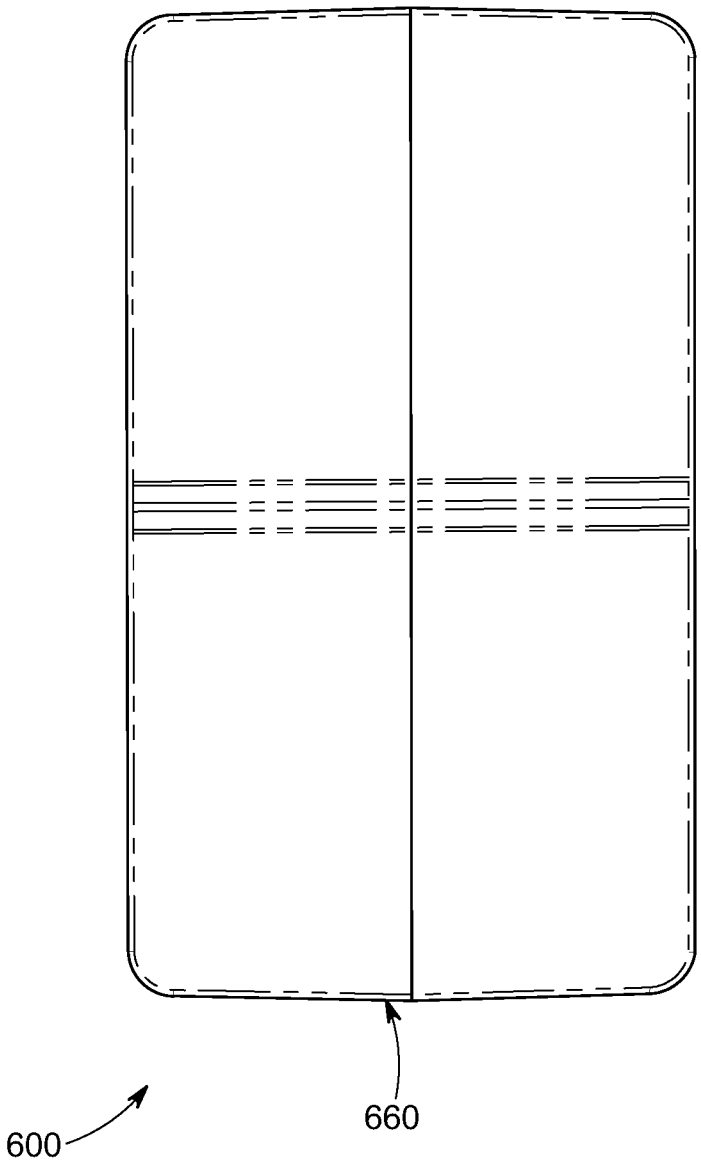
FIG. 43 is a top view of the field cut connector of FIG. 41.
Figure 44:
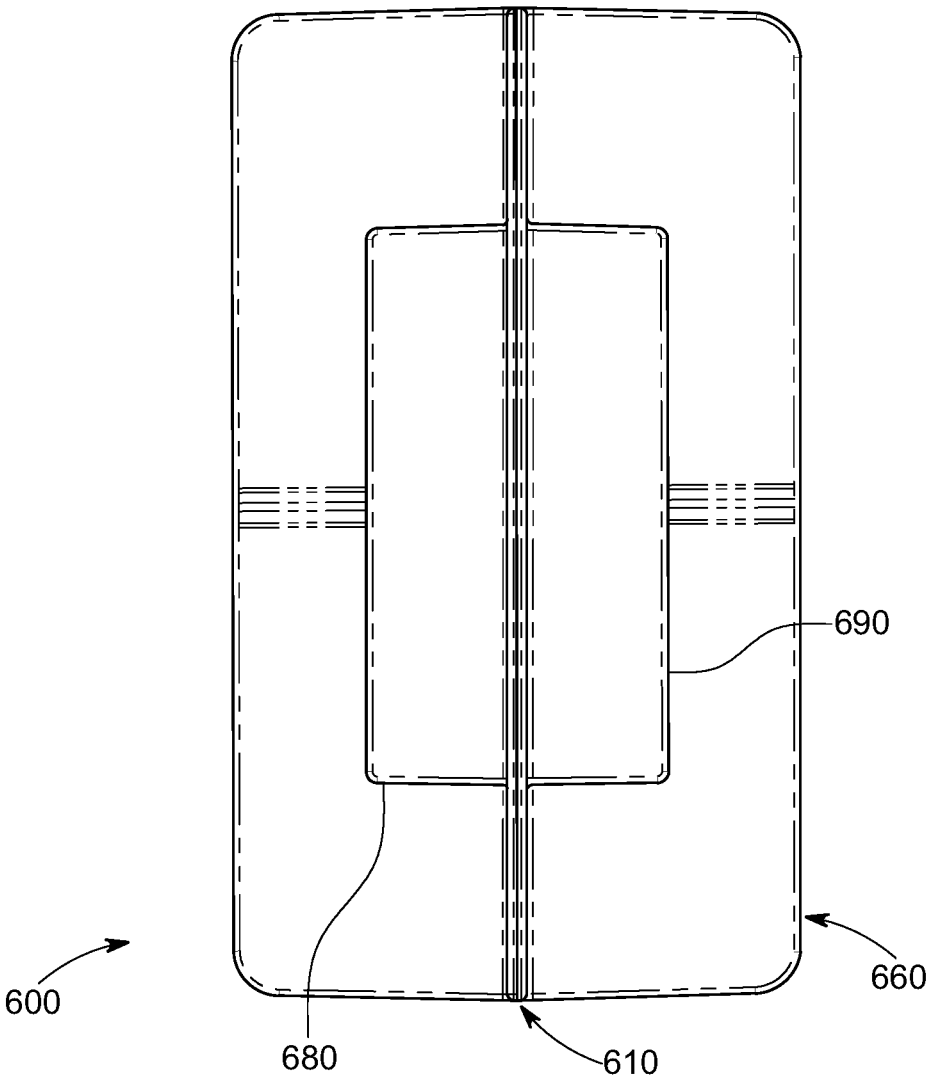
FIG. 44 is a bottom view of the field cut connector of FIG. 41.
Figure 45:
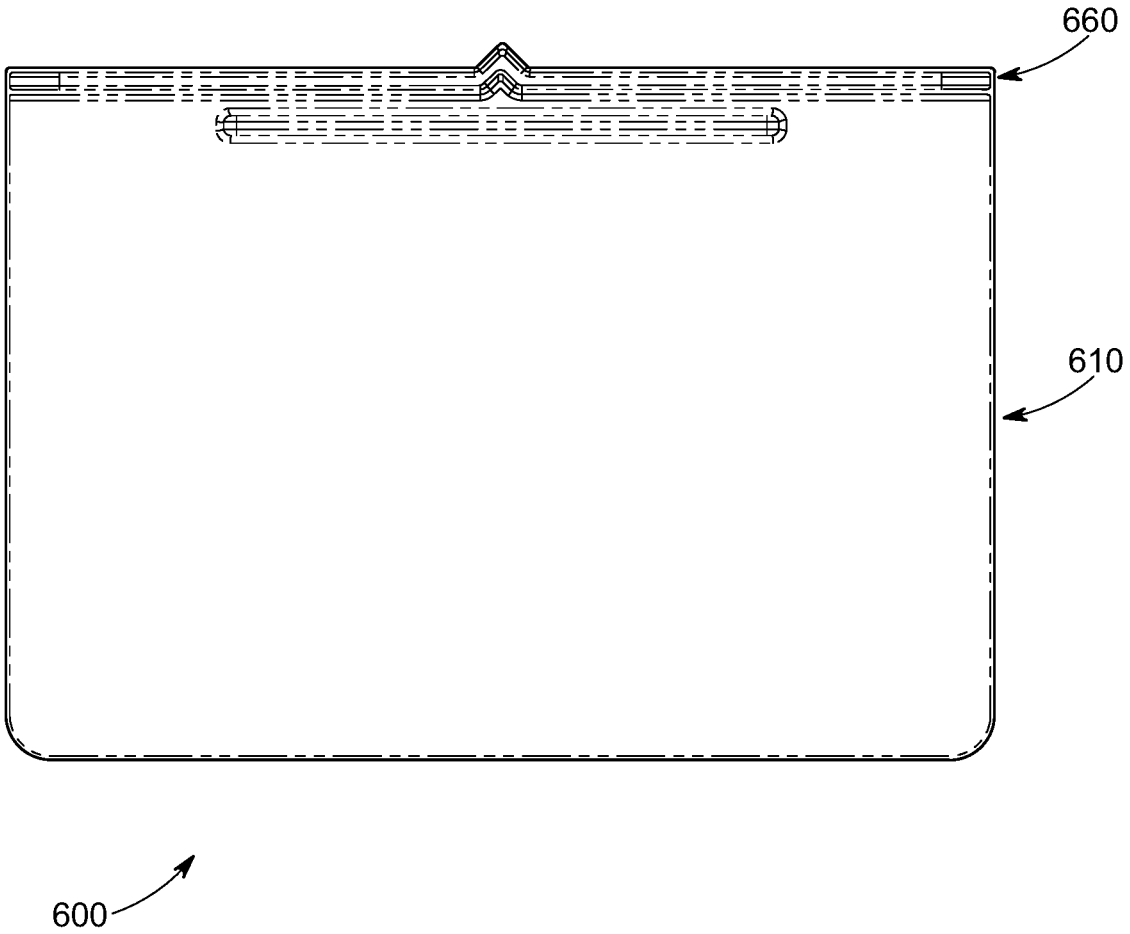
FIG. 45 is a first side view of the field cut connector of FIG. 41.
Figure 46:
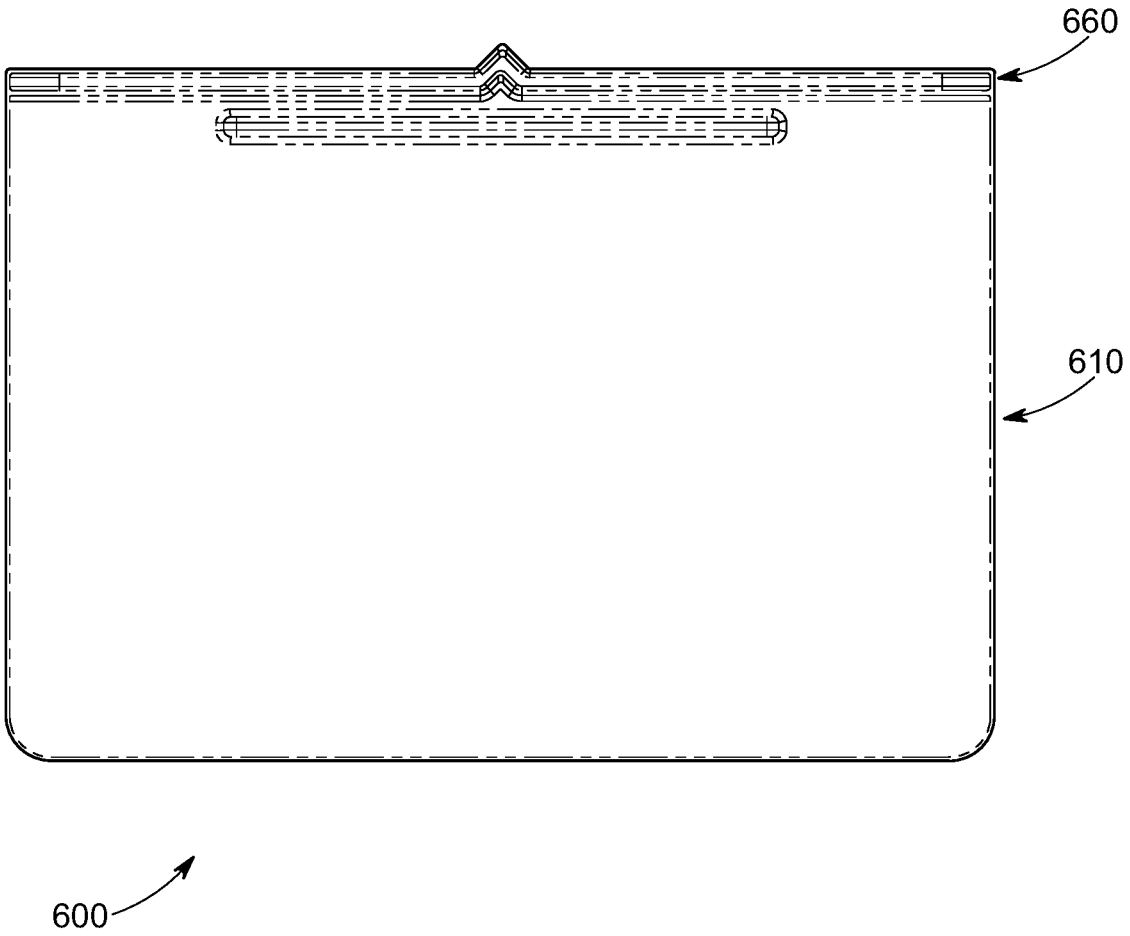
FIG. 46 is a second side view of the field cut of FIG. 41.
Figure 47:
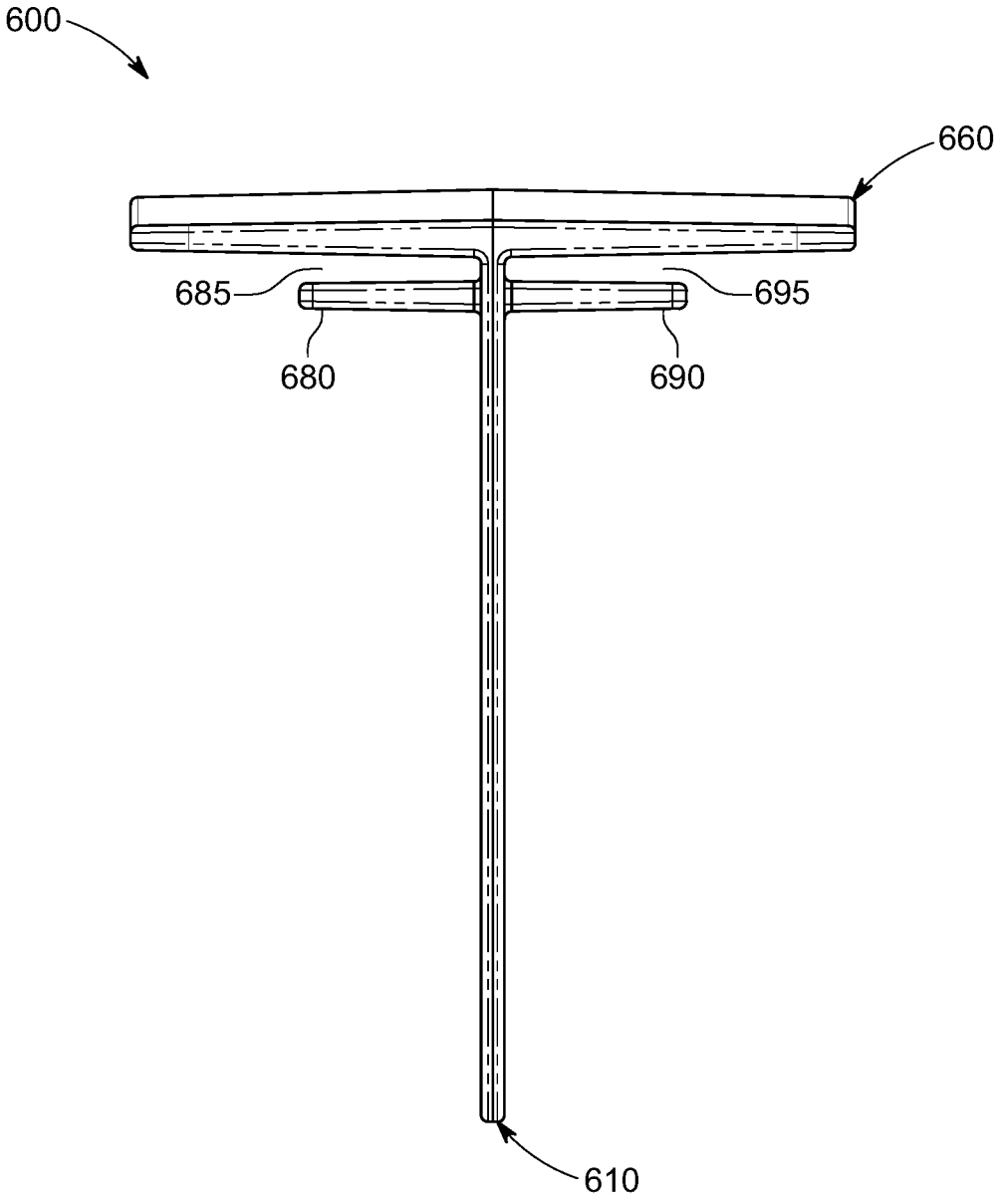
FIG. 47 is a first end view of the field connector of FIG. 41.
Figure 48:
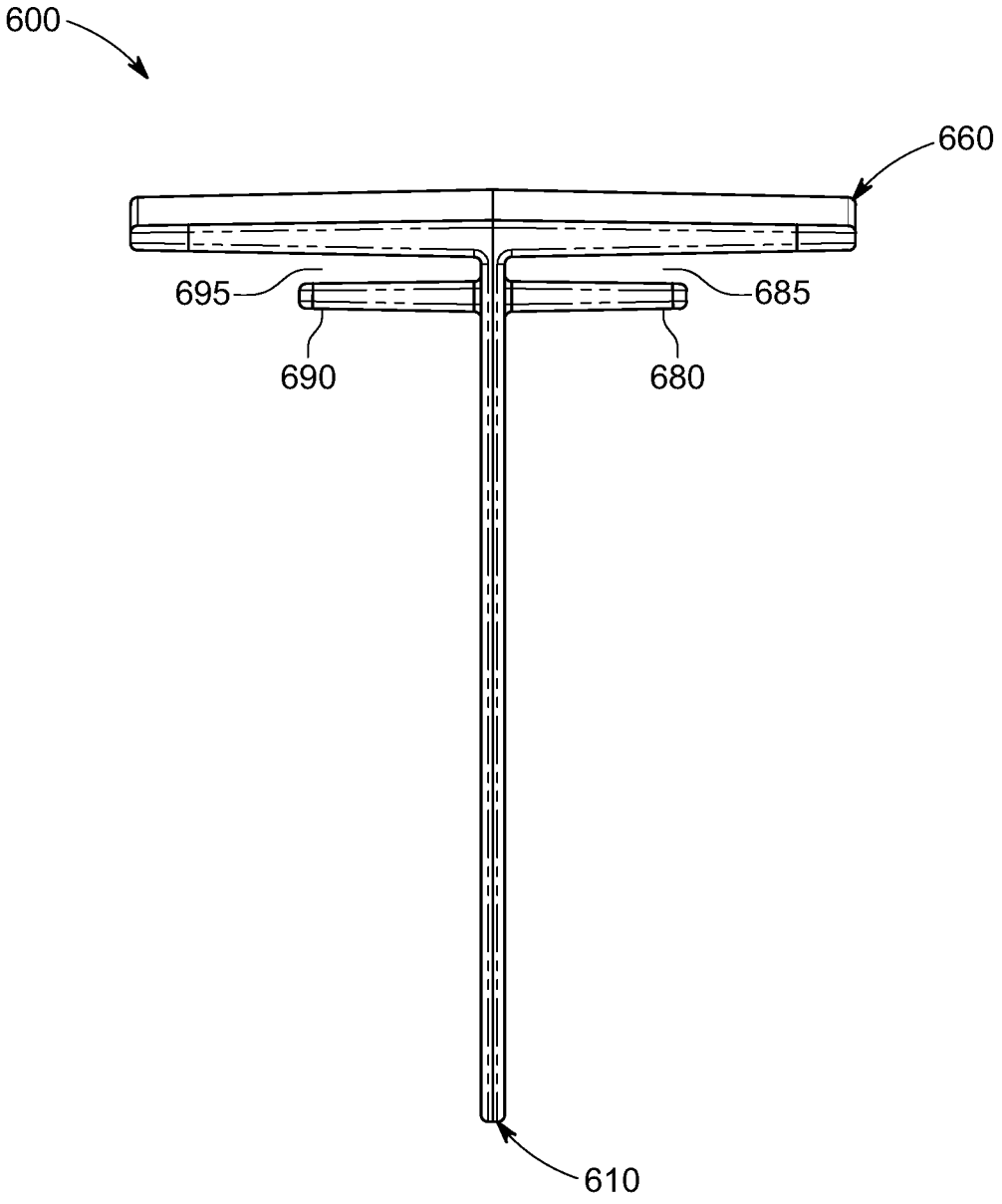
FIG. 48 is a second end view of the filed cut connector of FIG. 41.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

Various embodiments of the present disclosure provide concrete slab joint forming systems and methods of using such concrete slab joint forming systems for forming joints between adjacent concrete slabs and the concrete slabs themselves. For brevity, the concrete slab joint forming system may sometimes be referred to herein as the joint forming system or the system. Such abbreviations are not meant to limit the scope of the present disclosure.

In various embodiments of the present disclosure provide, the concrete slab joint forming systems and methods are dowel-less, and thus do not include any additional dowels that extend into the adjacent concrete slabs. In various embodiments, the lips and tongues of the adjacent concrete slabs perform the functions previously performed by such additional dowels.

Example Concrete Slab Joint Forming System

Figure 56:
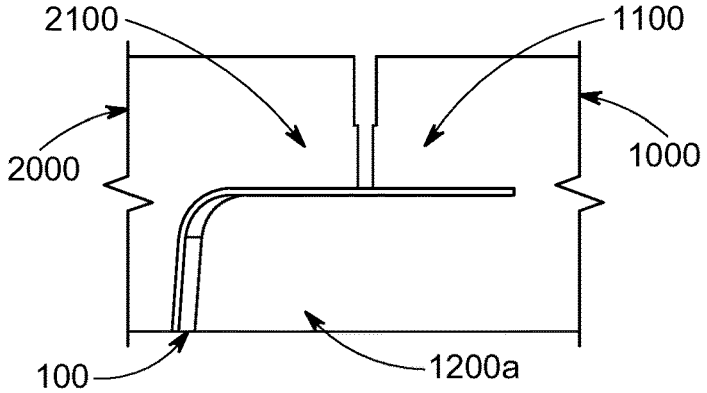
FIG. 56 is a fragmentary end cross-sectional view of the concrete slab joint former of FIG. 1 shown positioned between two adjacent concrete slabs, and illustrating the structures in the adjacent concrete slabs formed by the concrete slab joint former.

One example embodiment of the concrete slab joint forming system of the present disclosure is shown in FIGS. 1 to 56. This example embodiment of the concrete slab joint forming system includes a concrete slab joint former 100 shown in FIGS. 1 to 8, and various different connecters shown in FIGS. 9 to 48. The various different connectors in this example embodiment include: (a) an extension connector 200 shown in FIGS. 9 to 16, (b) a cross intersection connector 300 shown in FIGS. 17 to 24, (c) a tee intersection connector 400 shown in FIGS. 25 to 32, (d) an end connector 500 shown in FIGS. 33 to 40, and (e) a field cut connector 600 shown in FIGS. 41 to 48. The concrete slab joint former 100 can be employed with or without any of the connectors 200, 300, 400, 500, and/or 600. Multiple concrete slab joint formers 100 can be employed with each other and with or without one or more of any of the connectors 200, 300, 400, 500, and/or 600 to form joints for concrete slabs and the concrete slabs themselves.

Example Concrete Slab Joint Former

Turning now to FIGS. 1 to 8, in this illustrated example embodiment, this concrete slab joint former 100 includes: (a) an elongated load transfer tongue former 110; and (b) an elongated load transfer lip former 160 connected to the top of the load transfer tongue former 110. The load transfer tongue former 110 and the load transfer lip former 160 are configured to form opposing load transfer lips 1100 and 2100 respectively of the adjacent slabs 1000 and 2000 and opposing load transfer tongues 1200*a*, 1200*b*, 1200*c*, 1200*d*, and 1200*e* and 2200*a*, 2200*b*, 2200*c*, 2200*d*, 2200*e*, and 2200*f* respectively of the adjacent concrete slabs 1000 and 2000 such as shown in FIGS. 53, 54, 55, and 56, and as further discussed below. In various embodiments, the lips rest of the respective concrete slabs rest on the respective opposing tongues of the concrete slabs. Such opposing load transfer lips and opposing load transfer tongues are configured to transfer forces (such as but not limited to vertical forces) between the adjacent concrete slabs without the use of additional dowels as further explained below. In various circumstances, the concrete slab joint former 100 may additionally itself function as a dowel for assisting in the transfer of such forces between adjacent concrete slabs. The concrete slab joint former 100 may sometimes be referred to herein as the joint former 100 for brevity.

In the illustrated example embodiment, the concrete slab joint former 100 is molded from a polymer. It should be appreciated that the concrete slab joint former 100 can be made from other suitable materials in accordance with the present disclosure. In this illustrated example embodiment, this concrete slab joint former 100 is a single monolithically formed piece that includes the elongated load transfer tongue former 110 and the elongated load transfer lip former 160. In other embodiments, the elongated load transfer tongue former 110 and the elongated load transfer lip former 160 or parts thereof can be separately formed and connected together.

Figure 49:
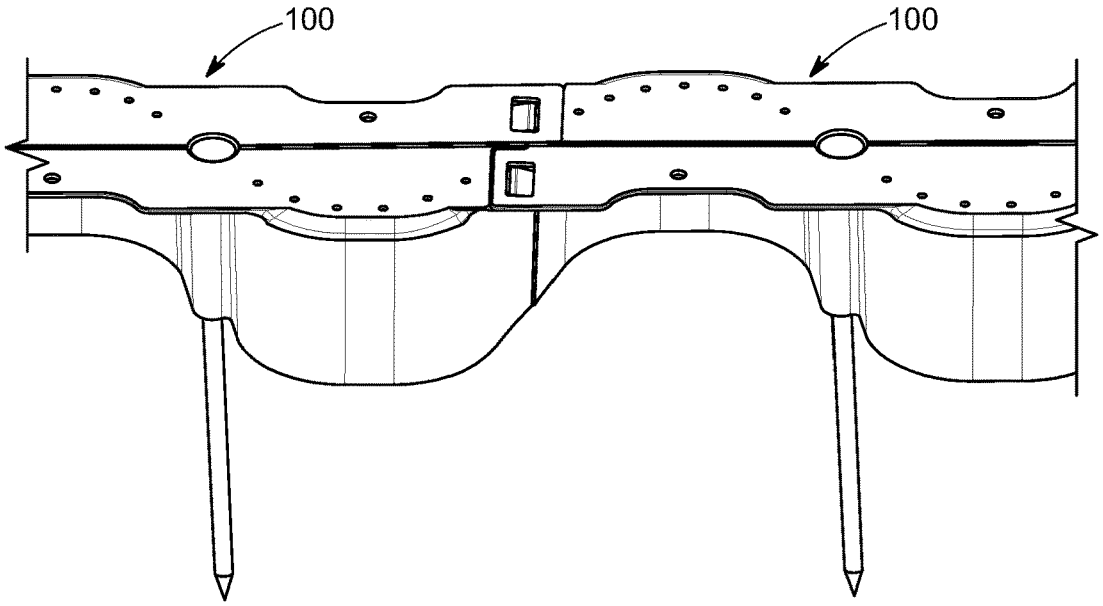
FIG. 49 is a fragmentary top perspective view of two concrete slab joint formers of FIG. 1 having their respective ends connected.

The load transfer tongue former 110 includes an upright vertically extending waveform 112 having multiple tongue forming concrete receipt sections 120*a*, 120*b*, 120*c*, 120*d*, 120*e*, 120*f*, and 120*g*. The waveform 112 has a longitudinally extending central axis (not shown). Each of the sections 120*a*, 120*b*, 120*c*, 120*d*, 120*e*, 120*f*, and 120*g* is connected to a respective adjacent section by a section connector. Specifically, section 120*a* is connected to section 120*b* by section connector 125*a*, section 120*b* is connected to section 120*c* by section connector 125*b*, section 120*c* is connected to section 120*d* by section connector 125*c*, section 120*d* is connected to section 120*e* by section connector 125*e*, section 120*e* is connected to section 120*f* by section connector 125*e*, and section 120*f* is connected to section 120*g* by section connector 125*f*. Each of the section connectors 125*a*, 125*b*, 125*c*, 125*d*, 125*e*, and 125*f* defines an upright vertically extending substrate fastener receiver (not labeled) that is shaped, sized, and otherwise configured to receive a fastener (such as a nail as shown in FIG. 49) that connects the concrete slab joint former 100 to a substrate (not shown) on which the concrete slabs formed using the joint former 100 will be positioned.

In this example embodiment, the sections 120*b*, 120*c*, 120*d*, 120*e*, and 120*f* respectively include first tongue forming concrete receipt segments 130*b*, 130*c*, 130*d*, 130*e*, and 130*f* that each extends outwardly in a first direction from the central axis and respectively include second tongue forming concrete receipt segments 140*b*, 140*c*, 140*d*, 140*e*, and 140*f* that each extends outwardly in a second opposite direction from the central axis. The adjacent segments of each of the sections 120*b*, 120*c*, 120*d*, 120*e*, and 120*f* thus extend in opposing directions (e.g., the first segment of each of the sections extend in the first direction and second segment of each of the concrete receipt sections extend in the second direction).

In this example embodiment, the section 120*a* has a tongue forming concrete receipt segment 140*a* that extends outwardly in the second direction from the central axis. Likewise, in this example embodiment, the section 120*g* has a tongue forming concrete receipt segment 130*g* that extends outwardly in the first opposite direction from the central axis.

The plurality of tongue forming concrete receipt segments 130*b*, 130*c*, 130*d*, 130*e*, 130*f*, and 130*f* respectively form a plurality of spaced-apart first slab concrete receipt pockets 138*b*, 138*c*, 138*d*, 138*e*, 138*f*, and 138*g* Each of the plurality of first slab concrete receipt pockets 138*b*, 138*c*, 138*d*, 138*e*, 138*f*, and 138*g* are wider at their openings, narrower at their innermost points, and are inwardly tapered from their openings to their innermost points.

The plurality of the tongue forming concrete receipt segments 140*a*, 140*b*, 140*c*, 140*d*, 140*e*, and 140*f* respectively form a plurality of spaced-apart second slab concrete receipt pockets 148*a*, 148*b*, 148*c*, 148*d*, 148*e*, and 148*f*. Each of the second slab concrete receipt pockets 148*a*, 148*b*, 148*c*, 148*d*, 148*e*, and 148*f* are wider at their openings, narrower at their innermost points, and are inwardly tapered from their openings to their innermost points.

The plurality of spaced apart first slab concrete receipt pockets 138*b*, 138*c*, 138*d*, 138*e*, 138*f*, and 138*g* alternate with the plurality of spaced apart second slab concrete receipt pockets 148*a*, 148*b*, 148*c*, 148*d*, 148*e*, and 148*f* in the directions of their respective openings, and are inwardly tapered from their openings to their innermost points.

The sections 120*a*, 120*b*, 120*c*, 120*d*, 120*e*, 120*f*, and 120*g* each are of the same height in this example embodiment. It should be appreciated that the height of the sections can vary in accordance with the present disclosure. In various different example embodiments, the height of the waveform 112 is 2.75 inches (6.985 cms), 3.75 inches (9.525 cms), 5.5 inches (13.97 cms), or 7.5 inches (19.05 cms). These example heights can for example be used with concrete slabs have heights (generally referred to as thicknesses) of between 5 inches (12.7 cms) and 16 inches (40.64 cms). The heights will thus generally depend on the heights of the concrete slabs in various embodiments.

All of the segments of the sections 120*a*, 120*b*, 120*c*, 120*d*, 120*e*, 120*f*, and 120*g* define the same respective pocket depths in this example embodiment. It should be appreciated that the depths of two or more of the pockets defined by the segments can vary in accordance with the present disclosure. In this various example embodiments, the pocket depth of the waveform 112 is 5 inches (12.7 cms), however the depth can depend on the desired depth of the lips and tongues of the concrete slabs.

All of the segments of the sections 120*a*, 120*b*, 120*c*, 120*d*, 120*e*, 120*f*, and 120*g* have the same radius of curvature in this example embodiment. It should also be appreciated that the radius of curvatures of two or more of the segments of the sections can vary in accordance with the present disclosure. The curvatures can be considered to at least partially define the amplitude of the waveform 112. It should be appreciated that the amplitude of the waveform can vary in accordance with the present disclosure. It should also be appreciated that a single waveform can have a varying amplitude in accordance with the present disclosure.

It should further be appreciated that the quantity of sections of the waveform 112 and thus the quantity of segments of the waveform 112 can vary in accordance with the present disclosure, such as based on the length of the concrete slab joint former 100. In various example embodiments, the waveform 112 is 69 inches (175.26 cms). It should thus be appreciated that the waveform 112 can be made in other suitable sizes, shapes, and configurations in accordance with the present disclosure.

The load transfer lip former 160 includes an elongated central section 170, a first end connection section 180, and a second end connection section 190, each of which are connected to the top of the waveform 112 in this example embodiment. In other embodiments, only the elongated central section 170 is connected to the top of the waveform 112 and the first end connection section 180 and the second end connection section 190 are connected to opposite ends of the waveform 112 and extend in opposing directions from the waveform 112.

The central section 170 is connected to the top of the waveform 112 and extends substantially the entire length of the waveform 112. The central section 170 includes horizontally extending top and bottom surfaces 171*t* and 171*b* that are flat (or substantially flat), extend in parallel (or substantially horizontal parallel) planes to one another, and have a constant thickness or height in this illustrated example embodiment. The central section 170 includes a plurality of sections 172*a*, 172*b*, 172*c*, 172*d*, 172*e*, 172*f*, and 172*g* that correspond with the sections 120*a*, 120*b*, 120*c*, 120*d*, 120*e*, 120*f*, and 120*g* of the waveform 112. The plurality of sections 172*b*, 172*c*, 172*d*, 172*e*, 172*f*, and 172*g* respectively have a plurality of segments 173*b*, 173*c*, 173*d*, 173*e*, 173*f*, and 173*g* that correspond to segments 130*b*, 130*c*, 130*d*, 130*e*, 130*f*, and 130*g* of the waveform 112. The plurality of sections 172*b*, 172*c*, 172*d*, 172*e*, 172*f*, and 172*g* also respectively have a plurality of segments 174*a*, 174*b*, 174*c*, 174*d*, 174*e*, and 174*f*, that correspond with the segments 140*a*, 140*b*, 140*c*, 140*d*, 140*e*, and 140*f* of the waveform 112.

In this example embodiment, each of the segments 173*b*, 173*c*, 173*d*, 173*e*, 173*f*, 173*g*, 174*a*, 174*b*, 174*c*, 174*d*, 174*e*, and 174*f* define a plurality of spaced-apart air and/or moisture release openings (not labeled) that each extend from the bottom surface 171*b* of the central section 170 to the top surface 171*t* of the central section 170. These air release openings enable air caught in the concrete that extends into the pockets 138*b*, 138*c*, 138*d*, 138*e*, 138*f*, 138*g*, 148*a*, 148*b*, 148*c*, 148*d*, 148*e*, and 148*f* during formation of the adjacent concrete slabs and under the load transfer lip former 160 to escape through such openings.

Figure 57:
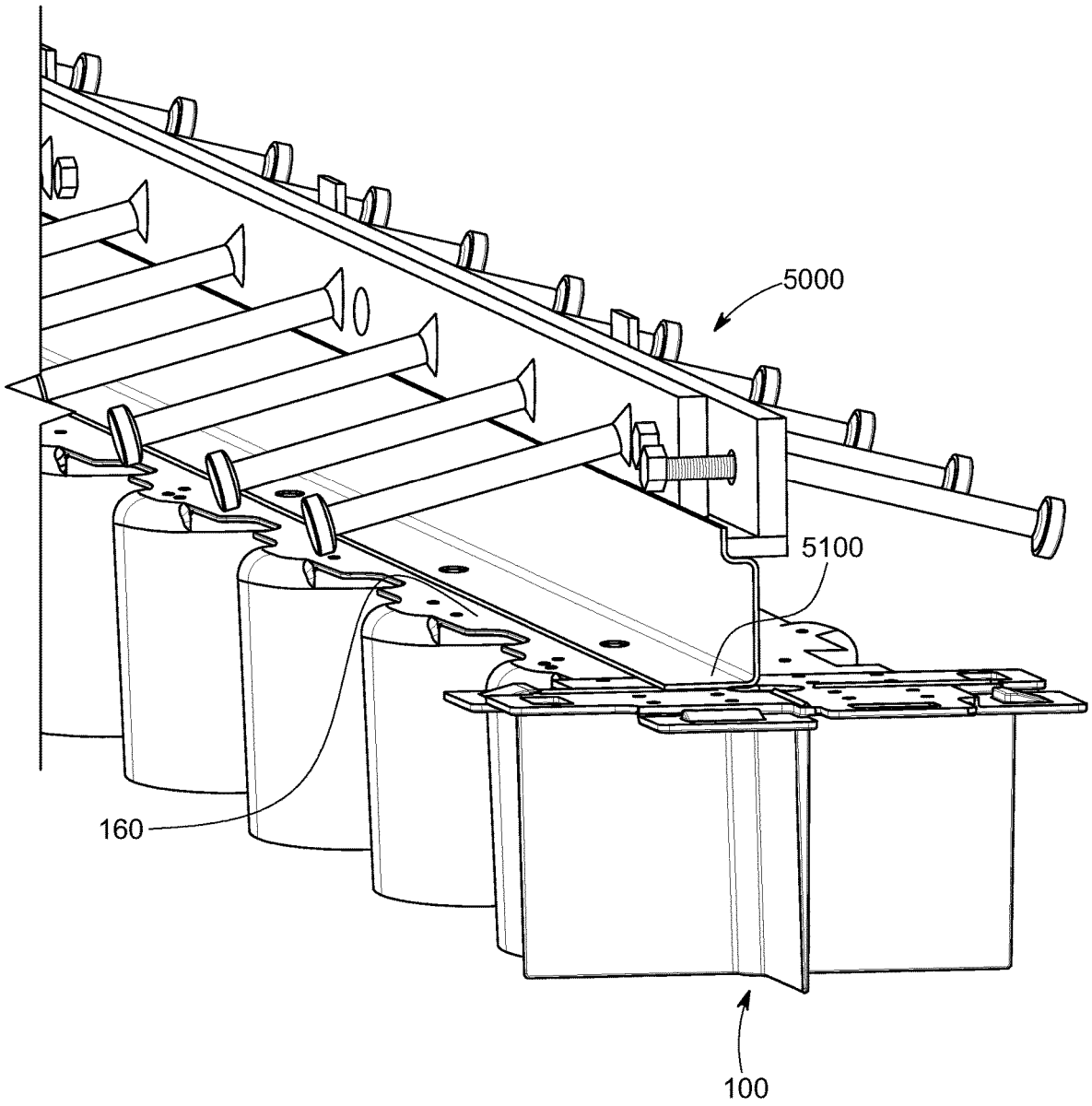
FIG. 57 is a fragmentary perspective view of an upright wall of an example edge member assembly attached above and to the concrete slab joint former of FIG. 1.

In this example embodiment, the segments also respectively define a plurality of spaced-apart edge member attachment openings (not individually labeled) that each extend from the bottom surface 171*b* of the central section 170 to the top surface 171*t* of the central section 170 that enable the bottom upright wall of an edge member assembly to be attached (by suitable fasteners (not shown)) above and to the load transfer lip former 160 and thus the concrete slab joint former 100. FIG. 57 shows an example of a bottom upright wall 5100 of an edge member assembly 5000 attached (by suitable fasteners (not shown)) above and to a load transfer lip former 160 and thus the concrete slab joint former 100. Thus, the concrete slab joint former 100 of the present disclosure can additionally function with a joint edge assembly to form a construction joint between two adjacent slabs.

Figure 58:
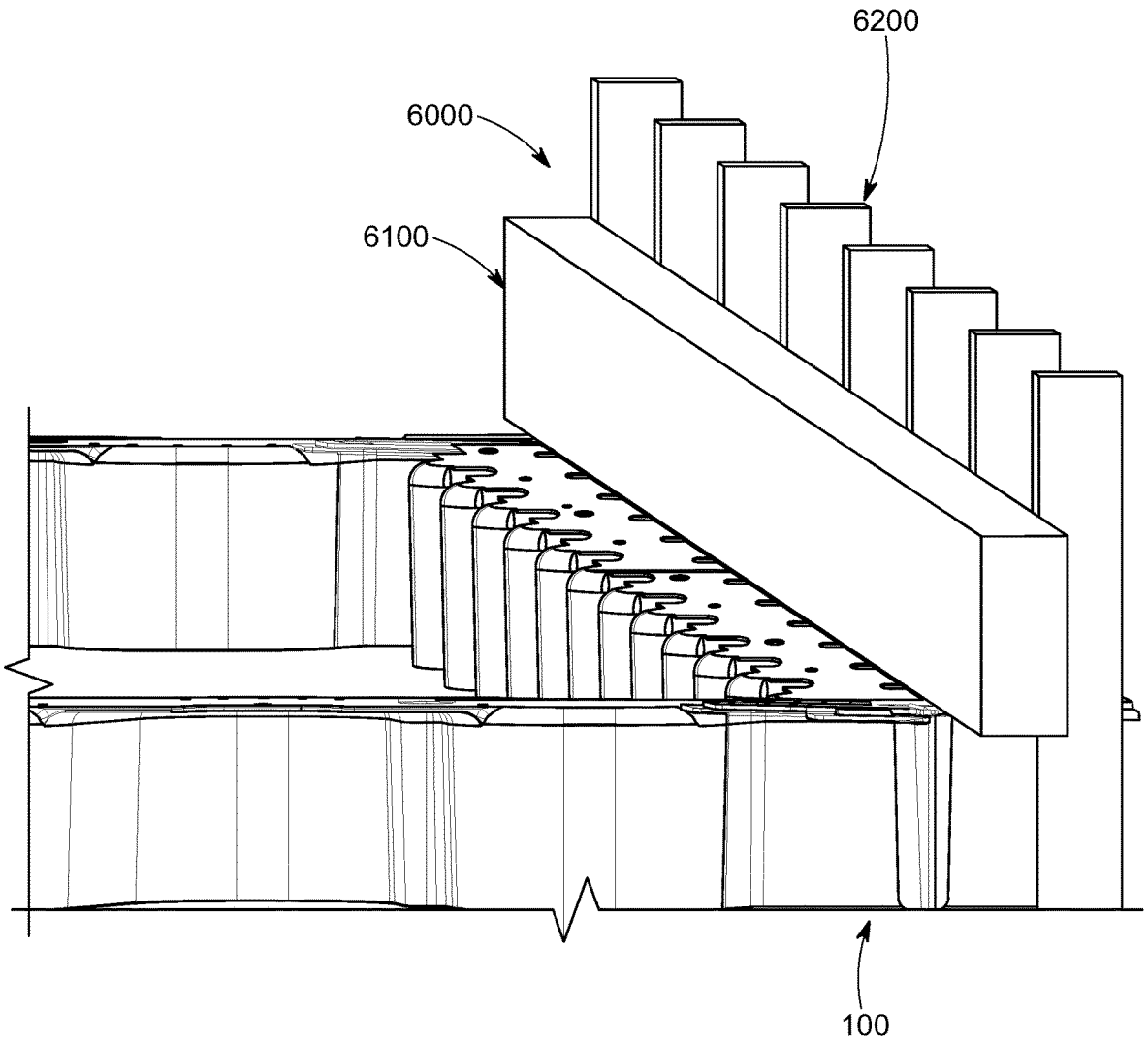
FIG. 58 is a fragmentary perspective view of the concrete slab joint former of FIG. 1 shown positioned with formwork for forming a construction joint.

In this example embodiment, the segments also respectively define a plurality of spaced-apart formwork receipt areas 178*a*, 178*b*, 178*c*, 178*d*, 178*e*, 178*f*, 178*g*, 178*h*, 178*i*, 178*j*, 178*k*, and 1781 configured to receive upright stakes of a formwork such as partially shown in FIG. 58) for forming construction joints between adjacent concrete slabs. Specifically, the concrete slab joint former 100 can be used with formwork for construction joints where one of the concrete slabs is poured and hardened before the adjacent concrete slab. In the illustrated example embodiment of FIG. 58, a horizontally extending two-by-four 6100 is positioned over the lip former and attached to the stakes 6200. The indented spaced-apart formwork receipt areas 178*a*, 178*b*, 178*c*, 178*d*, 178*e*, 178*f*, 178*g*, 178*h*, 178*i*, 178*j*, 178*k*, and 1781 enable the stakes and the two-by-four to be positioned such the inside surface of the two-by-four is directly aligned with the longitudinal center axis of the load transfer lip former 160 and the waveform 112 for forming the outer side surface of the concrete slab.

The first end connection section 180 includes top and bottom surfaces (not labeled). The first end connection section 180 includes a locking member portion 182 and a locking member receipt portion 186. The locking member portion 182 includes an upwardly extending locking member 184 (which is this example embodiment is an upwardly extending locking tab). The locking member receipt portion 186 defines a locking member receipt opening 188 configured to securely but releasably receive a locking member (and in this example embodiment an upwardly extending locking tab).

Likewise, the second end connection section 190 includes top and bottom surfaces (not labeled). The second end connection section 190 includes a locking member portion 192 and a locking member receipt portion 196. The locking member portion 192 includes an upwardly extending locking member 194 (which is this example embodiment is an upwardly extending locking tab). The locking member receipt portion 186 defines a locking member receipt opening 198 configured to securely but releasably receive a locking member (and in this example embodiment an upwardly extending locking tab).

The first end connection section 180 and the second end connection section 190 are thus configured with the locking member portion 182 and the locking member receipt portion 186 oppositely positioned from the locking member portion 192 and the locking member receipt portion 196. This enables two the concrete slab joint former 100 to be connected to each other end to end such as shown in FIG. 49.

Figure 50:
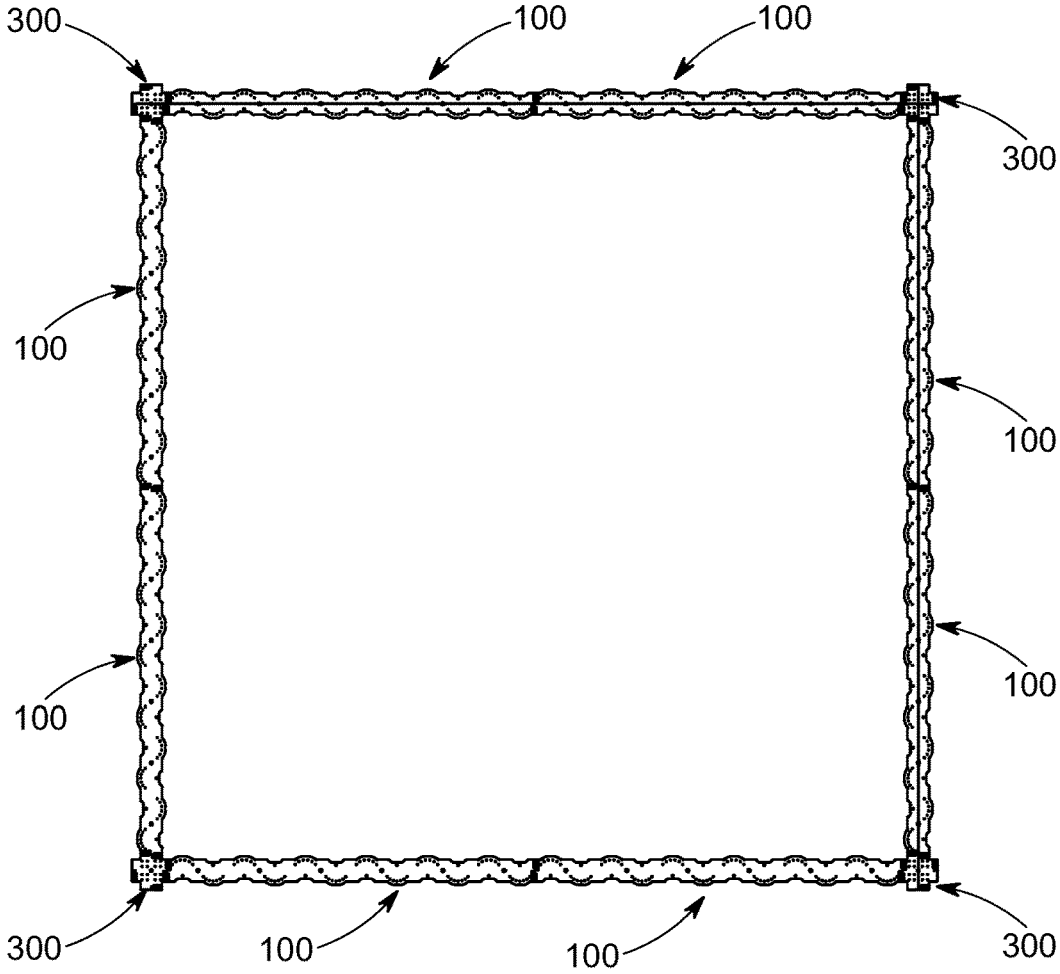
FIG. 50 is a top view of eight concrete slab joint formers of FIG. 1 and four cross intersection connector of FIG. 17 suitably connected.
Figure 51:
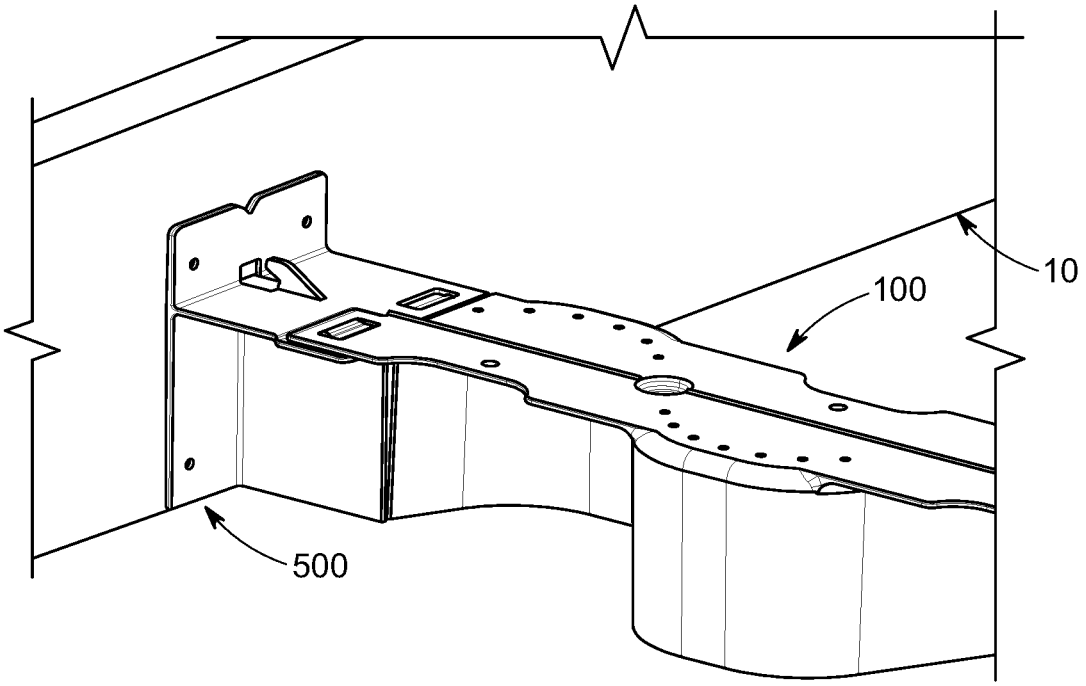
FIG. 51 is a fragmentary top perspective view of one concrete slab joint former of FIG. 1 connected to an end connector of FIG. 33 that is in turn connected to formwork.

This also enables either end of the concrete slab joint former 100 to be connected to any of the extension connector 200, the cross intersection connector 300, the tee intersection connector 400, and the end connector 500 such as shown in FIGS. 49, 50, and 51.

The elongated lip former 160 further defines a longitudinally and upwardly extending central crack initiator 162 in the top surfaces of the central section 170, the first end connection section 180, and the second end connection section 190. This crack initiator 162 facilitates alignment of the joint former and an indication to the installer for alignment purposes as to where the cut in the concrete should be made to form the contraction joint between and to form the adjacent concrete slabs. This crack initiator 162 further facilitates the forming of the crack or separation in the concrete to form the separate adjacent concrete slabs. Specifically, when the concrete is cut from the top to form the location of the separation between the two concrete slabs and to form the contraction joint, the crack initiator can provide a weakened area in the concrete that will assist in forming the separation in the correct location.

It should thus be appreciated from the above and as shown in FIGS. 53, 54, 55, and 56 that in this illustrated example embodiment of present disclosure, each concrete slab joint former 100 is positionable at an area where a contraction joint will be formed between adjacent concrete slabs, as further discussed below.

Example Extension Connector

Turning now to FIGS. 9 to 16, in this illustrated example embodiment, the extension connector 200 of the concrete slab joint forming system is substantially similar to the concrete slab joint former 100 but is substantially shorter in length. The extension connector 200 includes: (a) a load transfer tongue former 210; and (b) a load transfer lip former 260 connected to the top of the load transfer tongue former 210. The load transfer tongue former 210 and the load transfer lip former 260 are configured to form opposing load transfer lips and opposing load transfer tongues in the adjacent concrete slabs as further discussed below and such that the opposing load transfer lips and opposing load transfer tongues are configured to transfer vertical forces between the adjacent concrete slabs without the use of dowels as further explained below.

In the illustrated example embodiment, the extension connector 200 is molded from a polymer. It should be appreciated that the extension connector 200 can be made from other suitable materials in accordance with the present disclosure. In this illustrated example embodiment, this extension connector 200 is a single monolithically formed piece that includes the load transfer tongue former 210 and the load transfer lip former 260. In other embodiments, the load transfer tongue former 210 and the load transfer lip former 260 or parts thereof can be separately formed and connected together.

The load transfer tongue former 210 includes an upright vertically extending waveform 212 having two tongue forming concrete receipt sections 220*a* and 220*b*. The waveform 212 has a longitudinally extending central axis (not shown). The sections 220*a* and 220*b* are connected by a section connector 225*a*. The section connector 225*a* defines an upright vertically extending substrate fastener receiver (not labeled) that is shaped, sized, and otherwise configured to receive a fastener (such as shown in FIG. 49) that connects the extension connector 200 to a substrate (not shown) on which the concrete slabs partially formed by the extension connector 200 will be positioned.

In this example embodiment, the section 220*a* has a tongue forming concrete receipt segment 230*a* that extends outwardly in a first direction from the central axis. The tongue forming concrete receipt segment 230*a* forms a slab concrete receipt pocket 238*a* that is wider at its opening, narrower at its innermost points, and is inwardly tapered from its opening to their innermost points.

Likewise, in this example embodiment, the section 220*b* has a tongue forming concrete receipt segment 240*b* that extends outwardly in a second opposite direction from the central axis. The tongue forming concrete receipt segment 240*b* forms a second slab concrete receipt pocket 248*b* that is wider at its opening, narrower at its innermost points, and is inwardly tapered from its openings to its innermost points.

The opening of the first slab concrete receipt pocket 238*a* faces in an opposite direction as the opening of the second slab concrete receipt pocket 248*b*.

The sections 220*a* and 220*b* each are of the same height in this example embodiment. It should be appreciated that the height of the sections can vary in accordance with the present disclosure. In various different example embodiments, the heights of the waveform 212 is 2.75 inches (6.985 cms), 3.75 inches (9.525 cms), 5.5 inches (13.97 cms), or 7.5 inches (19.05 cms).

The segments of the sections 220*a* and 220*b* form pockets of the same depth in this example embodiment. It should be appreciated that the depths of the pockets formed by the segments can vary in accordance with the present disclosure. In this example embodiment, the depth of each pocket of the waveform 212 is 5 inches (12.7 cms), however the depth can depend on the desired depth of the lips and tongues of the concrete slabs.

The segments of the sections 220*a* and 220*b* have the same radius of curvature in this example embodiment. It should also be appreciated that the radius of curvatures of the segments of the sections can vary in accordance with the present disclosure. The curvatures can be considered to define the amplitude of the waveform 212.

It should be appreciated that the quantity of sections of the waveform 212 and thus the quantity of segments of the waveform 212 can vary in accordance with the present disclosure, such as based on the length of the extension connector 200.

In this example embodiment, the waveform 212 is 12 inches (30.48 cms). It should also be appreciated that the waveform 212 can be made in other suitable sizes, shapes, and configurations in accordance with the present disclosure.

The load transfer lip former 260 includes a central section 270, a first end connection section 280, and a second end connection section 290, each of which are connected to the top of the waveform 212.

The central section 270 is attached to the top of the waveform 212 and extends substantially the entire length of the waveform 212.

The central section 270 includes top and bottom surfaces (not labeled) that are flat (or substantially flat) and extend in parallel (or substantially parallel) planes to one another in this illustrated example embodiment. The central section 270 includes a two sections 272*a* and 272*b* that correspond with the sections 220*a* and 220*b* of the waveform 212. The sections 272*a* and 272*b* respectively have a plurality of segments 273*a* and 273*b* that correspond with the segments 240*a* and 240*b* of the waveform 212.

In this example embodiment, each of the segments 240*a* and define a plurality of spaced-apart air release openings (not labeled) that each extend from the bottom surface 271*b* of the central section 270 to the top surface 271*t* of the central section 270. These air release opening enable air caught in the concrete under the load transfer lip former 260 to escape through such openings.

Although not shown, the segments can define a plurality of spaced-apart edge member attachment openings that enable edge members to be attached above and to the load transfer lip former 260 and thus the extension connector 200.

Although not shown, the segments can define a plurality of spaced-apart formwork receipt areas that can be used to receive upright formwork members.

The first end connection section 280 includes top and bottom surfaces (not labeled). The first end connection section 280 includes a locking member portion 282 and a locking member receipt portion 286. The locking member portion 282 includes an upwardly extending locking member 284 (which is this example embodiment is an upwardly extending locking tab). The locking member receipt portion 286 defines a locking member receipt opening 288 configured to securely but releasably receive a locking member (and in this example embodiment an upwardly extending locking tab).

Likewise, the second end connection section 290 includes top and bottom surfaces (not labeled). The second end connection section 290 includes a locking member portion 292 and a locking member receipt portion 296. The locking member portion 292 includes an upwardly extending locking member 294 (which is this example embodiment is an upwardly extending locking tab). The locking member receipt portion 286 defines a locking member receipt opening 298 configured to securely but releasably receive a locking member (and in this example embodiment an upwardly extending locking tab).

The first end connection section 280 and the second end connection section 290 are configured with the locking member portion 282 and the locking member receipt portion 286 are oppositely positioned from the locking member portion 292 and the locking member receipt portion 296. This enables two extension connectors 200 to be connected to each other end to end, and also enables either end of the extension member 200 to be connected to either end of the concrete slab joint former 100, and either end to be connected to any of the cross intersection connector 300, the tee intersection connector 400, or the end connector 500, such as further discussed below.

The lip former 260 further defines a longitudinally extending central crack initiator 262 in the central section 270, the first end connection section 280, and the second end connection section 290. This crack initiator 262 assists in facilitating the formation of the crack between the adjacent concrete slabs when the installer cuts the concrete from the top to form the contraction joint between the two concrete slabs.

It should thus be appreciated from the above that in this illustrated example embodiment of present disclosure, each extension connector is positionable at an area where a contraction joint will be formed between adjacent concrete slabs, as further discussed below. Such extension connector 200 can be employed with one or more concrete slab joint former 100 to extend such concrete slab joint former 100. Such extension connector 200 can also be employed with one or more other extension connectors 200.

Example Cross Intersection Connector

Turning now to FIGS. 17 to 24, in this illustrated example embodiment, the cross intersection connector 300 of the concrete slab joint forming system includes: (a) a load transfer corner tongue former 310; and (b) a load transfer corner lip former 360 connected to the top of the load transfer corner tongue former 310. The load transfer corner tongue former 310 and the load transfer lip former 360 are configured to form an intersection area for two, three, or four joint formers 100.

In the illustrated example embodiment, the cross intersection connector 300 is molded from a polymer. It should be appreciated that this cross intersection connector 300 can be made from other suitable materials in accordance with the present disclosure. In this illustrated example embodiment, this cross intersection connector 300 is a single monolithically formed piece that includes the load transfer corner tongue former 310 and the load transfer corner lip former 360. In other embodiments, the load transfer corner tongue former 310 and the load transfer corner lip former 360 or parts thereof can be separately formed and connected together.

The load transfer corner tongue former 310 includes upright vertically extending dividers 312*a*, 312*b*, 312*c*, and 312*d* that form four sections 320*a*, 320*b*, 320*c*, and 320*d*. The dividers 312*a*, 312*b*, 312*c*, and 312*d* are connected by a wall connector 325*a*. The wall connector 325*a* defines an upright vertically extending substrate fastener receiver (not labeled) that is shaped, sized, and otherwise configured to receive a fastener (not shown) that connects the cross intersection connector 300 to a substrate (not shown) on which the concrete slabs formed using the cross intersection connector 300 will be positioned.

In this example embodiment, the section 320*a* extends outwardly in a first direction from the wall connector 325*a* and forms a slab concrete receipt pocket 338*a* that is wider at its opening, narrower at its innermost points, and is inwardly tapered from its opening to its innermost points.

Likewise, the section 320*b* extends outwardly in a second direction from the wall connector 325*b* and forms a slab concrete receipt pocket 338*b* that is wider at its opening, narrower at its innermost points, and is inwardly tapered from its opening to its innermost points.

Likewise, the section 320*c* extends outwardly in a third direction from the wall connector 325*c* and forms a slab concrete receipt pocket 338*c* that is wider at its opening, narrower at its innermost points, and is inwardly tapered from its opening to its innermost points.

Likewise, the section 320*d* extends outwardly in a fourth direction from the wall connector 325*d* and forms a slab concrete receipt pocket 338*d* that is wider at its opening, narrower at its innermost points, and is inwardly tapered from its opening to its innermost points.

The openings of the first, second, third, and fourth slab concrete receipt pockets 338*a*, 338*b*, 338*c*, and 338*d* thus face in four different directions.

The sections 320*a*, 320*b*, 320*c*, and 320*d* each are of the same height in this example embodiment. It should be appreciated that the heights of the sections can vary in accordance with the present disclosure. In various different example embodiments, the height is 2.75 inches (6.985 cms), 3.75 inches (9.525 cms), 5.5 inches (13.97 cms), or 7.5 inches (19.05 cms).

The sections 320*a*, 320*b*, 320*c*, and 320*d* have the same depth in this example embodiment. It should be appreciated that the depths of the section can vary in accordance with the present disclosure.

The load transfer lip former 360 includes a central section 370, a first end connection section 380, a second end connection section 390, a third end connection section 380*a*, and a fourth end connection section 390*a* that are connected to the top of the dividers 312*a*, 312*b*, 312*c*, and 312*d*.

The central section 370 is attached to the top of the dividers 312*a*, 312*b*, 312*c*, and 312*d*. The central section 370 includes top and bottom surfaces (not labeled) that are flat (or substantially flat) and extend in parallel (or substantially parallel) planes to one another in this illustrated example embodiment. The central section 370 includes four sections (not labeled) that correspond with the sections 320*a*, 320*b*, 320*c*, and 320*d*.

In this example embodiment, each of the sections 320*a*, 320*b*, 320*c*, and 320*d* and define a plurality of spaced-apart air release openings (not labeled) that each extend from the bottom surface of the central section 370 to the top surface of the central section 370. These air release openings enable air caught in the concrete under the load transfer lip former 360 to escape through such openings.

The first end connection section 380 includes top and bottom surfaces (not labeled). The first end connection section 380 includes a locking member portion 382 and a locking member receipt portion 386. The locking member portion 382 includes an upwardly extending locking member 384 (which is this example embodiment is an upwardly extending locking tab). The locking member receipt portion 386 defines a locking member receipt opening 388 configured to securely but releasably receive a locking member (and in this example embodiment an upwardly extending locking tab).

Likewise, the second end connection section 390 includes top and bottom surfaces (not labeled). The second end connection section 390 includes a locking member portion 392 and a locking member receipt portion 396. The locking member portion 392 includes an upwardly extending locking member 394 (which is this example embodiment is an upwardly extending locking tab). The locking member receipt portion 386 defines a locking member receipt opening 398 configured to securely but releasably receive a locking member (and in this example embodiment an upwardly extending locking tab).

Likewise, the third end connection section 380*a* includes top and bottom surfaces (not labeled). The third end connection section 380*a* includes a locking member portion 382*a* and a locking member receipt portion 386*a*. The locking member portion 382*a* includes an upwardly extending locking member 384*a* (which is this example embodiment is an upwardly extending locking tab). The locking member receipt portion 386*a* defines a locking member receipt opening 388*a* configured to securely but releasably receive a locking member (and in this example embodiment an upwardly extending locking tab).

Likewise, the fourth second end connection section 390*a* includes top and bottom surfaces (not labeled). The fourth second end connection section 390*a* includes a locking member portion 392*a* and a locking member receipt portion 396*a*. The locking member portion 392*a* includes an upwardly extending locking member 394*a* (which is this example embodiment is an upwardly extending locking tab). The locking member receipt portion 386*a* defines a locking member receipt opening 398*a* configured to securely but releasably receive a locking member (and in this example embodiment an upwardly extending locking tab).

As explained above, the first, second, third, and fourth end connection sections 380, 380*a*, 390, and 390*a* are each configured to be connected to an end of a joint former 100 or to an extension connector 200. This enables two, three, or four joint formers 100 or extension connectors 200 to be connected to each other and extend in multiple different directions.

Similar to as described above, the lip former 360 can include central crack initiators (not labeled) in the top surfaces of the central section 370.

It should thus be appreciated from the above that in this illustrated example embodiment of present disclosure, each cross intersection connector 300 is positionable at an area where a contraction joint (or in certain instances a construction joint) will be formed between adjacent concrete slabs.

Example Tee Intersection Connector

Turning now to FIGS. 25 to 32, in this illustrated example embodiment, the tee intersection connector 400 of the concrete slab joint forming system includes: (a) a load transfer corner tongue former 410; and (b) a load transfer corner lip former 460 connected to the top of the load transfer corner tongue former 410. The load transfer corner tongue former 410 and the load transfer lip former 460 are configured to form an intersection area for two or three joint formers 100.

In the illustrated example embodiment, the tee intersection connector 400 is molded from a polymer. It should be appreciated that this tee intersection connector 400 can be made from other suitable materials in accordance with the present disclosure. In this illustrated example embodiment, this tee intersection connector 400 is a single monolithically formed piece that includes the load transfer corner tongue former 410 and the load transfer corner lip former 460. In other embodiments, the load transfer corner tongue former 410 and the load transfer corner lip former 460 or parts thereof can be separately formed and connected together.

The load transfer corner tongue former 410 includes upright vertically extending dividers 412*a*, 412*b*, and 412*c* that form two sections 420*a* and 420*b*. The dividers 412*a*, 412*b*, and 412*c* are connected by a wall connector 425*a*. The wall connector 425*a* defines an upright vertically extending substrate fastener receiver (not labeled) that is shaped, sized, and otherwise configured to receive a fastener (not shown) that connects the tee intersection connector 400 to a substrate (not shown) on which the concrete slabs formed using the tee intersection connector 400 will be positioned.

In this example embodiment, the section 420*a* extends outwardly in a first direction from the wall connector 425*a* and partially forms (with divider 412*b*) a slab concrete receipt pocket 438*a* that is wider at its opening, narrower at its innermost points, and is inwardly tapered from its opening to its innermost points.

Likewise, the section 420*c* extends outwardly in a second direction from the wall connector 425*b* and partially forms (with divider 412*b*) a slab concrete receipt pocket 438*b* that is wider at its opening, narrower at its innermost points, and is inwardly tapered from its opening to its innermost points.

The openings of the first and second slab concrete receipt pockets 438*a* and 438*b* thus face in two different directions.

The sections 420*a* and 420*b* each are of the same height in this example embodiment. It should be appreciated that the height of the sections can vary in accordance with the present disclosure. In various different example embodiments, the height is 2.75 inches (6.985 cms), 3.75 inches (9.525 cms), 5.5 inches (13.97 cms), or 7.5 inches (19.05 cms).

The sections 420*a* and 420*b* have the same depth in this example embodiment. It should be appreciated that the depths of the section can vary in accordance with the present disclosure.

The load transfer lip former 460 includes a central section 470, a first end connection section 480, a second end connection section 490, and a third end connection section 480*a* each of which are connected to the top of the divider 412*a*, 412*b*, and 412*c*.

The central section 470 is attached to the top of the dividers 412*a*, 412*a*, and 412*c*. The central section 470 includes top and bottom surfaces (not labeled) that are flat (or substantially flat) and extend in parallel (or substantially parallel) planes to one another in this illustrated example embodiment. The central section 470 includes two sections (not labeled) that correspond with the sections 420*a* and 420*b*.

In this example embodiment, each of the sections 420*a* and 420*b* and define a plurality of spaced-apart air release openings (not labeled) that each extend from the bottom surface of the central section 470 to the top surface of the central section 470. These air release openings enable air caught in the concrete under the load transfer lip former 460 to escape through such openings.

The first end connection section 480 includes top and bottom surfaces (not labeled). The first end connection section 480 includes a locking member portion 482 and a locking member receipt portion 486. The locking member portion 482 includes an upwardly extending locking member 484 (which is this example embodiment is an upwardly extending locking tab). The locking member receipt portion 486 defines a locking member receipt opening 488 configured to securely but releasably receive a locking member (and in this example embodiment an upwardly extending locking tab).

Likewise, the second end connection section 490 includes top and bottom surfaces (not labeled). The second end connection section 490 includes a locking member portion 492 and a locking member receipt portion 496. The locking member portion 492 includes an upwardly extending locking member 494 (which is this example embodiment is an upwardly extending locking tab). The locking member receipt portion 486 defines a locking member receipt opening 498 configured to securely but releasably receive a locking member (and in this example embodiment an upwardly extending locking tab).

Likewise, the third end connection section 480*a* includes top and bottom surfaces (not labeled). The third end connection section 480*a* includes a locking member portion 482*a* and a locking member receipt portion 486*a*. The locking member portion 482*a* includes an upwardly extending locking member 484*a* (which is this example embodiment is an upwardly extending locking tab). The locking member receipt portion 486*a* defines a locking member receipt opening 488*a* configured to securely but releasably receive a locking member (and in this example embodiment an upwardly extending locking tab).

As explained above, the first, second, and third end connection sections 480, 480*a*, and 490 are each configured to be connected to an end of a joint former 100 or to an extension connector 200. This enables two, or three joint formers 100 or extension connectors 200 to be connected to each other and extend in multiple different directions.

Similar to as described above, the lip former 460 can include central crack initiators (not labeled) in the top surfaces of the central section 470.

It should thus be appreciated from the above that in this illustrated example embodiment of present disclosure, each tee intersection connector 400 is positionable at an area where a contraction joint (or in certain instances a construction joint) will be formed between adjacent concrete slabs.

Example End Connector

Turning now to FIGS. 33 to 40, in this illustrated example embodiment, the end connector 500 of the concrete slab joint forming system includes: (a) a load transfer corner tongue former 510; and (b) a load transfer corner lip former 560 connected to the top of the load transfer corner tongue former 510. The load transfer corner tongue former 510 and the load transfer lip former 560 are configured to form an end area for a joint former 100.

In the illustrated example embodiment, this end connector 500 is molded from a polymer. It should be appreciated that this end connector 500 can be made from other suitable materials in accordance with the present disclosure. In this illustrated example embodiment, this end connector 500 is a single monolithically formed piece that includes the load transfer corner tongue former 510 and the load transfer corner lip former 560. In other embodiments, the load transfer corner tongue former 510 and the load transfer corner lip former 560 or parts thereof can be separately formed and connected together.

The load transfer corner tongue former 510 includes an upright vertically extending divider 512*a* that form two sections 520*a* and 520*b*. The divider 512*a* is connected to an upright vertically extending form connector 525*a*. The form connector 525*a* defines a horizontally extending fastener receivers (not labeled) that are shaped, sized, and otherwise configured to receive fasteners (not shown) that connects end connector 500 to formwork (not shown).

In this example embodiment, the section 520*a* extends outwardly in a first direction from the form connector 525*a* and forms a slab concrete receipt pocket 538*a* that is wider at its opening, narrower at its innermost points, and is inwardly tapered from its opening to its innermost points.

Likewise, the section 520*b* extends outwardly in a second direction from the form connector 525*b* and forms a slab concrete receipt pocket 538*b* that is wider at its opening, narrower at its innermost points, and is inwardly tapered from its opening to its innermost points.

The openings of the first and second slab concrete receipt pockets 538*a* and 538*b* thus face in different directions.

The sections 520*a* and 520*b* each are of the same height in this example embodiment. It should be appreciated that the height of the sections can vary in accordance with the present disclosure. In various different example embodiments, the height is 2.75 inches (6.985 cms), 3.75 inches (9.525 cms), 5.5 inches (13.97 cms), or 7.5 inches (19.05 cms).

The sections 520*a* and 520*b* have the same depth in this example embodiment. It should be appreciated that the depths of the section can vary in accordance with the present disclosure.

The load transfer lip former 560 includes a central section 570 and a first end connection section 580 connected to the top of the divider 512*a*.

The central section 570 is attached to the top of the divider 512*a*. The central section 570 includes top and bottom surfaces (not labeled) that are flat (or substantially flat) and extend in parallel (or substantially parallel) planes to one another in this illustrated example embodiment. The central section 570 includes two sections (not labeled) that correspond with the sections 520*a* and 520*b*.

In this example embodiment, each of the sections 520*a* and 520*b* can define a plurality of spaced-apart air release openings (not shown) that each extend from the bottom surface of the central section 570 to the top surface of the central section 570. These air release openings enable air caught in the concrete under the load transfer lip former 560 to escape through such openings.

The first end connection section 580 includes top and bottom surfaces (not labeled). The first end connection section 580 includes a locking member portion 582 and a locking member receipt portion 586. The locking member portion 582 includes an upwardly extending locking member 584 (which is this example embodiment is an upwardly extending locking tab). The locking member receipt portion 586 defines a locking member receipt opening 588 configured to securely but releasably receive a locking member (and in this example embodiment an upwardly extending locking tab).

As explained above, the first end connection sections 580 is configured to be connected to an end of a joint former 100 or to an extension connector 200.

The end connector 500 can further include an upwardly extending cleat 595 that is configured for attaching a line or string to the end connector 500 such as when two opposing end connectors are attached to opposing spaced apart boards that define the ends of the formwork such as partially shown in FIG. 51. The line or string can be used to align the joint former 100 between the boards. These boards can be used as an outer perimeter for the concrete slabs to be formed within the area defined by the boards.

It should thus be appreciated from the above that in this illustrated example embodiment of present disclosure, the end connector 500 is positionable at end area where a contraction joint (or in certain instances a construction joint) will be formed between adjacent concrete slabs.

Example Field Cut Connector

Figure 52:
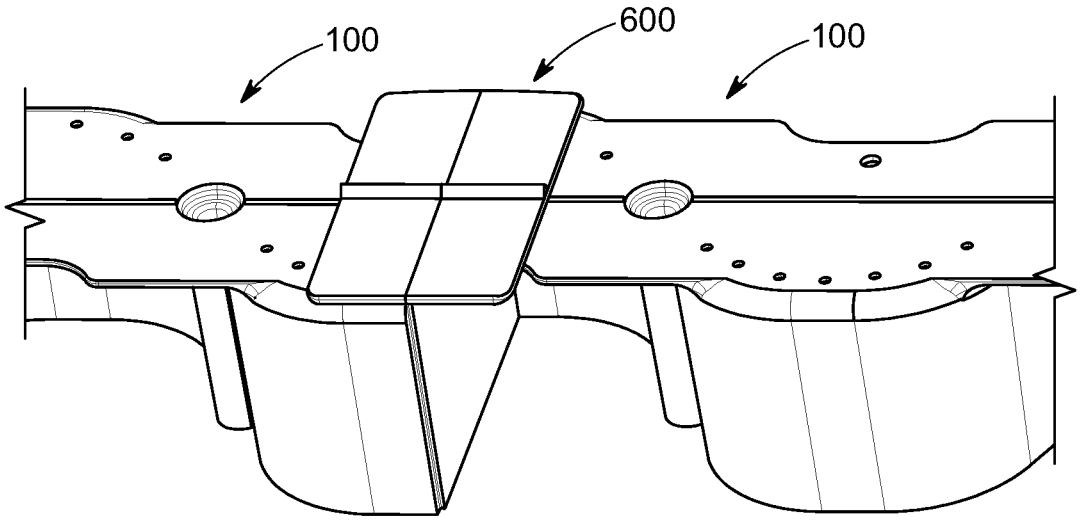
FIG. 52 is a fragmentary top perspective view of two concrete slab joint formers of FIG. 1 their respective ends connected by a field cut connector.

Turning now to FIGS. 41 to 48, in this illustrated example embodiment, the field cut connector 600 of the concrete slab joint forming system includes: (a) a load transfer tongue former 610; (b) a load transfer corner lip former 660 connected to the top of the load transfer tongue former 610; and (c) opposing locking lips 680 and 690. The load transfer tongue former 610, the load transfer lip former 660, and the locking lips 680 and 690 are configured to form a connection between two joint formers 100 such as shown in FIG. 52, where one or both of the joint formers 100 have been cut in the field during the installation process.

In the illustrated example embodiment, this field cut connector 600 is molded from a polymer. It should be appreciated that this field cut connector 600 can be made from other suitable materials in accordance with the present disclosure. In this illustrated example embodiment, this field cut connector 600 is a single monolithically formed piece that includes the load transfer tongue former 610, the load transfer corner lip former 660, and the locking lips 680 and 690. In other embodiments, the load transfer tongue former 610, the load transfer corner lip former 660, and the locking lips 680 and 690 or parts thereof can be separately formed and connected together.

The load transfer tongue former 610 includes an upright vertically extending upstanding divider 612. The load transfer lip former 660 is connected to the top of the divider 612. The locking lip 680 is connected to a first side of the divider 612 and extends therefrom below and spaced apart from the load transfer lip former 660. The locking lip 680 is connected to second side of the divider 612 and extends therefrom below and spaced apart from the load transfer lip former 660. The locking lips 680 and 690 respectively define lip former receipt pockets 685 and 698 configured to receive end portions of the lip formers of adjacent joint former 100 that are cut in the field.

The field cut connector is positionable at an area where a contraction joint (or in certain instances a construction joint) will be formed between adjacent concrete slabs. Such field cut connector 600 can be employed with two concrete slab joint formers 100 such as shown in FIG. 52 to connect such joint formers 100.

Example Connections

As mentioned above, and as shown in FIGS. 49, 50, 51, and 52, the concrete slab joint former 100, the extension connector 200, the cross intersection connector 300, the tee intersection connector 400, the end connector 500, and the field cut connector 600 can be releasably connected in various different configurations. As mentioned above, FIG. 49 shows two joint formers 100 directly connected to each other. As mentioned above, FIG. 51 shows a joint former 100 directly connected to and the end connector 500 and the end connected to formwork 10. As mentioned above, FIG. 52 shows two joint formers 100 connected to each other by a field cut connecter 600. FIG. 50 shows eight joint formers 100 connected by four cross intersection connectors 300.

Example Concrete Slab Forming Method

Referring now to FIGS. 53, 54, 55, and 56, one example method of using the concrete slab joint former 100 for forming a contraction (or control) joint between two adjacent concrete slabs 1000 and 2000 is shown. In this example embodiment, the joint former 100 is secured to a substrate (not shown) by fasteners (such as shown in FIG. 49) in the desired location of the contraction joint. The concrete slabs 1000 and 2000 are poured on opposites side of the joint former 100 such that: (1) the concrete extends into the opposing (such as pockets 138*b* to 138*f* and pockets 148*a* to 148*f*); (2) the air release openings in the segments of the lip former 160 (such as segments 173*b* to 173*g* and segments 174*a* to 174*f*) enable any air trapped under the lip former 160 to escape; and (3) the concrete then extends over the lip former 160 to the desired height of the concrete slabs 1000 and 2000. As the concrete starts to cure and harden a cut is formed in the concrete down from the top surface of the concrete to the top surface of the lip former 160. As the concrete cures and hardens the concrete slabs may separate to a certain degree along the cut line.

As the concrete cures and hardens, the respective lip and tongues will be formed in the concrete slabs 1000 and 2000. Specifically, in this example, concrete slab 1000 will include lip 1100, spaced apart tongues 1200*a*, 1200*b*, 1200*c*, 1200*d*, and 1200*e*, and spaced apart tongue receipt areas (not labeled) between such tongues. Likewise, as the concrete cures and hardens, in this example, concrete slab 2000 will include lip 2100, spaced apart tongues 2200*a*, 2200*b*, 2200*c*, 2200*d*, and 2200*e*, and spaced apart tongue receipt areas (not labeled) between such tongues.

Figure 53:
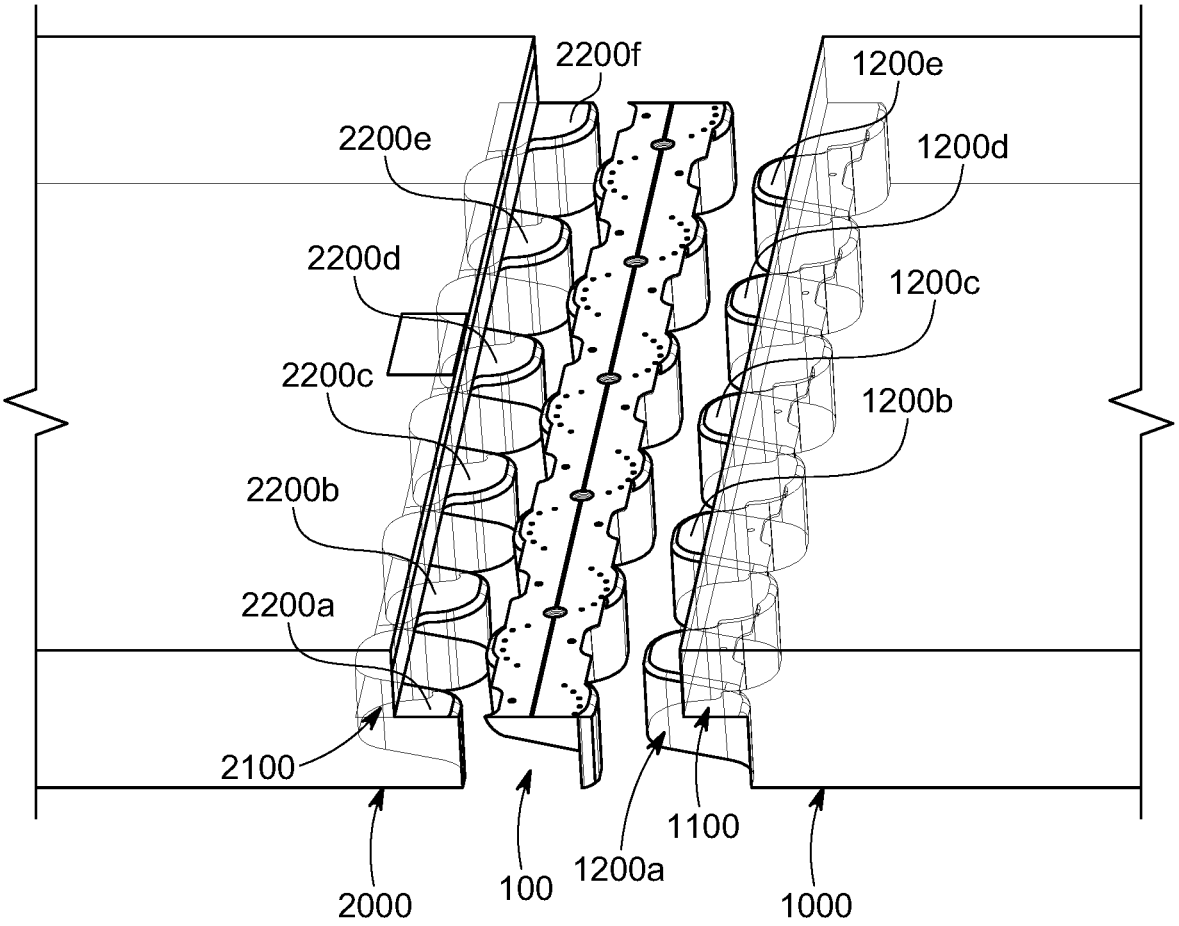
FIG. 53 is a top perspective view of the concrete slab joint former of FIG. 1 shown positioned between two adjacent concrete slabs (shown in fragmentary), and illustrating the structures in the adjacent concrete slabs formed by the concrete slab joint former.
Figure 54:
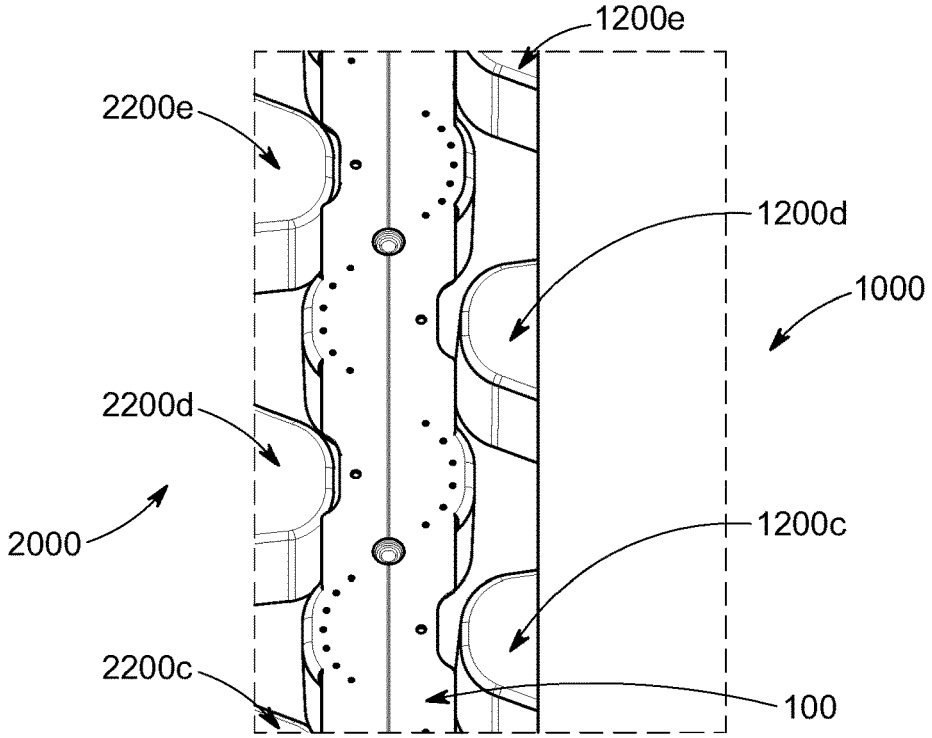
FIG. 54 is a fragmentary top perspective view of the concrete slab joint former of FIG. 1 shown positioned between two adjacent concrete slabs, and illustrating the structures in the adjacent concrete slabs formed by the concrete slab joint former.
Figure 55:
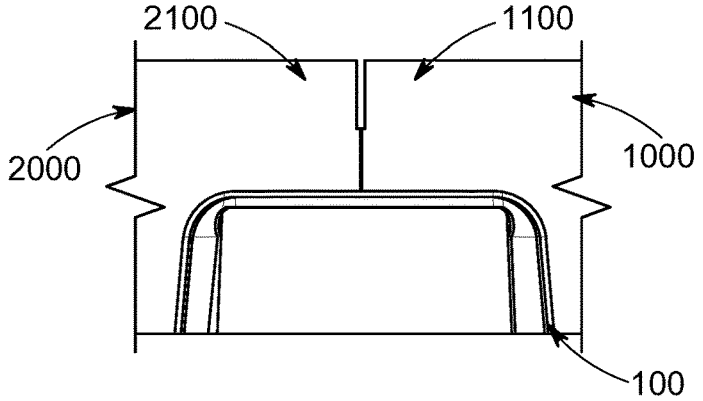
FIG. 55 is a fragmentary end cross-sectional view of the concrete slab joint former of FIG. 1 shown positioned between two adjacent concrete slabs, and illustrating the structures in the adjacent concrete slabs formed by the concrete slab joint former.

It should be appreciated that FIGS. 53 and 54 show the slabs 1000 and 2000 substantially further apart then they would actually separate solely to illustrate the respective tongues of the concrete slabs 1000 and 2000. In practice, the spaced apart tongues 1200*a*, 1200*b*, 1200*c*, 1200*d*, and 1200*e* of concrete slab 1000 would substantially extend in the pockets of the concrete slab 2000 and under the lip 2100 of the concrete slab 2000. Likewise, in practice, the spaced apart tongues 2200*a*, 2200*b*, 2200*c*, 2200*d*, 2200*e*, and 2200*f* of concrete slab 2000 would substantially extend in the pockets of the concrete slab 1000 and under the lip 1100 of the concrete slab 1000. In such respective positions, a sufficient vertical load on the concrete slab 1000 that causes the downward vertical movement of the concrete slab 1000 would cause the downward movement of the lip 1100 of the concrete slab 1000, which in turn would cause the lip 1100 to engage the spaced apart tongues 2200*a*, 2200*b*, 2200*c*, 2200*d*, 2200*e*, and 2200*f* of concrete slab 2000 and cause the downward vertical movement of the concrete slab 2000. Likewise, in such respective positions, a sufficient vertical load on the concrete slab 2000 that causes the downward vertical movement of the concrete slab 2000 would cause the downward movement of the lip 2100 of the concrete slab 2000, which in turn would cause the lip 2100 to engage the spaced apart tongues 1200*a*, 1200*b*, 1200*c*, 1200*d*, 1200*e*, and 1200*f* of concrete slab 1000 and cause the downward vertical movement of the concrete slab 1000. The concrete slabs 1000 and 2000 would thus vertically move together when a vertical load is placed on either one of the concrete slabs 1000 and 2000. The interaction of the respective lips and tongues of the concrete slabs will thus facilitate load transfer without dowels extend between the loads.

FIG. 57 shows an alternative use of the joint former 100 of the present disclosure. In this example embodiment, the joint former 100 is used with a joint edge assembly 5000 configured to protect the joint between concrete slabs. Examples of a joint edge assembly 5000 are described in U.S. Pat. Nos. 6,775,952 and 8,302,359. Various joint edge assemblies enable the joint edges to both self-open with respect to the opposite joint edge as the adjacent concrete slabs shrink during curing or hardening. The joint edge assembly 5000 protects the upper adjacent edges of the concrete slabs from damage that can occur when the joint opening creates a discontinuity in the concrete floor surface that can cause the wheels of a vehicle (such as a forklift truck) to impact the upper edges of the adjacent concrete slabs that form the joint. This damage to the edges of concrete slabs is commonly referred to as joint spalling. Joint spalling can interrupt the normal working operations of a facility by slowing down forklift and other truck traffic, and/or causing damage to trucks and the carried products. Severe joint spalling and uneven joints can cause loaded forklift trucks to overturn (which of course is dangerous to people in those facilities). Joint spalling can also be expensive and time consuming to repair. The joint edge assembly 5000 can be attached to the joint former 100 using suitable fasteners (not shown) that are inserted through the above described spaced-apart edge member attachment openings in the lip former 160 of the joint former 100.

FIG. 58 shows an alternative use of the joint former 100 of the present disclosure. In this example embodiment, the joint former 100 is used with formwork 6000 for forming a construction joint. The vertical extending sections (not labeled) of the formwork 6000 can extend into the plurality of spaced-apart formwork receipt areas 178*a*, 178*b*, 178*c*, 178*d*, 178*e*, 178*f*, 178*g*, 178*h*, 178*i*, 178*j*, 178*k*, and 1781 of the upper lip former 160 of the joint former 100, as mentioned above. This enables the horizontally extending member (not labeled) of the formwork 6000 to be positioned directly adjacent to the central axis of the joint former.

Figure 59:
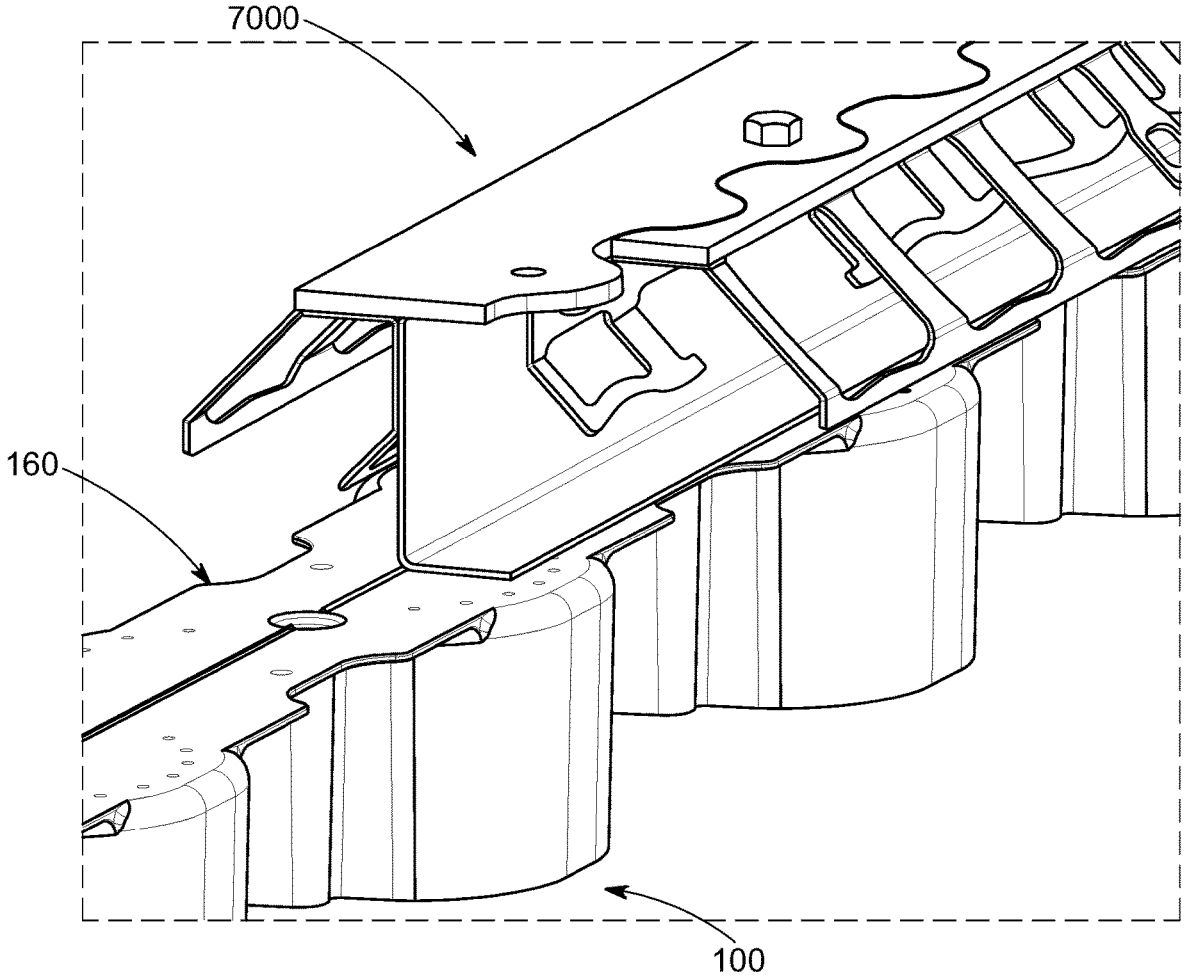
FIG. 59 is a fragmentary perspective view of an upright wall of another example edge member assembly attached above and to the concrete slab joint former of FIG. 1.
Figure 60:
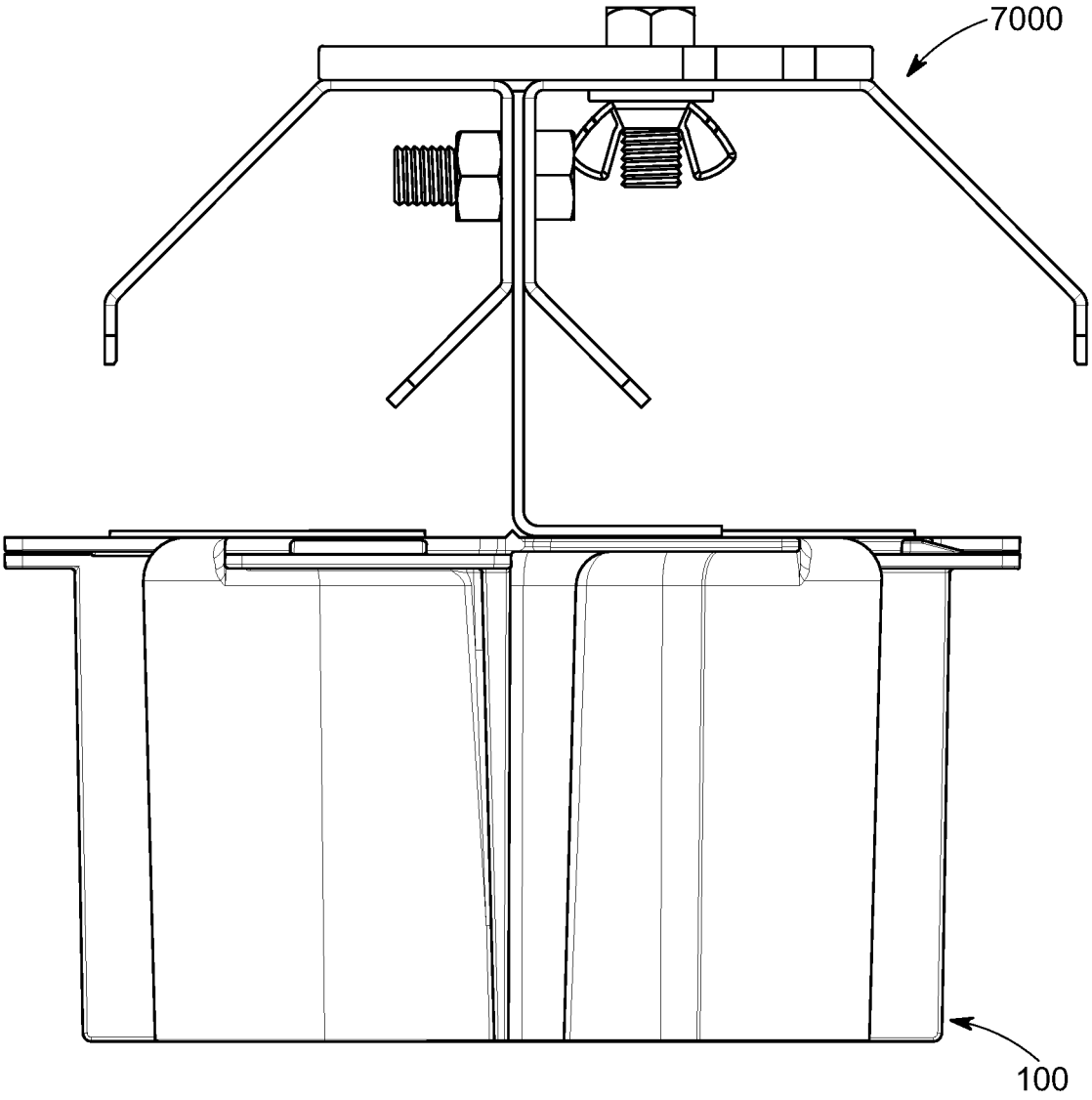
FIG. 60 is an end view of the upright wall of the example edge member assembly of FIG. 59 shown attached above and to the concrete slab joint former of FIG. 1.
Figure 61:
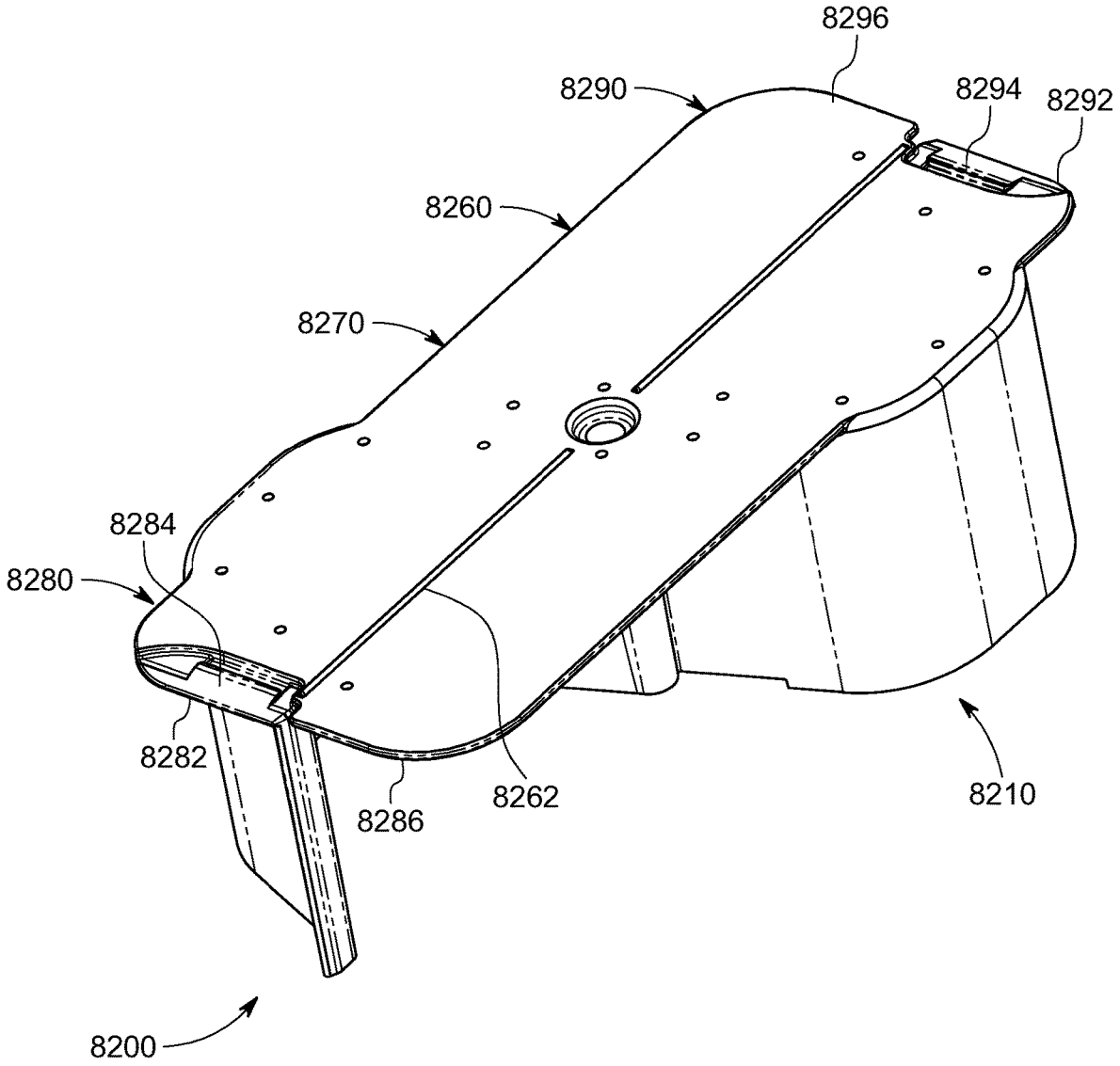
FIG. 61 is a top perspective view of an extension connector of another example embodiment of the concrete slab joint forming system of the present disclosure.
Figure 62:
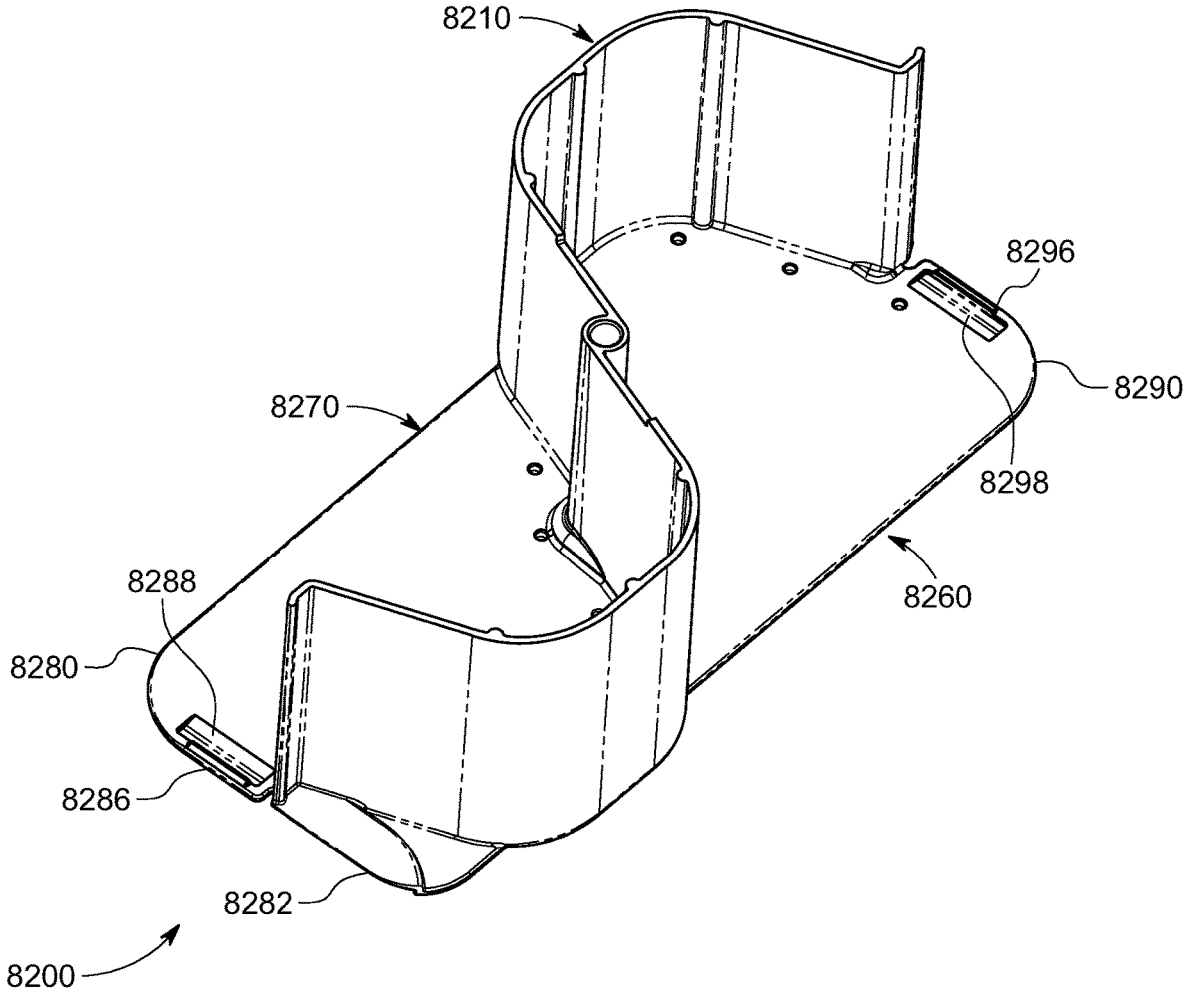
FIG. 62 is a bottom perspective view of the extension connector of FIG. 61.
Figure 63:
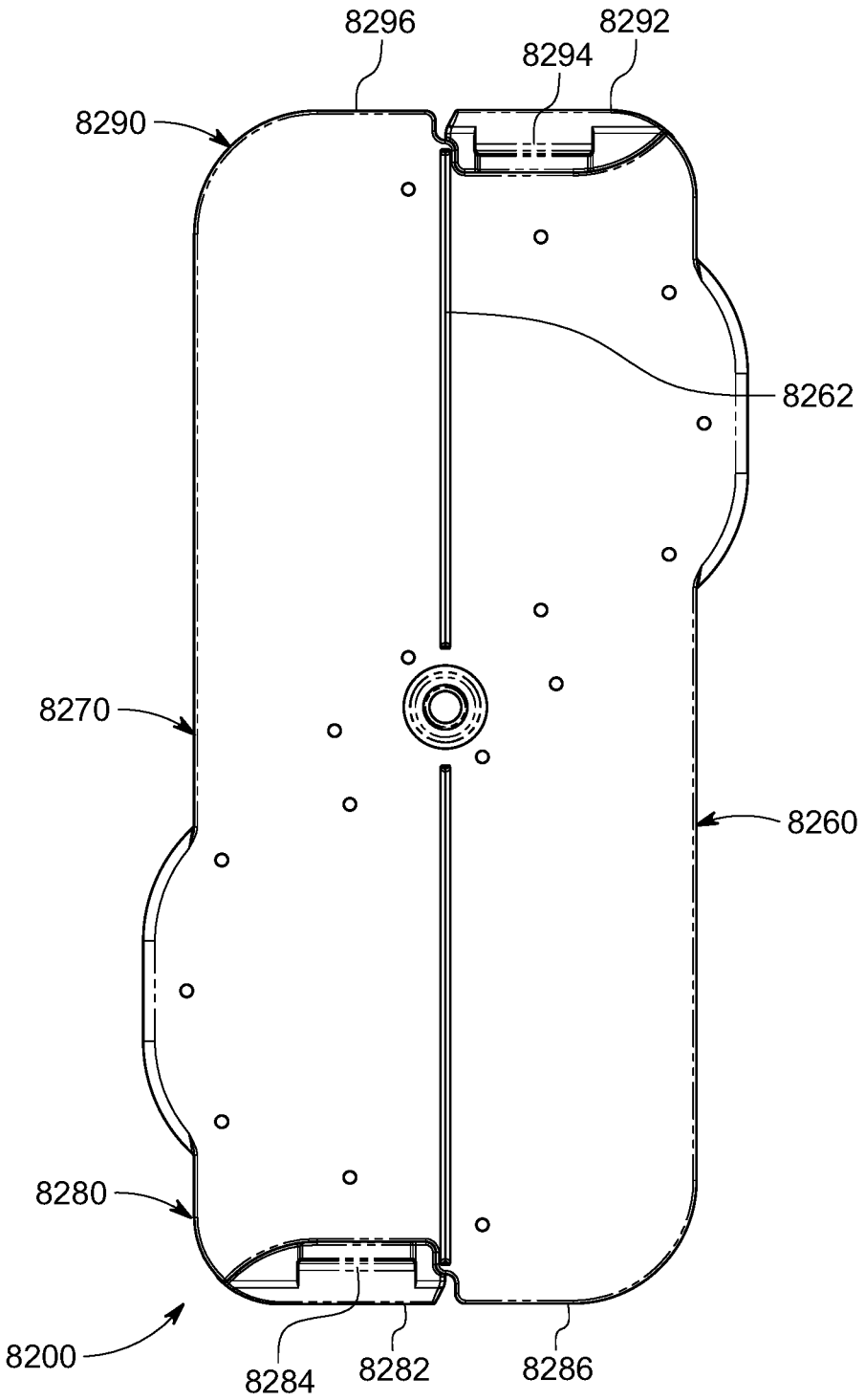
FIG. 63 is a top view of the extension connector of FIG. 61.
Figure 64:
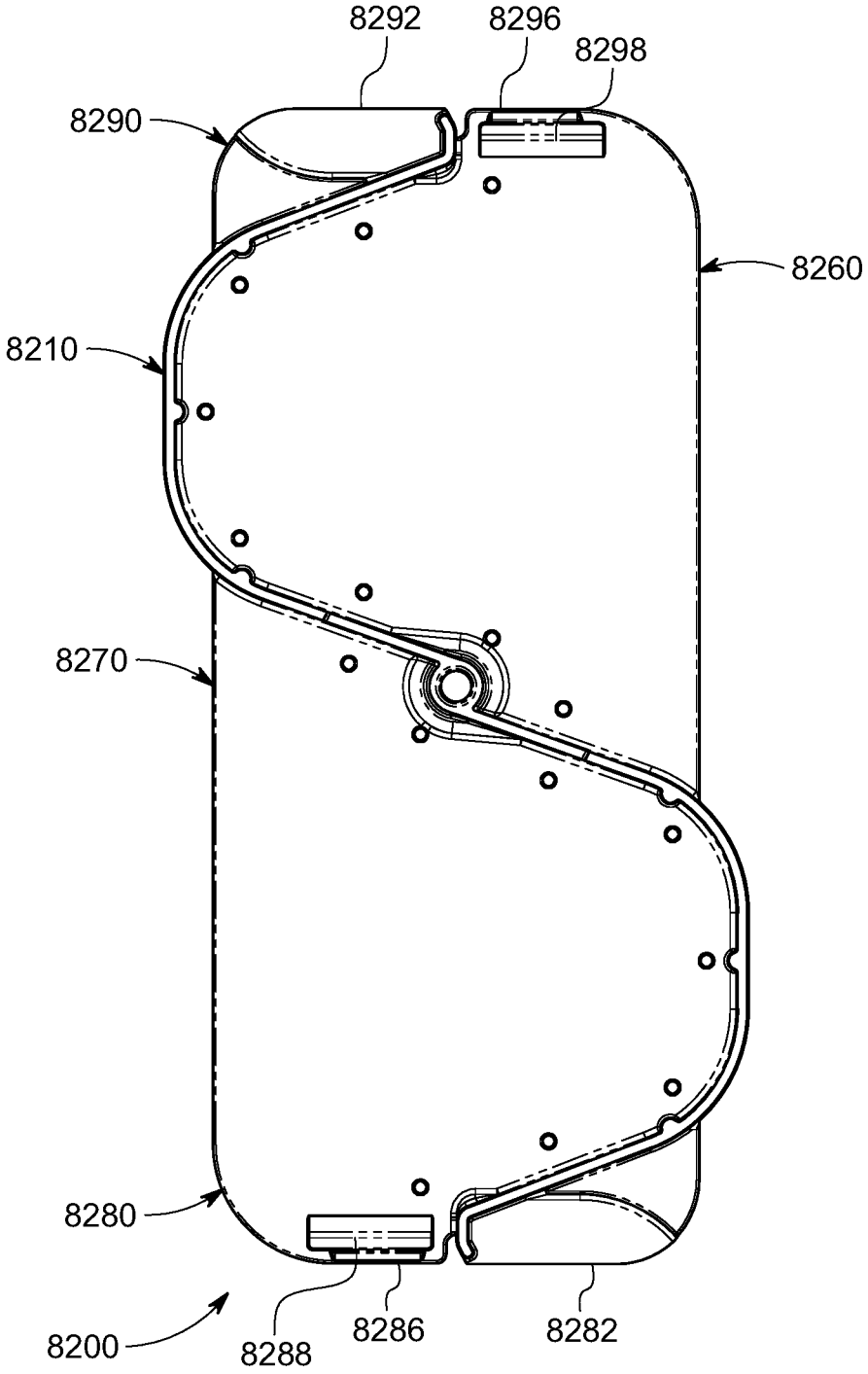
FIG. 64 is a bottom view of the extension connector of FIG. 61.
Figure 65:
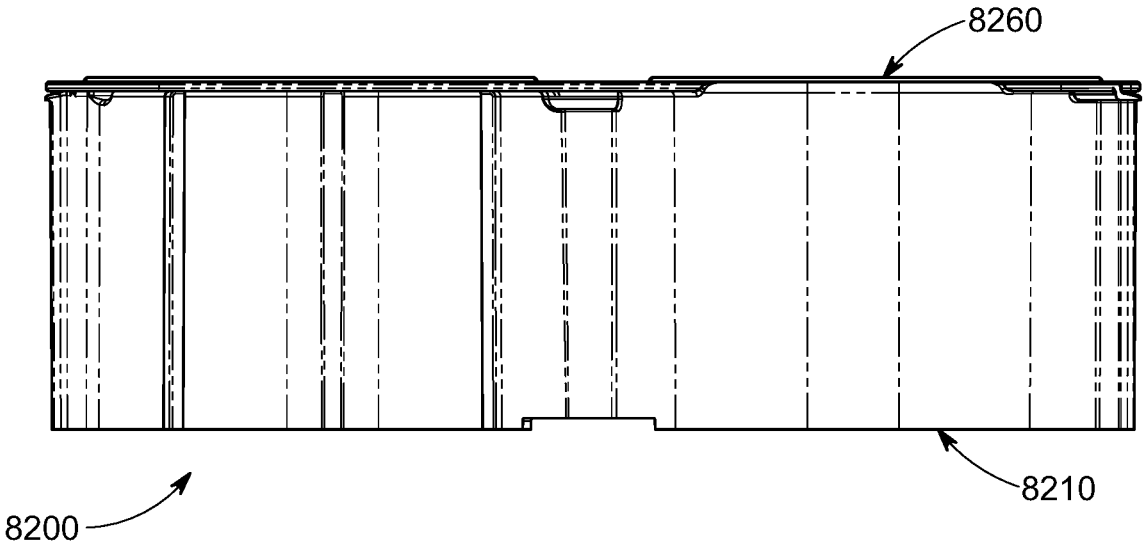
FIG. 65 is a first side view of the extension connector of FIG. 61.
Figure 66:
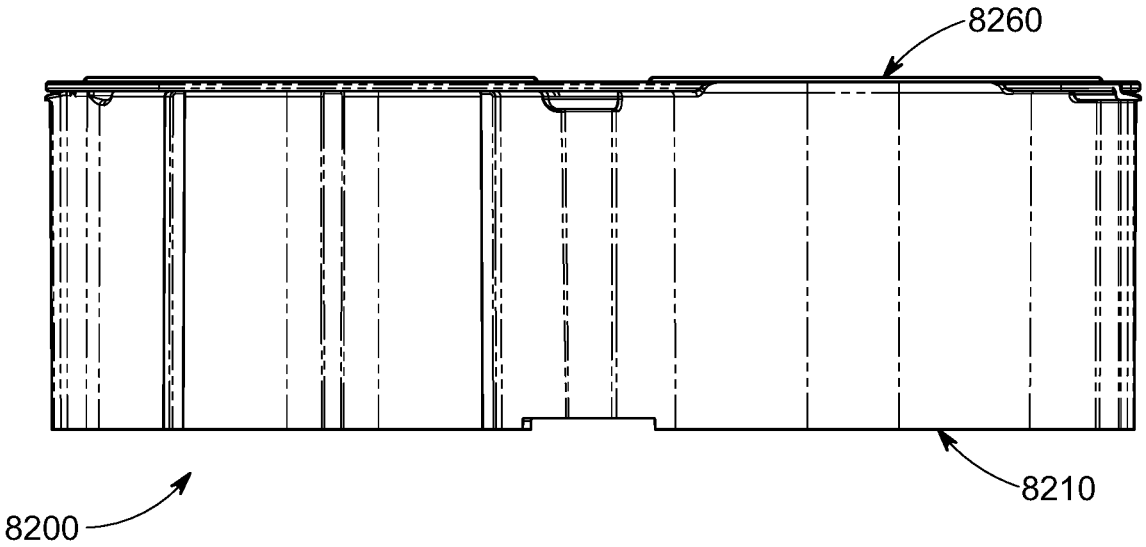
FIG. 66 is a second side view of the extension connector of FIG. 61.
Figure 67:
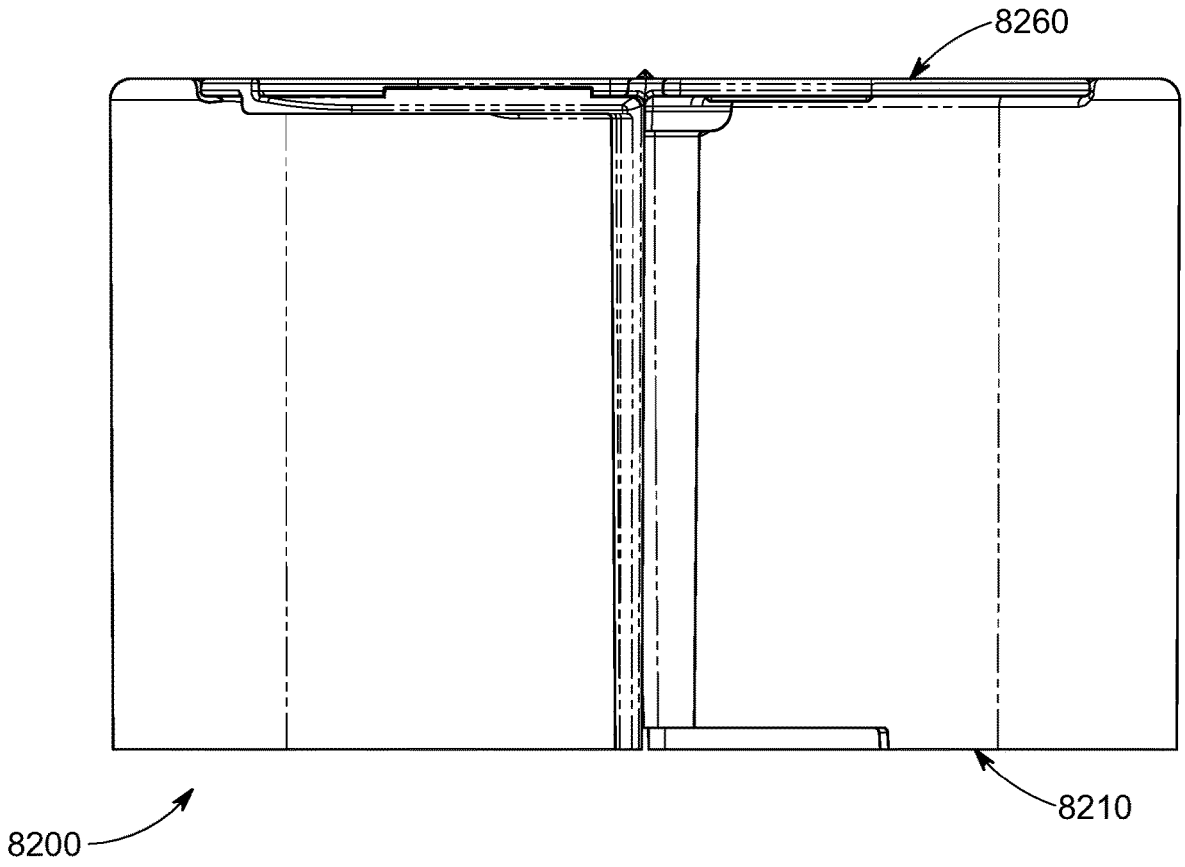
FIG. 67 is an enlarged first end view of the extension connector of FIG. 61.
Figure 68:
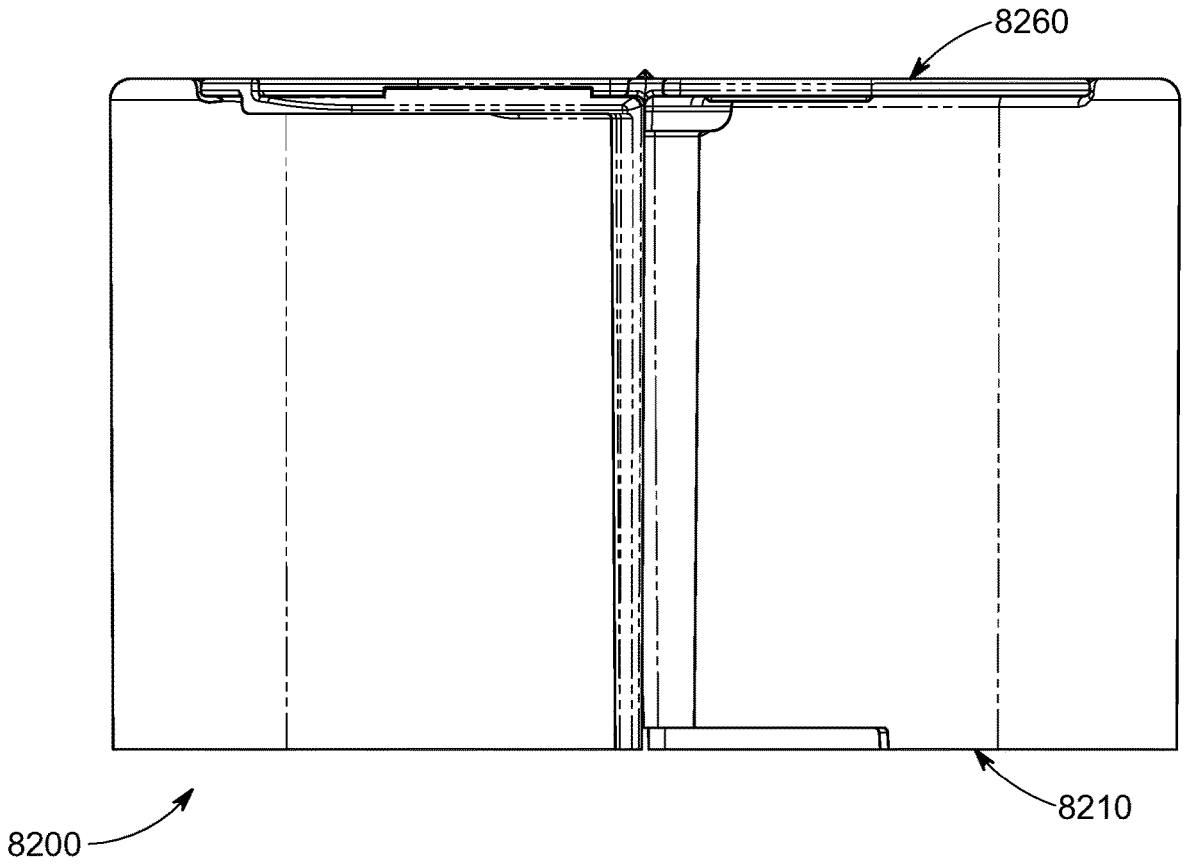
FIG. 68 is an enlarged second end view of the extension connector of FIG. 61.

FIGS. 59 and 60 show a further alternative use of the joint former 100 of the present disclosure. In this example embodiment, the joint former 100 is used with a joint edge assembly 7000 configured to protect the joint between concrete slabs. This joint edge assembly 7000 enable the joint edges to both self-open with respect to the opposite joint edge as the adjacent concrete slabs shrink during curing or hardening. The joint edge assembly 7000 protects the upper adjacent edges of the concrete slabs from damage that can occur when the joint opening creates a discontinuity in the concrete floor surface that can cause the wheels of a vehicle (such as a forklift truck) to impact the upper edges of the adjacent concrete slabs that form the joint and thus against joint spalling (explained above). The joint edge assembly 7000 can be attached to the joint former 100 using suitable fasteners (not shown) that are inserted through the above described spaced-apart edge member attachment openings in the lip former 160 of the joint former 100.

Further Example Extension Connector

Turning now to FIGS. 61 to 68, in this illustrated example embodiment, the extension connector 8200 of the concrete slab joint forming system is substantially similar to the extension connector 200 but has a different load transfer lip former 8260 connected to the top of the load transfer tongue former 8210. The load transfer tongue former 8210 and the load transfer lip former 8260 are configured to form opposing load transfer lips and opposing load transfer tongues in the adjacent concrete slabs as discussed above and such that the opposing load transfer lips and opposing load transfer tongues are configured to transfer vertical forces between the adjacent concrete slabs without the use of dowels as further explained below.

In the illustrated example embodiment, the extension connector 8200 is molded from a polymer. It should be appreciated that the extension connector 8200 can be made from other suitable materials in accordance with the present disclosure. In this illustrated example embodiment, this extension connector 8200 is a single monolithically formed piece that includes the load transfer tongue former 8210 and the load transfer lip former 8260. In other embodiments, the load transfer tongue former 8210 and the load transfer lip former 8260 or parts thereof can be separately formed and connected together.

The load transfer tongue former 8210 is identical or substantially identical to the load transfer tongue former 210, and thus for brevity is not described herein.

The load transfer lip former 8260 includes a central section 8270, a first end connection section 8280, and a second end connection section 8290. The central section 8270 is attached to the top of the load transfer tongue former 8210, and is identical or substantially identical to the central section 270 of the load transfer tongue former 210, and thus for brevity is not described herein. Although not shown, the central section 8270 segments can define a plurality of spaced-apart formwork receipt areas that can be used to receive upright formwork members. It should also be appreciated that the lip former 8260 defines a longitudinally extending central crack initiator 8262 in the central section 8270, the first end connection section 8280, and the second end connection section 8290. This crack initiator 8262 assists in facilitating the formation of the crack between the adjacent concrete slabs when the installer cuts the concrete from the top to form the contraction joint between the two concrete slabs.

The first end connection section 8280 includes top and bottom surfaces (not labeled). The first end connection section 8280 includes a locking member portion 8282 and a locking member receipt portion 8286. The locking member portion 8282 includes an upwardly extending locking member 8284 (which is this example embodiment is an upwardly extending locking tab). The locking member receipt portion 8286 defines a locking member receipt indentation 8288 configured to securely but releasably receive a locking member (and in this example embodiment an upwardly extending locking tab). This first connection section is thus slightly alternatively configured in comparison to the first connection section of the extension connector 200.

Likewise, the second end connection section 8290 includes top and bottom surfaces (not labeled). The second end connection section 8290 includes a locking member portion 8292 and a locking member receipt portion 8296. The locking member portion 8292 includes an upwardly extending locking member 8294 (which is this example embodiment is an upwardly extending locking tab). The locking member receipt portion 8286 defines a locking member receipt indentation 8298 configured to securely but releasably receive a locking member (and in this example embodiment an upwardly extending locking tab). This second connection section is thus slightly alternatively configured in comparison to the second connection section of the extension connector 200.

The first end connection section 8280 and the second end connection section 8290 are configured with the locking member portion 8282 and the locking member receipt portion 8286 are oppositely positioned from the locking member portion 8292 and the locking member receipt portion 8296. This enables two extension connectors 8200 to be connected to each other end to end.

It should also be appreciated that these alternative connection sections can be employed in the concrete slab joint former 100, the cross intersection connector 300, the tee intersection connector 400, and the end connector 500. In such embodiments, these components can be suitably connected such as described above.

It should be appreciated from the above that in various embodiments of the present disclosure, none of the concrete slab joint formers, the extension connectors, the cross intersection connectors, the tee intersection connectors, the end connectors, and the field cut connectors include any anchors that extend into the adjacent concrete slabs.

In various other embodiments of the concrete slab joint forming system of the present disclosure, the concrete slab joint formers and/or the extension connectors can include alternatively configured load transfer tongue formers. For example, the one or more of the sections or segments thereof can be straight, differently curved, differently rounded, trapezoidal, irregular in the wave pattern or amplitude, or otherwise formed.

In various other embodiments of the concrete slab joint forming system of the present disclosure, concrete slab joint former can be formed from two longitudinally adjacent separable elongated load transfer tongue formers and two longitudinally adjacent separate elongated load transfer lip formers respectively connected to the tops of the load transfer tongue formers. In various such embodiments, each of the concrete slab joint former can include one or more anchors that extend into the respective concrete slabs. In various embodiments, the extension connectors, the cross intersection connectors, the tee intersection connectors, the end connectors, and the field cut connectors can be similarly formed from multiple sections.

In various other embodiments of the concrete slab joint forming system of the present disclosure, one or more height adjustment members can be connected to or used with the concrete slab joint formers, the extension connectors, the cross intersection connectors, the tee intersection connectors, the end connectors, and the field cut connectors.

Various changes and modifications to the above-described embodiments described herein will be apparent to those skilled in the art. These changes and modifications can be made without departing from the spirit and scope of this present subject matter and without diminishing its intended advantages.

The claims are as follows:

1. A concrete slab joint former formed from a polymer and comprising:

a load transfer tongue former having a top edge and a bottom edge, the load transfer tongue former including an upstanding waveform having a plurality of tongue forming concrete receipt sections that are each connected to another one of the tongue forming concrete receipt sections by a section connector, wherein each of the section connectors defines an upright substrate fastener receiver configured to receive a fastener to connect the concrete slab joint former to a substrate on which adjacent concrete slabs will be positioned; and a load transfer lip former having a top surface and a bottom surface, wherein the bottom surface of the load transfer lip former is connected to the top edge of the load transfer tongue former along the entire top edge of the load transfer tongue former and the top edge of the load transfer tongue former does not extend above the load transfer lip former, wherein the load transfer tongue former and the load transfer lip former are shaped to form opposing load transfer lips and opposing load transfer tongues in the adjacent concrete slabs, such that the opposing load transfer lips and opposing load transfer tongues are engageable to transfer forces between the adjacent concrete slabs.

2. The concrete slab joint former of claim 1, which is a single monolithically formed piece that includes the load transfer tongue former and the load transfer lip former.

3. The concrete slab joint former of claim 1, wherein the plurality of tongue forming concrete receipt sections include first tongue forming concrete receipt segments that each extends outwardly in a first direction from a central axis of the concrete slab joint former and include the second tongue forming concrete receipt segments that each extends outwardly in a second opposite direction from the central axis.

4. The concrete slab joint former of claim 1, wherein the plurality of tongue forming concrete receipt sections define a plurality of spaced-apart first slab concrete receipt pockets that are wider at their openings, narrower at their innermost points, and are inwardly tapered from their openings to their innermost points.

5. The concrete slab joint former of claim 1, wherein the load transfer lip former includes a central section connected to the top of the load transfer tongue former, a first end connection section, and a second end connection section.

6. The concrete slab joint former of claim 5, wherein the central section of the load transfer lip former includes a plurality of sections that respectively have a plurality of segments that correspond to segments of the load transfer tongue former, and wherein each of the segments of the load transfer lip former define a plurality of spaced-apart release openings.

7. The concrete slab joint former of claim 5, wherein the first end connection section includes a locking member portion and a locking member receipt portion, and the second end connection section includes a locking member portion and a locking member receipt portion.

8. The concrete slab joint former of claim 7, wherein the first end connection section and the second end connection section are configured with their respective locking member portions and the locking member receipt portions oppositely positioned to enable either end of the concrete slab joint former to be connected to either end of a second concrete slab joint former.

9. The concrete slab joint former of claim 1, wherein the load transfer lip former defines a longitudinally and upwardly extending central crack initiator.

10. A concrete slab joint former comprising:

a load transfer tongue former having a top edge and a bottom edge and including an upstanding waveform having a plurality of tongue forming concrete receipt sections, the plurality of tongue forming concrete receipt sections are each connected to another one of the tongue forming concrete receipt sections by a section connector, wherein each of the section connectors defines an upright substrate fastener receiver configured to receive a fastener to connect the concrete slab joint former to a substrate on which the concrete slabs will be positioned; and a load transfer lip former including a central section connected to the top of the load transfer tongue former, a first end connection section including a locking member portion and a locking member receipt portion, and a second end connection section including a locking member portion and a locking member receipt portion, wherein the top edge of the load transfer tongue former does not extend above the load transfer lip former, wherein the locking member portion and the locking member receipt portion of the first end connection section are separate and spaced apart longitudinally from the locking member portion and the locking member receipt portion of the first second connection, wherein the locking member portion of the first end connection section is separate and spaced apart transversely from the locking member receipt portion of the first end connection section, wherein the locking member portion of the second end connection section is separate and spaced apart transversely from the locking member receipt portion of the second end connection section, and wherein the load transfer tongue former and the load transfer lip former are shaped to form opposing load transfer lips and opposing load transfer tongues in adjacent concrete slabs, such that the opposing load transfer lips and opposing load transfer tongues are engageable to transfer forces between the adjacent concrete slabs.

11. The concrete slab joint former of claim 10, which is a single monolithically formed polymer piece that includes the load transfer tongue former and the load transfer lip former.

12. The concrete slab joint former of claim 10, wherein the plurality of tongue forming concrete receipt sections include first tongue forming concrete receipt segments that each extends outwardly in a first direction from a central axis of the concrete slab joint former and include second tongue forming concrete receipt segments that each extends outwardly in a second opposite direction from the central axis.

13. The concrete slab joint former of claim 10, wherein the plurality of tongue forming concrete receipt sections define a plurality of spaced-apart first slab concrete receipt pockets that are wider at their openings, narrower at their innermost points, and are inwardly tapered from their openings to their innermost points.

14. The concrete slab joint former of claim 10, wherein the load transfer lip former defines a longitudinally and upwardly extending central crack initiator.

15. A concrete slab joint former comprising:

a load transfer tongue former having a top edge and a bottom edge and including an upstanding waveform having a plurality of tongue forming concrete receipt sections connected to another one of the tongue forming concrete receipt sections by a section connector, wherein each of the section connectors defines an upright substrate fastener receiver configured to receive a fastener to connect the concrete slab joint former to a substrate on which the concrete slabs will be positioned; and a load transfer lip former, wherein the top edge of the load transfer tongue former does not extend above the load transfer lip former, wherein the load transfer tongue former and the load transfer lip former are shaped to form opposing load transfer lips and opposing load transfer tongues in adjacent concrete slabs, such that the opposing load transfer lips and opposing load transfer tongues are engageable to transfer forces between the adjacent concrete slabs.

16. The concrete slab joint former of claim 15, wherein the load transfer lip former includes a top surface and a bottom surface, wherein the bottom surface of the load transfer lip former is connected to the top edge of the load transfer tongue former along the entire top edge of the load transfer tongue former.

* * * * *